United States Patent [19]

Johnson

[11] 4,361,161

[45] Nov. 30, 1982

[54] COIN HANDLING DEVICE

[75] Inventor: Raymond A. Johnson, Hot Springs, Ark.

[73] Assignee: UMC Industries, Inc., Stamford, Conn.

[21] Appl. No.: 299,497

[22] Filed: Sep. 4, 1981

Related U.S. Application Data

[63] Continuation of Ser. No. 36,335, May 4, 1979, abandoned.

[51] Int. Cl.[3] ..... G07D 3/00; G07F 1/04

[52] U.S. Cl. ..... 133/3 R; 133/2; 133/4 A; 194/1 C; 194/1 K

[58] Field of Search ..... 194/1 C, 1 D, 1 K, 1 L, 194/1 N; 133/2, 3 R, 3 C, 3 D, 4 R, 4 A, 5 R

[56] References Cited

U.S. PATENT DOCUMENTS

| | | | |
|---|---|---|---|
| 2,108,651 | 2/1938 | Cherry et al. | 194/1 K X |
| 2,585,718 | 2/1952 | Adams et al. | 133/2 X |
| 2,718,352 | 9/1955 | Nicolaus | 194/1 K X |
| 3,080,035 | 3/1963 | Diaz | 133/4 R X |
| 3,082,852 | 3/1963 | Melvin et al. | 133/5 R X |
| 3,159,260 | 12/1964 | Melvin et al. | 133/5 R X |
| 3,182,780 | 5/1965 | Jenkins, Sr. | 194/94 X |
| 3,204,648 | 9/1965 | Rumer, Jr. et al. | 133/2 |
| 3,335,838 | 8/1967 | Schuller et al. | 133/4 R X |
| 3,387,616 | 6/1968 | Bortz et al. | 133/3 R |
| 3,788,333 | 1/1974 | Johnson | 133/2 |
| 3,901,368 | 8/1975 | Klinger | 194/100 A |
| 3,948,377 | 4/1976 | Hayashi et al. | 194/1 C |
| 4,080,973 | 3/1978 | Kobayashi | 133/5 R |
| 4,121,603 | 10/1978 | Hayashi | 133/2 |
| 4,221,227 | 9/1980 | Heiman | 133/3 D |

FOREIGN PATENT DOCUMENTS

| | | | |
|---|---|---|---|
| 31415 | 1/1973 | Australia | 133/3 D |
| 2815045 | 10/1979 | Fed. Rep. of Germany | 133/4 A |
| 1548504 | 7/1979 | United Kingdom | 194/1 C |

*Primary Examiner*—Robert B. Reeves
*Assistant Examiner*—Edward M. Wacyra
*Attorney, Agent, or Firm*—Senniger, Powers, Leavitt and Roedel

[57] ABSTRACT

Positioning surfaces and complementary surfaces on the walls and frame of a coin handling device partially restrain and position those walls. Positioning surfaces and complementary surfaces on a coin dispensing sub-assembly and on the frame partially restrain and position that sub-assembly. A gate adjacent the outlet of a passageway, which is defined by two of the walls, can hold a coin and selectively direct that coin toward a coin return chute or a cash box chute while simultaneously preventing the exiting of any further coins in that passageway. Subsequently, that gate can receive and hold the next of those further coins, and then selectively direct that coin to the coin return chute or to the cash box chute. Coin slides in the coin dispensing sub-assembly are confined for reciprocal movement; and they have gears adjacent them which are axially translatable into and out of engagement with those slides to drive those slides. Any desired gear can selectively engage and drive its slide while the other gears are permitted to remain out of engagement with their slides. A selector motor can select the gear which is to be translated to drive its slide. That selector motor also moves the gate relative to the passageway. A coin reservoir has an entrance adjacent the upper end thereof and an entrance adjacent the lower end thereof; and a deflector can be disposed in different fixed positions to cause coins to be directed toward the upper entrance or toward the lower entrance.

47 Claims, 41 Drawing Figures

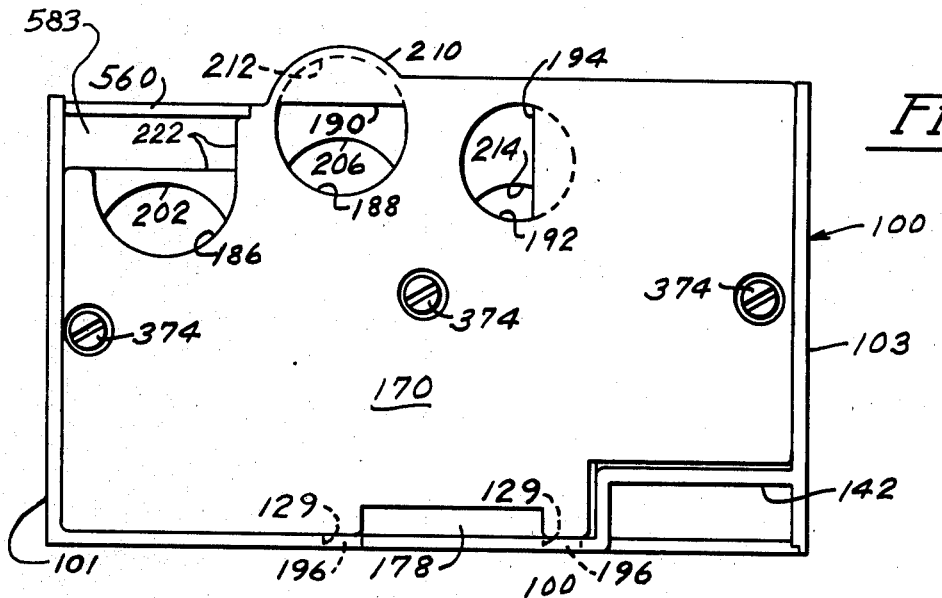
FIG. 3.
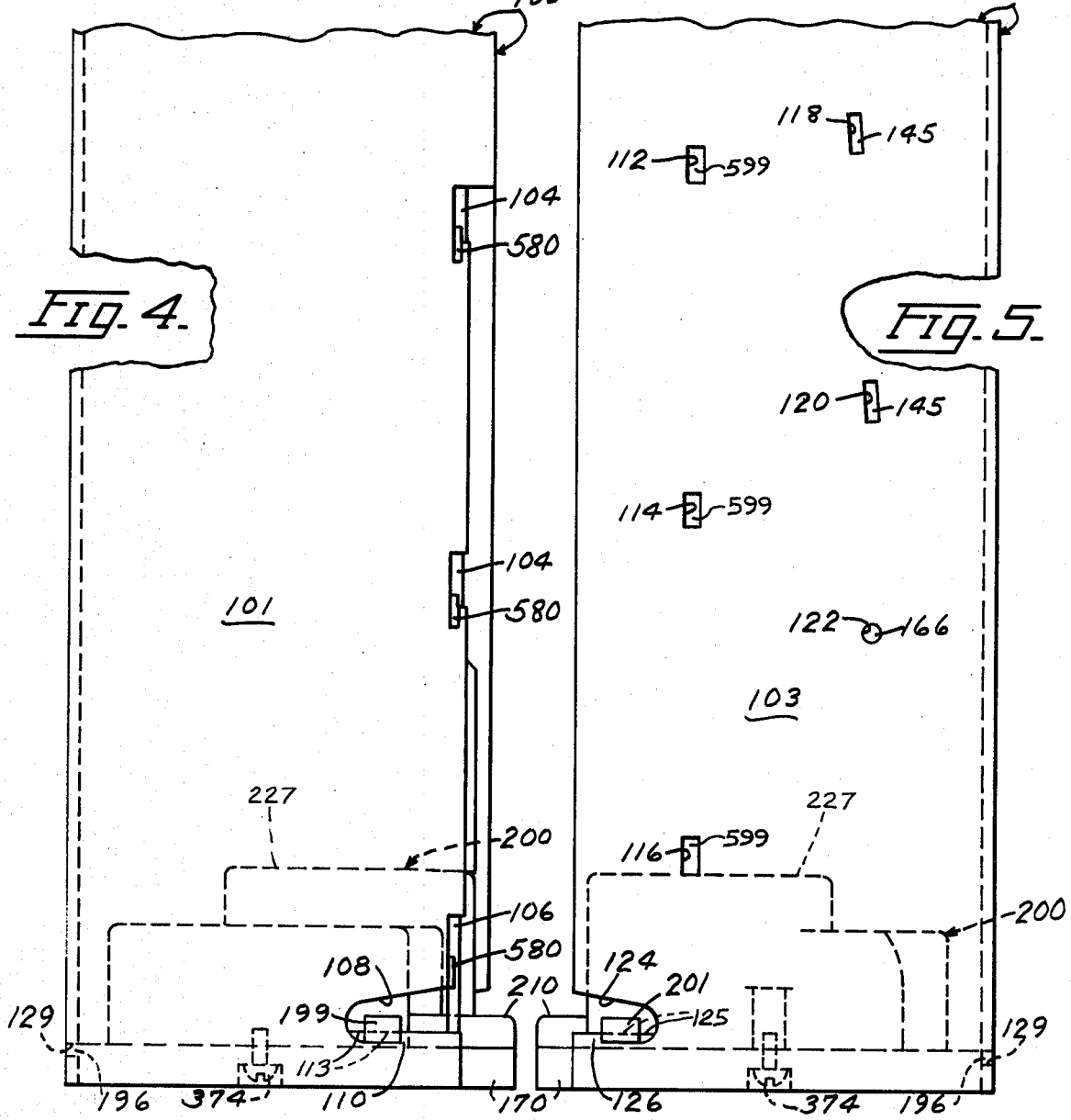
FIG. 4.
FIG. 5.

FIG. 8
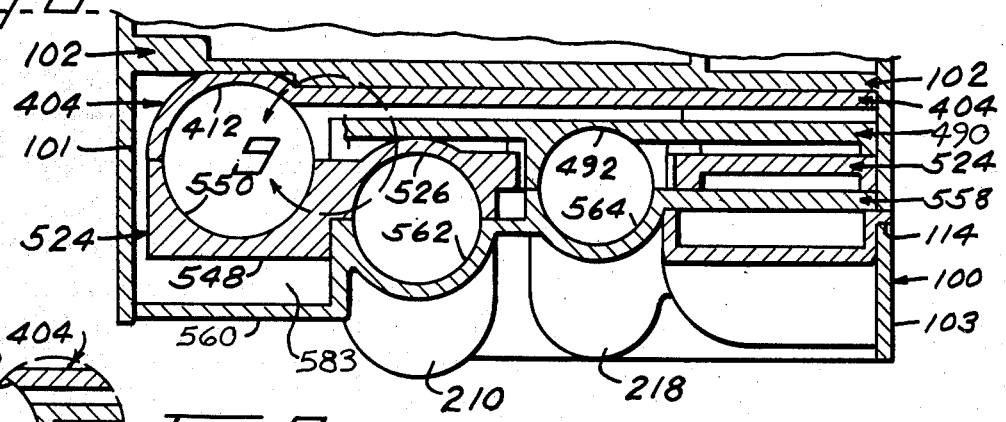
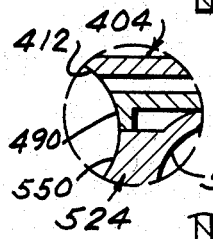
FIG. 9
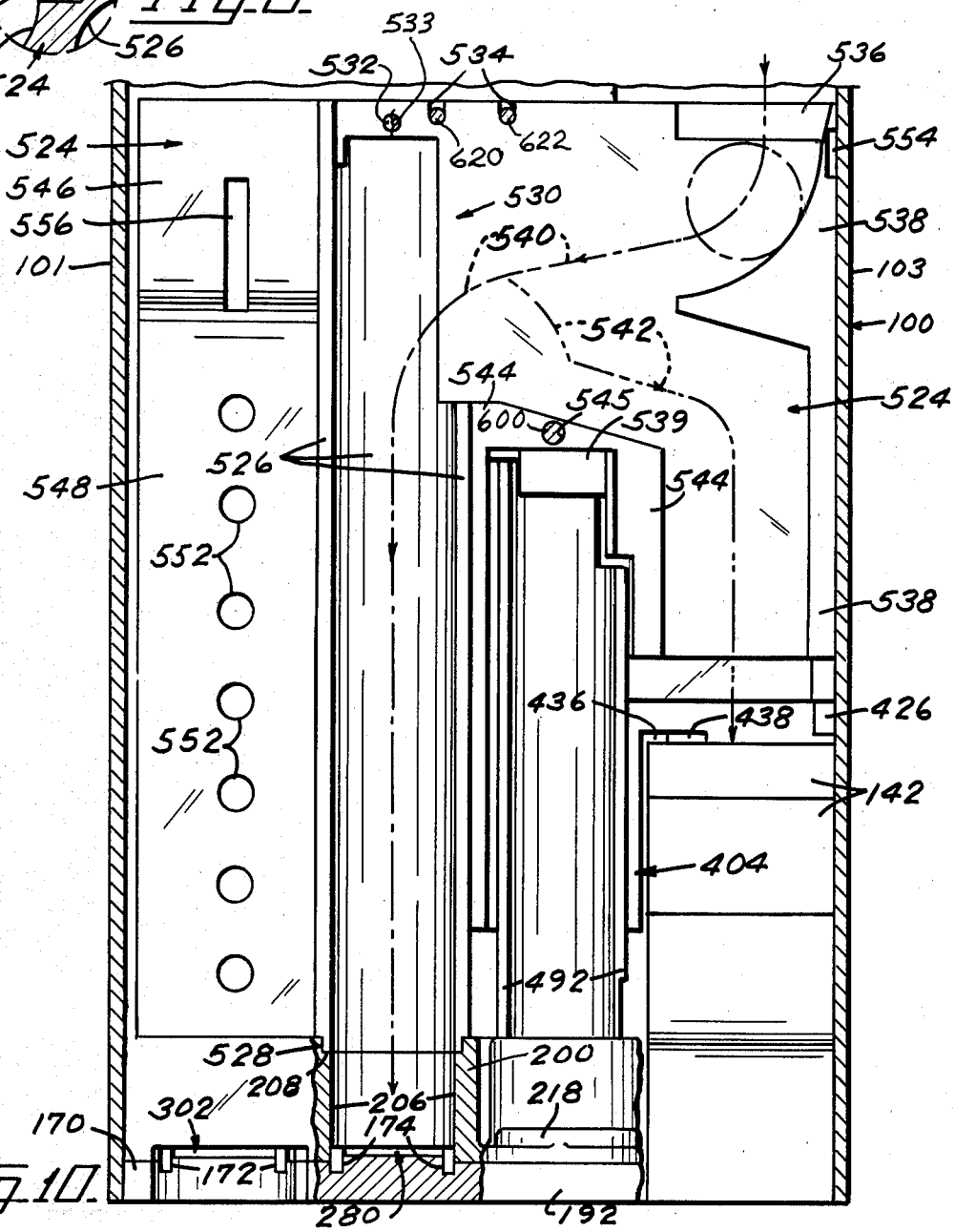
FIG. 10

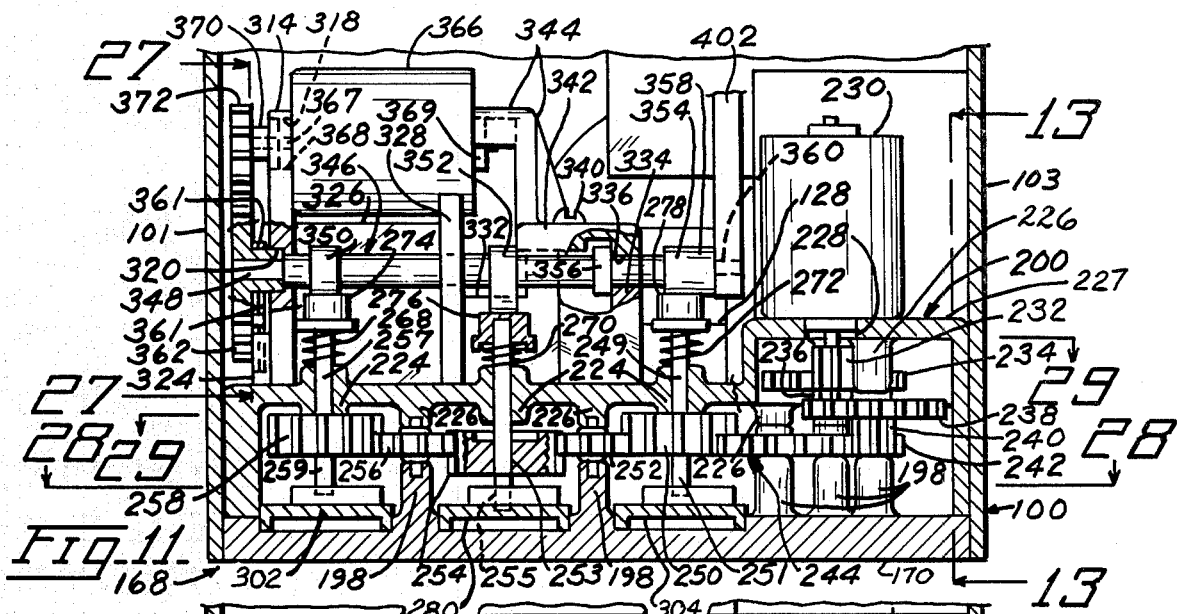
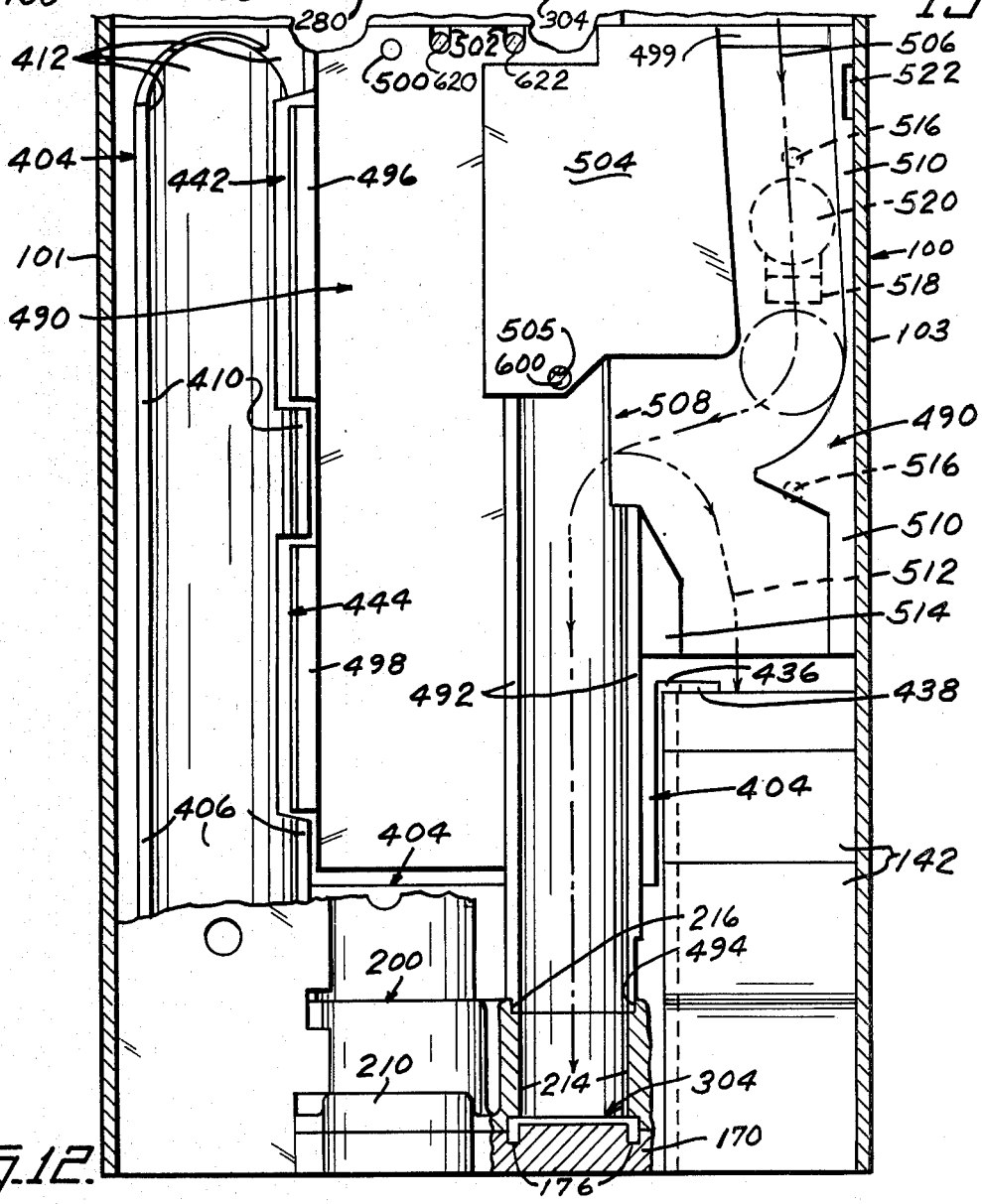
FIG. 12.

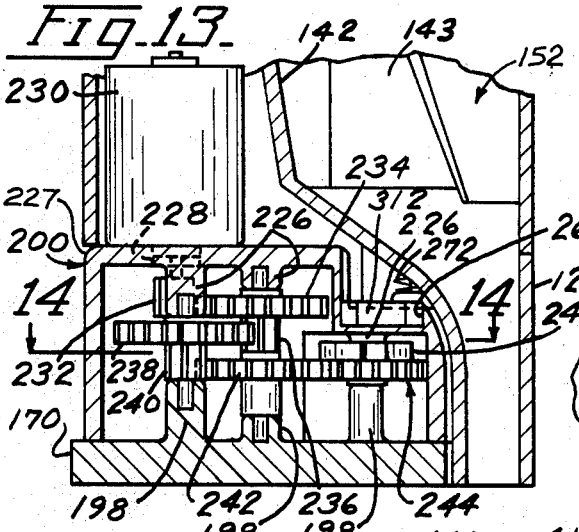
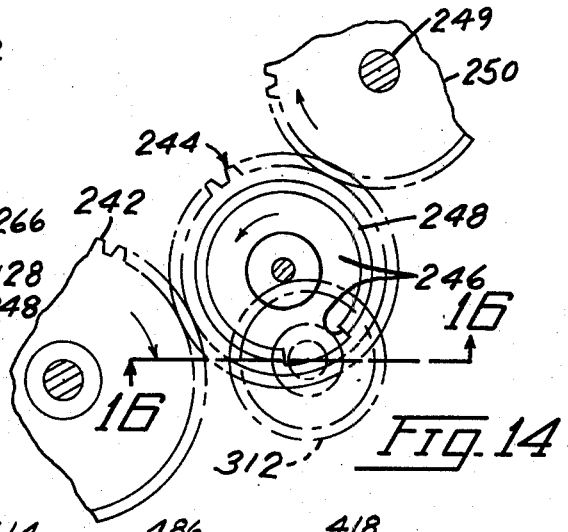
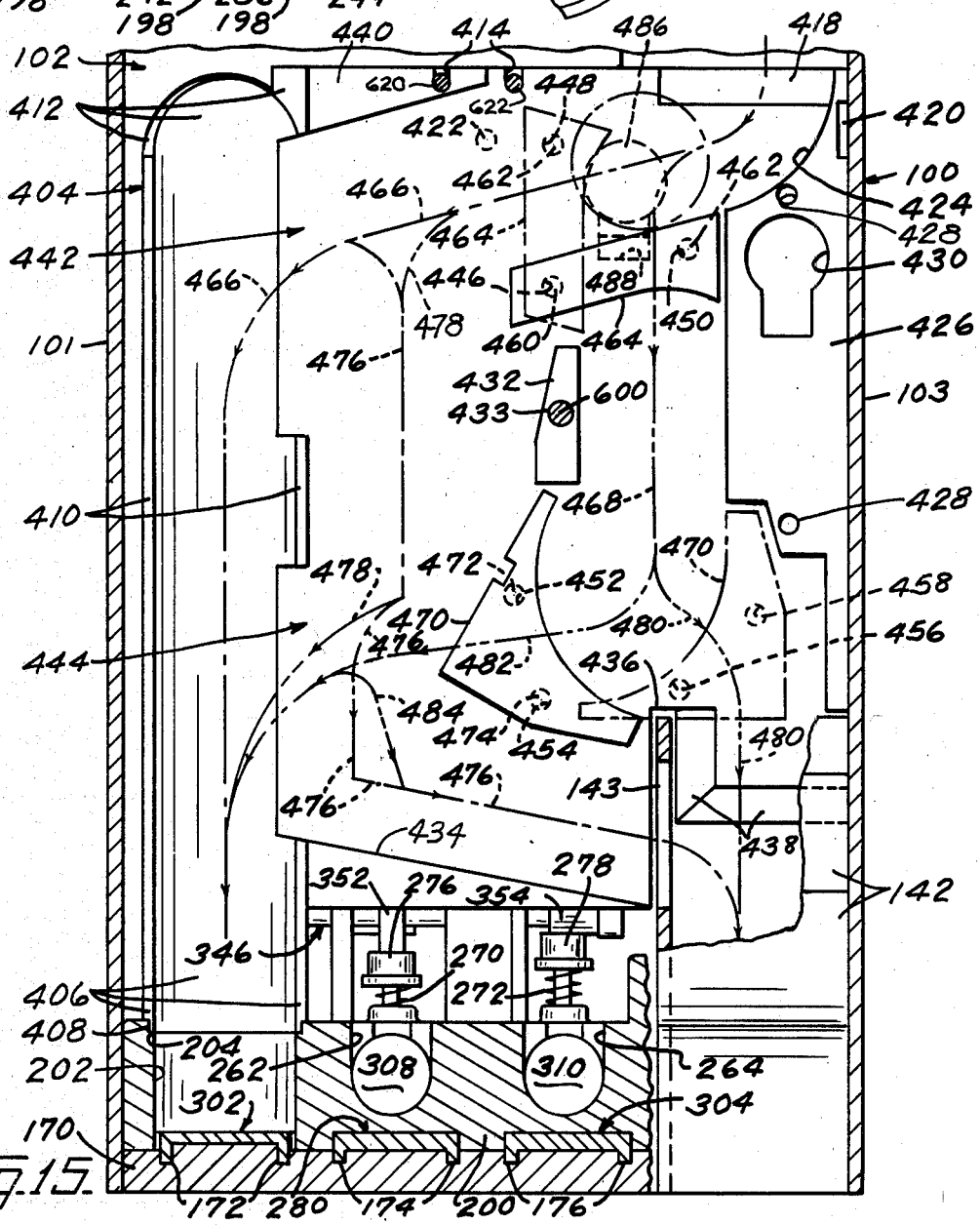
FIG. 15

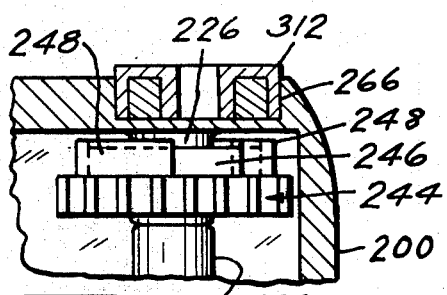
FIG. 16
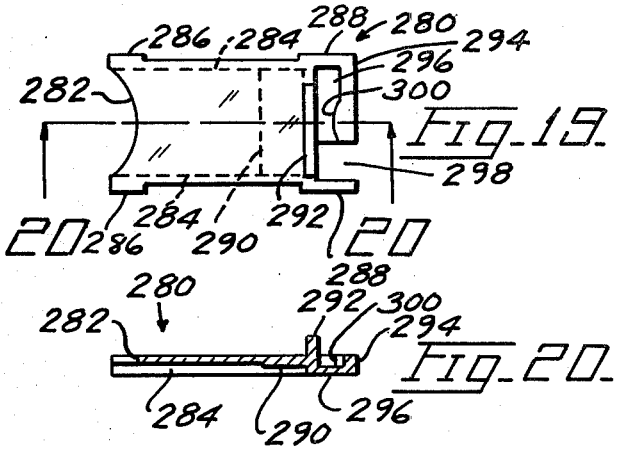
FIG. 19
FIG. 20
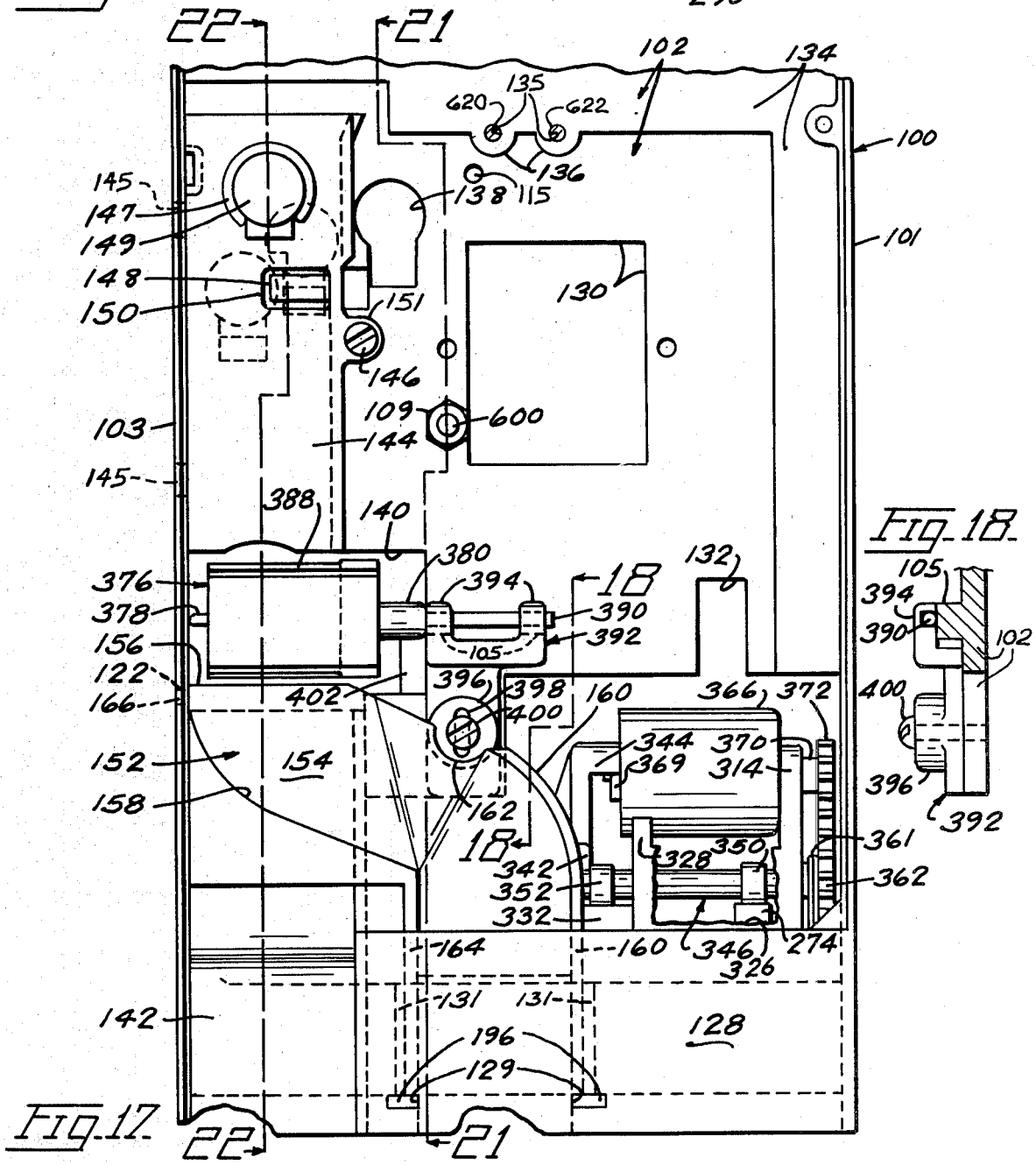
FIG. 17
FIG. 18

COIN HANDLING DEVICE

This application is a continuation, of application Ser. No. 36,335, filed May 4, 1979 now abandoned.

SUMMARY OF THE INVENTION

The coin passageays in coin handling devices are usually defined by walls; and one or more of those walls is usually secured to a main frame to support itself and to provide support for the other walls. The time involved in securing one or more walls to the frame increases the cost of the coin handling devices. The coin handling device of the present invention obviates such increase in cost by providing a number of passageway-defining walls which have positioning surfaces and complementary surfaces thereon that partially restrain and position those walls to permit those walls to be disposed adjacent the frame of that coin handling device and by using a single fastener to secure all of those walls to that frame. It is, therefore, an object of the present invention to provide a coin handling device which has a plurality of passageway-defining walls with positioning surfaces and complementary surfaces thereon that partially restrain and position those walls and that permit a single fastener to secure all of those walls to the frame of that coin handling device.

The coin handling device of the present invention has a coin-dispensing sub-assembly which has positioning surfaces thereon that interact with complementary surfaces on the frame of the coin handling device to prevent sideward, rearward, forward and downward movement of that sub-assembly but which will not prevent upward movement of that sub-assembly relative to that frame. The passageway-defining walls have positioning surfaces thereon which interact with complementary surfaces on the sub-assembly; and when the single fastener secures those passageway-defining walls to the frame, those walls will prevent upward movement of that sub-assembly. As a result, that single fastener secures the sub-assembly as well as the passageway-defining walls to the frame. It is, therefore, an object of the present invention to provide a coin-dispensing sub-assembly which has positioning surfaces thereon that interact with complementary surfaces on the frame of a coin handling device to prevent sideward, forward, backward and downward movement of that sub-assembly relative to that frame, and also to provide positioning surfaces on passageway-defining walls which coact with complementary surfaces on that sub-assembly to enable a single fastener to secure all of those walls and that sub-assembly to that frame.

A closure for a coin reservoir of the coin handling device constitutes part of a coin passageway which directs coins past that coin reservoir; and a slot in that closure is oriented so coins which strike that closure will be unable to enter that slot and, instead, will pass through that passageway. It is, therefore, an object of the present invention to provide a closure for a coin reservoir which serves as a part of a passageway that directs coins past that reservoir and which has a slot therein that is oriented so coins moving through that passageway cannot enter that slot.

The closure for the coin reservoir is inclined to the axis of that coin reservoir; and the inclination of that closure makes a projection of that slot, which lies in a plane normal to the axis of that coin reservoir, shorter than the diameter of the smallest-diameter coin passing through that passageway. As a result, that closure obviates a straight-line path which is parallel to the axis of that coin reservoir and which could permit even a small diameter coin to enter that slot. It is, therefore, an object of the present invention to provide a slot in a closure in a coin reservoir which is so inclined to the axis of that coin reservoir that a projection of that slot, which lies in a plane normal to the axis of that coin reservoir, is shorter than the diameter of the smallest-diameter coin passing through a passageway which has that coin reservoir as one wall thereof.

A wall is disposed at the opposite side of that coin passageway; and a slot in that wall is aligned with the slot in the closure of the coin reservoir to facilitate the insertion of coins through the slot in that wall, through that coin passageway, and through the slot in that closure. The width of the slot in that wall, the alignment of those slots and the proximity of that wall to the coin reservoir will impede any effort to cause a coin to pass through the slot in that wall and not also pass through the coin passageway and into the slot in the closure for the coin reservoir. It is, therefore, an object of the present invention to provide a slot, in a wall, which is aligned with, but on the opposite side of a coin passageway from, a slot in a coin reservoir, so a coin successively passes through the slot in that wall, through that coin passageway and into the slot in the coin reservoir.

Coin passageways and coin reservoirs in the coin handling device of the present invention are defined by mold-smooth confronting surfaces of walls which have no joints, cracks or other surface discontinuities past which coins must move. As a result, coins can move uninterruptedly through those coin passageways and into the entrances of those coin reservoirs. It is, therefore, an object of the present invention to provide coin passageways and coin reservoirs for a coin handling device which are defined by mold-smooth confronting surfaces of walls which have no joints, cracks or other surface discontinuities past which coins must move.

The storing of large quantities of large denomination coins within a coin reservoir of a coin handling device facilitates the dispensing of change, but it requires the operator of the machine in which that coin handling device is mounted to keep appreciable amounts of money in a non-productive status. The need of maintaining large quantities of large denomination coins within a coin reservoir of a coin handling device varies from location to location; and, in some locations, only limited quantities of such coins need be held in the coin reservoir, whereas, in other locations, large quantities of such coins need to be held in the coin reservoir. The present invention provides a coin handling device wherein it is a simple matter to dispose a runway and a deflector in either of two selected positions to direct large denomination coins toward an upper or a lower entrance for a coin reservoir and thereby provide large quantities or just small quantities of large denomination coins within that coin reservoir. It is, therefore, an object of the present invention to provide a coin handling device with a coin reservoir which has an upper and a lower entrance and which has a coin runway and deflector that are selectively disposed in either of two positions to cause coins to be directed toward that upper or toward that lower entrance.

Where a coin handling device is used with machines that dispense low-priced objects, only a limited number of denominations of coins are needed for making change. However, where a coin handling device is used with machines that dispense higher-priced products, an additional denomination of change-making coin is desirable. The present invention provides coin reservoirs for coins of three different denominations; and a selectively positionable runway and deflector can be used to cause coins to be stored within or kept from entering one of those coin reservoirs. As a result, a mere change in the positions of that runway and deflector can make one or two otherwise-identical coin handling devices capable of dispensing a given number of denominations of coins as change, and can make the other of those coin handling devices capable of dispensing an additional denomination of coins as change. It is, therefore, an object of the present invention to provide a coin handling device with coin reservoirs for coins of three different denominations and with a selectively positionable runway and deflector that can be used to cause coins to be stored within or kept from entering one of those reservoirs.

The coin-dispensing sub-assembly for the coin handling device of the present invention has gears which are movable axially toward and away from coin-dispensing slides therefor to permit selective movement of those slides in the dispensing of coins from adjacent coin reservoirs. The resulting sub-assembly is compact, direct acting, and efficient. It is, therefore, an object of the present invention to provide a coin-dispensing sub-assembly that has gears which are movable axially toward and away from coin-dispensing slides therefor to permit selective movement of those slides in the dispensing of coins from adjacent coin reservoirs.

A gate is mounted adjacent the outlet of a coin passageway, and that gate will hold a coin which exits from that coin passageway and will selectively direct that coin toward a coin return chute or a cash box chute, while acting to keep any further coins within that coin passageway from exiting from that coin passageway. Thereafter, that gate can receive and hold the lowermost coin in that coin passageway and then subsequently direct that coin toward the coin return chute or the cash box chute, while acting to keep any further coins within that coin passageway from exiting from that coin passageway. As a result, that gate makes it possible to direct one or more coins of a given denomination to the cash box chute and thereafter direct further coins of that denomination to the coin return chute. It is, therefore, an object of the present invention to provide a gate that is mounted adjacent the outlet of a coin passageway and that makes it possible to direct one or more coins of a given denomination to a cash box chute and thereafter direct further coins of that denomination to a coin return chute.

A cam shaft is used to control the selective dispensing of coins by the coin-dispensing sub-assembly of the coin handling device of the present invention. That cam shaft normally is in a position to cause one of the gears to be in slide-driving position, but it can be moved in one direction from that position to free that one slide from the gear adjacent to it and to move a second gear into driving engagement with the coin-dispensing slide therefor, or it can be moved in the opposite direction from that position to free that one slide from the gear adjacent to it and to move a third gear into driving engagement with the coin-dispensing slide therefor. In this way, that cam shaft is able to directly control the dispensing of desired ones of three different denominations of coins. It is, therefore, an object of the present invention to provide a cam shaft that normally is in position to cause the dispensing of coins of one denomination but is movable in one direction from that position to cause the dispensing of coins of a different denomination and is movable in the opposite direction from that position to cause the dispensing of coins of a third denomination.

The cam shaft for the coin-dispensing sub-assembly is connected to the gate which is mounted adjacent the outlet of the coin passageway. When that cam shaft is in its normal position, it will hold that gate in register with that coin passageway; and when it is moved in one direction from that normal position, it will shift that gate to a position wherein that gate will direct any coin therein toward a coin return chute, and when it is moved in the opposite direction from that normal position, it will shift that gate to a position wherein that gate will direct any coin therein toward a cash box chute. As a result, that cam shaft is able to control the dispensing of coins by that gate as well as by that coin-dispensing sub-assembly. It is, therefore, an object of the present invention to provide a coin handling device wherein a cam shaft controls the dispensing of coins by a gate as well as the dispensing of coins by a coin-dispensing sub-assembly.

Other and further objects and advantages of the present invention should become apparent from an examination of the drawing and accompanying description.

In the drawing and accompanying description a preferred embodiment and an alternate embodiment of coin handling device are disclosed and described but it is to be understood that the drawing and accompanying description are for the purpose of illustration only and do not limit the invention and that the invention will be defined by the appended claims.

BRIEF DESCRIPTION OF THE DRAWING

In the drawing, FIG. 2 is a partially-sectioned plan view of the portion of the change making device of FIG. 1, FIG. 3 is a bottom view of the portion of the change making device of FIG. 1, FIG. 4 is a partially broken-away elevational view of the left-hand side of the portion of the change making device of FIG. 1, FIG. 5 is a partially broken-away elevational view of the right-hand side of the portion of the change making device of FIG. 1, FIG. 8 is another sectional view, and it is taken along the plane indicated by the line 8—8 in FIG. 1, FIG. 9 is a sectional view of a portion of the quarter passageway and reservoir which are indicated by the circular line in FIG. 8, but that view is taken a short distance above the level at which the view of FIG. 8 is taken, FIG. 10 is a sectional view which is taken along the broken plane indicated by the broken line 10—10 in FIG. 2, and it shows the nickel passageway, the rear portions of the nickel and dime reservoirs, and the coin return chute, FIG. 11 is a sectional view which is taken along the broken plane indicated by the broken line 11—11 in FIG. 1;

FIG. 12 is a partially broken-away sectional view which is taken along the broken plane indicated by the broken line 12—12 in FIG. 2, and it shows the dime passageway, the rear portions of the dime and quarter reservoirs, and the coin return chute, FIG. 13 is a sectional view which is taken, in part, along the plane indicated by the line 13—13 in FIG. 11 but is also taken along two further planes that are spaced to the left of the line 13—13, FIG. 14 is a diagrammatic view, on a larger scale, which is taken along the plane indicated by the line 14—14 in FIG. 13, FIG. 15 is a sectional view which is taken along the plane indicated by the line 15—15 in FIG. 2, and it shows the quarter passageway, the rear portion of the quarter reservoir, a level sensor for the nickel reservoir, a level sensor for the dime reservoir, and parts of the coin-dispensing mechanism, FIG. 16 is a sectional view which is taken along the plane indicated by the line 16—16 in FIG. 14, FIG. 17 is an elevational view of the rear of the portion of the change making device of FIG. 1 after the rear cover for that portion has been removed, FIG. 18 is a sectional view which is taken along the broken plane indicated by the broken line 18—18 in FIG. 17, FIG. 19 is a plan view of one of the coin-dispensing slides of the change making device of FIG. 1, FIG. 20 is a sectional view which is taken along the plane indicated by the line 20—20 in FIG. 19.

DESCRIPTION OF PREFERRED EMBODIMENTS

Figure 1:
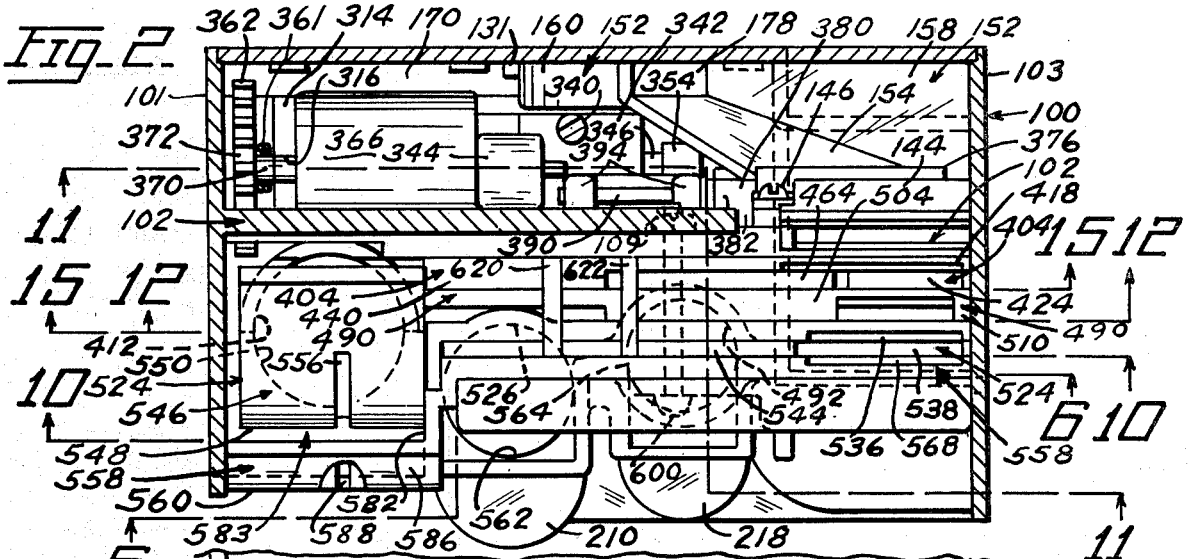
FIG. 1 is a front elevational view of the lower portion of one preferred embodiment of change making device that is made in accordance with the principles and teachings of the present invention.

Referring to the drawing in detail, the numeral 100 generally denotes a frame which is generally H-shaped in plan view, as shown by FIG. 2. A median wall 102, which is generally planar but which has forwardly and rearwardly offset portions, extends generally vertically of that frame, and it is generally perpendicular to side walls of that frame. The left-hand side wall is denoted by the numeral 101, and the right-hand side wall is denoted by the numeral 103. The numeral 104 denotes two notches in the forward edge of left-hand wall 101; and those notches have downwardly-extending slots contiguous thereto, as shown by solid lines in FIG. 4 and by dotted lines in FIG. 1. The numeral 106 denotes an elongated notch in the forward edge of left-hand wall 101 adjacent the lower end of that wall. The numeral 108 denotes a generally horizontally-directed slot in the side wall 101 which extends inwardly from the lower end of the notch 106; and an abutment 110 helps define the bottom of that slot. A reduced-thickness wall 113, which is contiguous to the rear of projection 110, defines a shallow recess at the outer face of slot 108 immediately rearwardly of that projection. Horizontally-directed slots 111 with notches at the inner ends thereof are provided in the forward edges of the side walls 101 and 103. Those slots are intended to receive and releasably hold pins at the lower portions of the flanges of a slug rejector, not shown, which can receive, test and sort nickels, dimes, quarters and the new small-size dollars, and which will reject all slugs.

Slots 112, 114 and 116 are provided in the side wall 103; and those slots define a vertical line which is close to the forward edge of that wall, as shown by FIG. 5. Further slots 118 and 120 are formed in side wall 103 closer to the rear edge of that wall; and a circular opening 122 is located below the level of slot 120, all as shown by FIG. 5. A generally horizontally-directed slot 124 extends inwardly from the forward edge of side wall 103, and an abutment 126 helps define the bottom of that slot. A reduced thickness wall 125, which is contiguous to the rear of projection 126, defines a shallow recess at the outer face of slot 124 immediately rearwardly of that projection. The slot 124 is in horizontal registry with the slot 108 in side wall 101.

Figures 6, 7:
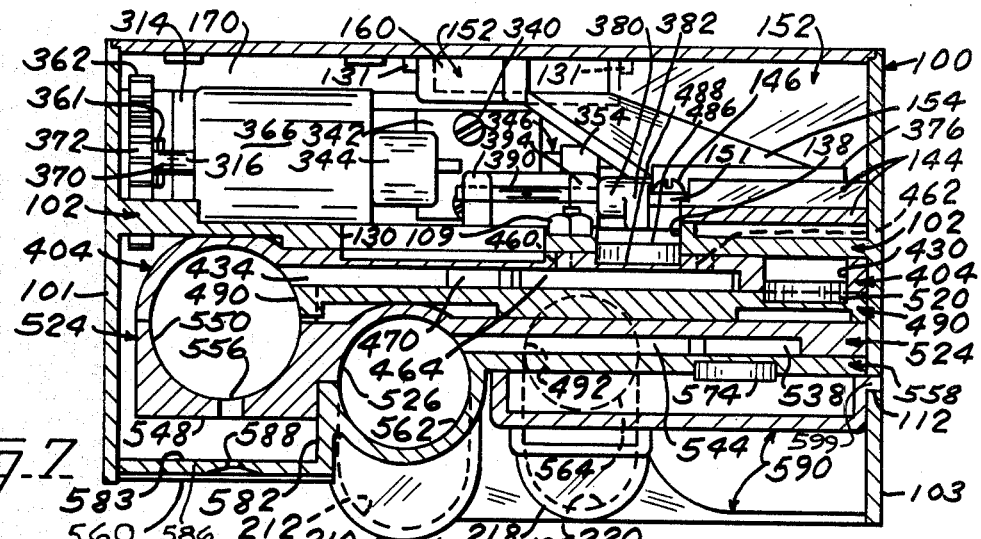
FIG. 6 is a sectional view which is taken along the broken plane indicated by the broken line 6—6 in FIG. 2, and it shows the portion of the change making device of FIG. 1 after a front plate, which also serves as a motor enclosure, has been removed.
FIG. 7 is a sectional view which is taken along the plane indicated by the line 7—7 in FIG. 1.
Figures 21, 22, 23, 24, 25, 26, 27:
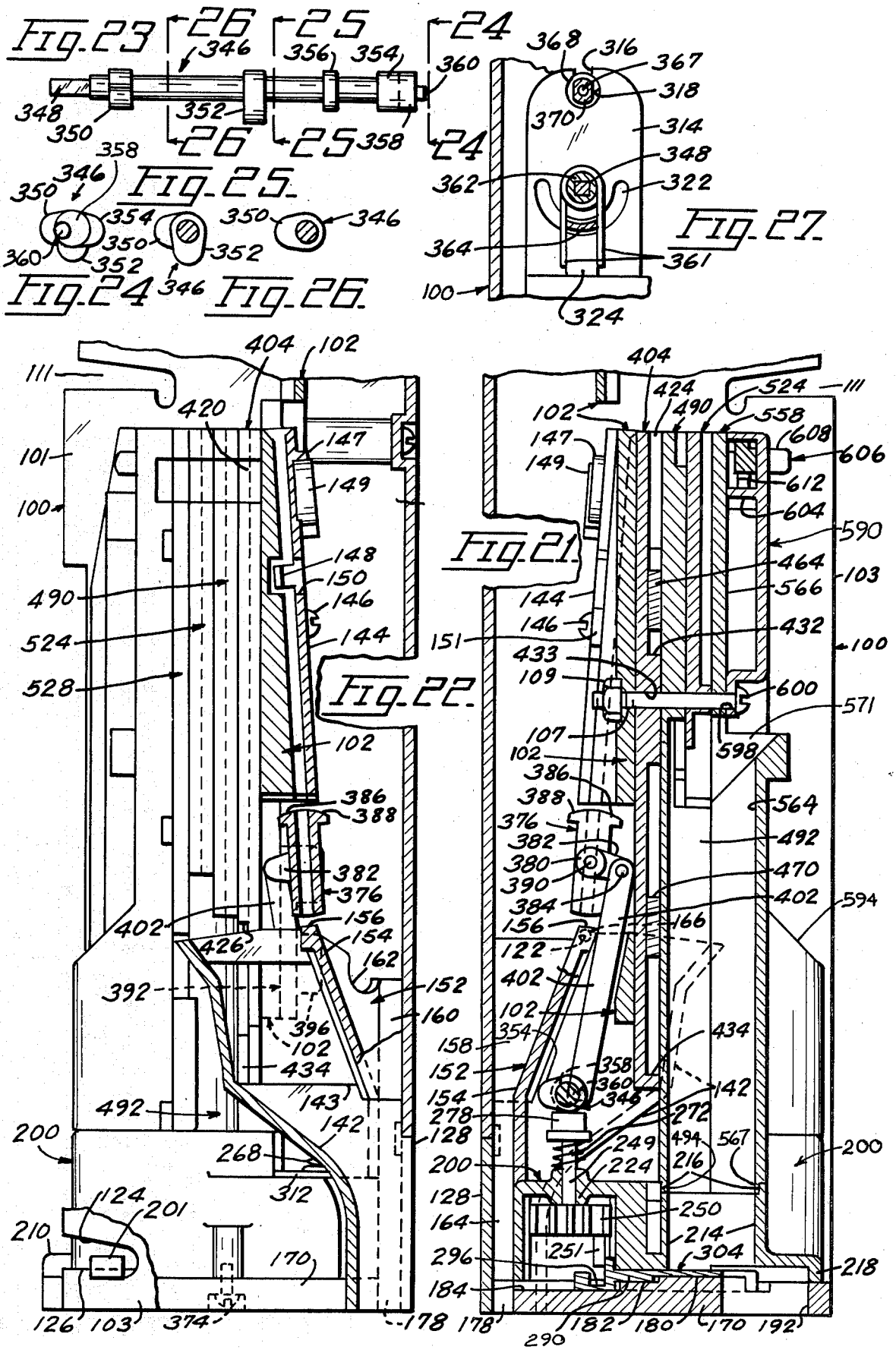
FIG. 21 is a sectional view which is taken along the broken plane indicated by the broken line 21—21 in FIG. 17.
FIG. 22 is a sectional view which is taken along the broken plane indicated by the broken line 22—22 in FIG. 17.
FIG. 23 is an elevational view of a cam shaft used in the change making device of FIG. 1.
FIG. 24 is an elevational view of the right-hand end of the cam shaft of FIG. 23, and it is taken along the plane indicated by the line 24—24 in FIG. 23.
FIG. 25 is a sectional view which is taken along the plane indicated by the line 25—25 in FIG. 23.
FIG. 26 is a sectional view which is taken along the plane indicated by the line 26—26 in FIG. 23.
FIG. 27 is a sectional view which is taken along the plane indicated by the line 27—27 in FIG. 11.

A shallow, vertically-directed web 128 is provided at the rear of the frame 100 and is shown particularly by FIGS. 13, 17, 21, 22 and 28–30. That web has horizontally-directed slots 129 therein, as shown by FIG. 17; and also has vertically-directed ribs 131 at the inner face thereof, as shown by FIGS. 2, 7 and 17. The median wall 102 has a rectangular opening 130 therein, a rectangular notch 132 extending upwardly from the lower edge thereof, and a generally L-shaped ridge 134 extending a few thousandths of an inch rearwardly from the rear face thereof. Bosses 136, with cylindrical openings 135 therein, are provided adjacent the lower edge of the horizontal portion of the ridge 134. A generally key-hole shaped opening 138 is provided in the median wall 102 to the left of the opening 130; and a generally-rectangular opening 140 is provided in that wall below the level, and to the left, of opening 130. Two short abutments 105, which are rectangular in front and side views, as shown by FIGS. 17 and 18, extend rearwardly from median wall 102. Those abutments are below the level of opening 130 and are disposed to the left of notch 132. A horizontally-directed opening 107 is provided in median wall 102, as shown by FIG. 21; and a nut 109 is secured within a socket therefor at the rear end of that opening, as shown by FIGS. 2, 7 and 21. A socket 115 is above opening 130.

A cash box chute 142 is shown particularly by FIGS. 15 and 22; and it has an upper edge which inclines upwardly and forwardly, a gently inclined upper wall portion, downwardly and rearwardly inclined wall portion, and a curved wall portion which extends to a vertically-directed lower wall portion. That chute is secured to the left-hand end of web 128, as that chute and web are viewed in FIG. 17; and that chute also is secured to the lower edge of median wall 102. A vertically-directed slot 143 is provided in the left-hand side wall of chute 142, as that chute is viewed in FIG. 15; and that slot is large enough to permit quarters to pass through it and thereby enter that chute. The frame 100, its median wall 102, its side walls 101 and 103, its web 128, the cash box chute 142, and all other portions of that frame will preferably be molded as a single piece from a sturdy, dimensionally-stable plastic material.

A passageway for dollars is defined by a wall 144 and by the rear face of median wall 102, as shown particularly by FIG. 22. An arcuate rib 147 extends rearwardly from a reduced-thickness upper portion of wall 144 to define a socket, as shown by FIGS. 21 and 22, for a coil-type sensor 149 for dollars. A generally L-shaped pad 148 extends forwardly from an opening 150 in the wall 144, as shown particularly by FIGS. 17 and 22; and that pad is displaced forwardly of the dollar passageway defined by wall 144 and median wall 102. As indicated by FIG. 22, that passageway inclines downwardly from upper left to lower right at an angle which is displaced only a few degrees from the vertical. Two ears 145 are provided at the left-hand edge of wall 144, as that wall is viewed in FIG. 17; and those ears extend into, and are confined by, the slots 118 and 120 in side wall 103, as shown by FIG. 5. A screw 146 passes through an ear 151 at the right-hand edge of wall 144 and seats in a threaded socket, not shown, in the median wall 102.

The numeral 152 generally denotes a doller return chute which has a wall 154 that inclines upwardly and forwardly, as indicated particularly by FIG. 22; and the upper edge of that wall is widened to constitute an elongated, horizontally-directed abutment 156. That chute has an arcuate runway portion 158 indicated by FIG. 17, and an elongated flange 160 is provided at the right-hand edge of that chute, as that chute is viewed in FIG. 17. That flange is curved adjacent the upper end thereof and then extends straight downwardly toward the right-hand slot 129 in FIG. 17; and a flange 164 extends straight downwardly, in spaced parallel relation to the straight portion of flange 160, toward the left-hand slot 129. An arcuate notch 162 is provided in a portion of the upper edge of chute 152 intermediate the flange 160 and the wall 154. The flanges 160 and 164 will help guide dollars toward the lower edge of frame 100 to permit them to fall into a conduit, not shown, which will direct them to a coin-receiving cup at the exterior of the machine in which the change-making device of FIG. 1 is mounted. A pin 166, at the left-hand edge of the widened upper edge 156 of wall 154, extends into, and is held by, the circular opening 122 in side wall 103 as indicated by FIGS. 5 and 17.

The numeral 168 in FIGS. 11 and 28–30 generally denotes a sub-assembly which can selectively dispense nickels, dimes and quarters. That sub-assembly includes a thick bottom plate 170 which has a number of pairs of parallel grooves 172, 174 and 176 that are shown particularly by FIGS. 15 and 28. The grooves 172 are spaced from the rear of bottom plate 170 and extend to a generally U-shaped, vertically-directed notch 186, in the front edge of that bottom plate, through which quarters can be dispensed. The grooves 174 are spaced from the forward edge of a vertically-directed rectangular opening 178, adjacent the rear edge of bottom plate 170, and they extend to a vertically-directed circular opening 188, adjacent the front edge of that bottom plate, through which nickels can be dispensed. The grooves 176 also are spaced from the forward edge of opening 178, and they extend to a vertically-directed circular opening 192 adjacent the front edge of bottom plate 170 through which dimes can be dispensed. A thin horizontally-directed deflector 190 is provided adjacent the bottom of the opening 188; and that deflector will permit nickels to pass freely through that opening, but will tend to urge those nickels to move rearwardly relative to the undersurface of bottom plate 170. A thin horizontally-directed deflector 194 is provided adjacent the bottom of the opening 192; and that deflector will permit dimes to pass freely through that opening, but will tend to urge those dimes to move to the left in FIG. 28 relative to the undersurface of that bottom plate.

Ears 196 project rearwardly from the opposite sides of the opening 178 adjacent the rear edge of bottom plate 170. In assembling the sub-assembly 168 with the frame 100, those ears are moved rearwardly beneath the lower ends of the ribs 131 on web 128 and also beneath the lower ends of flanges 160 and 164 on the dollar return chute 152 until they extend into, and are held by, the slots 129 in that web, as shown by FIG. 17. The flanges 160 and 164 will be held against sideways movement by the ribs 131 and will be held against downward movement by the bottom plate 170; and those flanges will help guide dollars to and through the opening 178 to the conduit that extends to the coin-receiving cup.

Abutments 180 are provided intermediate the forward ends of the grooves of each pair of grooves 172, 174 and 176; and the upper surfaces of those abutments are spaced short distances above the level of a plane which is defined by the upper surface of bottom plate 170. The abutment 180 between the grooves 176 is shown by FIG. 21. Surfaces 182 are provided intermediate the grooves of each pair of grooves 172, 174 and 176; and those surfaces are close to the level of the plane of the upper surface of bottom plate 170. The surfaces 182 expose the rear faces of abutments 180; and the surface 182 between the grooves 176 is shown by FIG. 21. Surfaces 184 are provided intermediate the rear ends of the grooves of each pair of grooves 172, 174 and 176; and those surfaces are below the level of the surfaces 182. The surfaces 184 expose the rear faces of the surfaces 182; and the surface 184 between the grooves 176 is shown by FIG. 21.

Five bosses 198 extend upwardly from the upper surface of the bottom plate 170, as indicated by FIGS. 11 and 13. The upper ends of those bosses have bearing-like sockets therein to accommodate shafts for the gears of the sub-assembly 168. The bottom plate 170 also has three vertically-directed openings that accommodate three fasteners 374 which releasably hold the parts of sub-assembly 168 in assembled relation.

Figure 30:
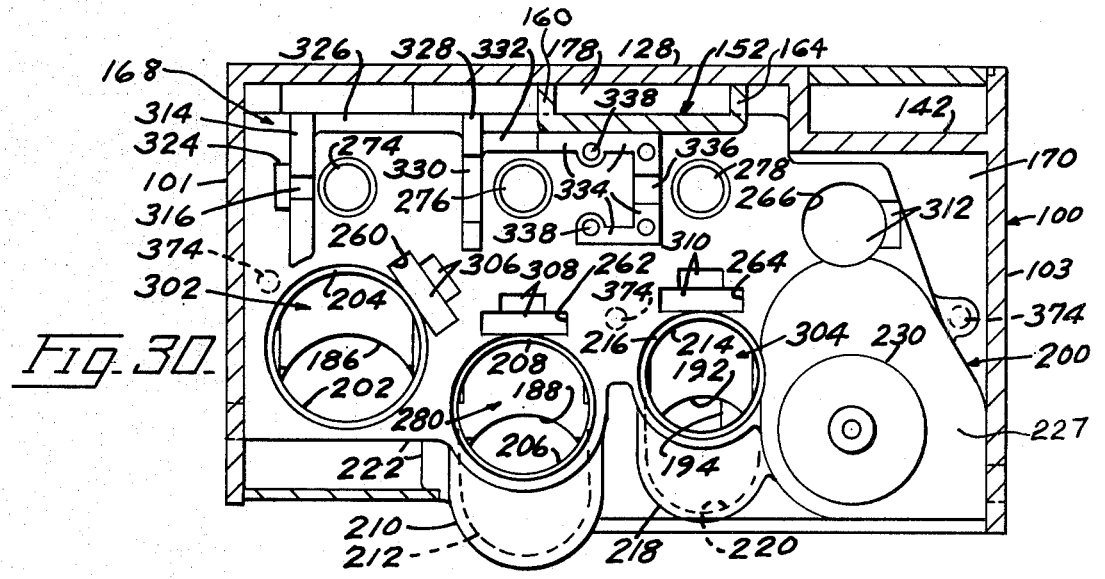
FIG. 30 is a sectional view which shows the bottom of the change making device of FIG. 1 after the selector motor, the coin passageways and reservoirs, and other parts have been removed.

Referring particularly to FIGS. 11 and 13, the numeral 200 denotes a housing which is part of the sub-assembly 168, and that housing overlies and is secured to the bottom plate 170 by the fasteners 374. Ears 199 and 201, at the opposite sides of that housing, extend into the slots 108 and 124, respectively, in the side walls 101 and 103. As indicated particularly by FIG. 1, those ears have thin downwardly-depending lips that lodge within the recesses at the outer faces of the reduced-thickness walls 113 and 125, respectively; and that lodgment effectively secures the front portion of sub-assembly 168 to the frame 100. A vertically-directed opening 202 is provided adjacent the front edge of the housing 200; and that opening is above, but has the center thereof spaced slightly rearwardly of, the center of the U-shaped opening 186 in bottom plate 170, as indicated by FIG. 30. The opening 202 constitutes the bottom of the quarter reservoir; and an annular groove 204 is provided at the upper inner edge of that opening. The numeral 206 denotes a vertically-directed opening adjacent the front edge of the housing 200; and that opening is above, but has the center thereof spaced rearwardly of, the center of the opening 188 in bottom plate 170. The opening 206 constitutes the bottom of the nickel reservoir; and an annular groove 208 is provided at the upper inner edge of that opening. The numeral 210 denotes a generally semi-cylindrical shallow boss which extends forwardly from the lower part of that portion of housing 200 which defines the opening 206. A recess 212 in the undersurface of boss 210 is indicated by dotted lines in FIG. 7; and it opens downwardly to the opening 188 in bottom plate 170. That boss and recess will confine and guide each nickel as it is moved from a position in register with opening 206 to a position in register with opening 188. The numeral 214 denotes a vertically-directed circular opening adjacent the front edge of the housing 200; and that opening is above, but has the center thereof spaced rearwardly of, the center of the opening 192 in bottom plate 170. The opening 214 constitutes the bottom of the dime reservoir; and an annular groove 216 is provided at the upper inner edge of that opening. A generally semi-cylindrical shallow boss 218 extends forwardly from the lower part of that portion of housing 200 which defines the opening 214. A recess 220 in the undersurface of boss 218 is indicated by dotted lines in FIG. 7; and it opens downwardly to the opening 192 in bottom plate 170. That boss and recess will confine and guide each dime as it is moved from a position in register with opening 214 to a position in register with opening 192. As indicated by FIG. 30, the portion of housing 200 which defines the opening 202 does not have a generally semi-cylindrical boss extending forwardly from the lower part thereof. Instead, the adjacent forward edge of that housing is cut away, as indicated by the numeral 222 in FIG. 30, to define a rectangular opening which overlies the forward end of the U-shaped opening 186 in bottom plate 170.

The numeral 224 denotes three bosses which extend downwardly from the undersurface of the top wall of housing 200; and those bosses have vertically-directed bearing-like openings therethrough. The numeral 226 denotes five bosses which also extend downwardly from the undersurface of that top wall; and those bosses have bearing-like sockets therein. One portion of that top wall, which is denoted by the numeral 227, extends a considerable distance above the plane of the upper surface of housing 200; and two of the bosses 226 are located at the undersurface of that portion. An opening 228 is provided in the portion 227; and it accommodates and confines an annular bearing housing of a small electric motor 230. A pinion 232 is mounted on the output shaft of motor 230; and that pinion and the lower portion of that shaft pass downwardly through opening 228 to be disposed within housing 200. The teeth of pinion 232 mesh with the teeth of a gear 234 which is rotatably held by a shaft or pivot that is supported by one of the bosses 226 and by one of the bosses 198. A pinion 236 is formed integrally with the gear 234; and the teeth of that pinion mesh with the teeth of a gear 238 which is rotatably held by a further shaft or pivot that is supported by another boss 226 and by another boss 198. A pinion 240 is formed integrally with the gear 238; and the teeth of that pinion mesh with the teeth of a gear 242 which is rotatably held by the same shaft or pivot by which the gear 234 and its pinion 236 are held. The gear 242 can rotate relative to the gear 234 and relative to the pinion 242.

Figure 29:
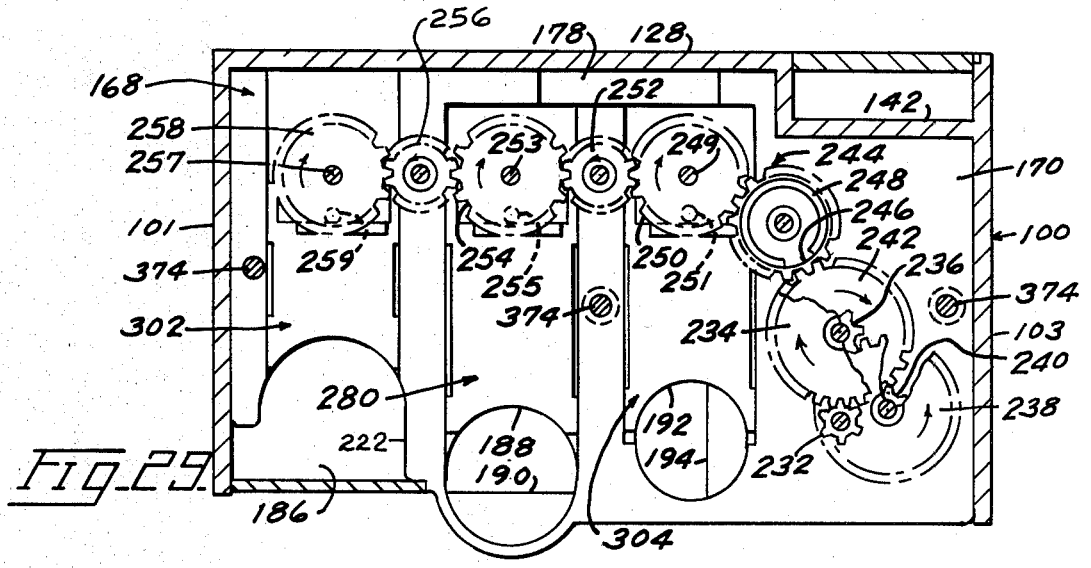
FIG. 29 is a sectional view which is taken along the broken plane indicated by the broken line 29—29 in FIG. 11.

The numeral 244 generally denotes a gear which is rotatably held by a shaft or pivot that is held by a further set of bosses 226 and 198; and the teeth of that gear mesh with the teeth of gear 242. A generally-cylindrical boss 246 is formed on, extends upwardly from, gear 244; and a piece of iron 248, which is generally annular but which has an angular extent of less than three hundred and sixty degrees, is pressed into engagement with the outer face of boss 246. As shown by FIGS. 16 and 29, the outer diameter of iron piece 248 is less than the pitch diameter of gear 244. The numeral 250 denotes a gear which is rotatably held by a shaft 249 that is held for axial shifting and for rotation by one of the bosses 224. A pin 251 depends downwardly from the lower face of that gear; and the teeth of that gear mesh with the teeth of gear 244. An idler gear 252 is rotatably held by a shaft or pivot which is supported by further of bosses 198 and 226; and the teeth of that gear mesh with the teeth of gear 250. A gear 254 is rotatably held by a shaft 253 that is held for axial shifting and for rotation by a further boss 224. A pin 255 depends downwardly from the lower face of that gear; and the teeth of that gear mesh with the teeth of idler gear 252. A further idler gear 256 is rotatably held by a shaft or pivot that is supported by further bosses 198 and 226; and the teeth of that gear mesh with the teeth of gear 254. A gear 258 is rotatably held by a shaft 257 that is held for axial shifting and for rotation by a further boss 224. A pin 259 depends downwardly from the lower face of that gear; and the teeth of that gear mesh with the teeth of idler gear 256.

The motor 230 acts through pinion 232, gear 234, pinion 236, gear 238, pinion 240, and gear 242 to drive gear 244 at a speed which is substantially smaller than the speed of pinion 232. The gear 244 causes gear 250 to rotate in the clockwise direction in FIG. 29 at about one hundred revolutions per minute. The idler gears 252 and 256 cause the gears 254 and 258 to rotate at the same speed, and in the same direction, as gear 250. The pins 251, 255 and 259 are molded integrally with, but are mounted eccentrically of the axes of, the gears 250, 254 and 258, respectively, as shown by FIG. 29. The axial dimension of gear 250 is long enough to enable the teeth of that gear to mesh with the teeth of gear 244 and of idler gear 252 in all axial positions of shaft 249. Similarly, the axial dimension of gear 254 is long enough to enable the teeth of that gear to mesh with the teeth of idler gears 252 and 256 in all axial positions of shaft 253; and the axial dimension of gear 258 is long enough to enable the teeth of that gear to mesh with the teeth of idler gear 256 in all axial positions of shaft 257.

Referring particularly to FIG. 30, the numeral 260 denotes a generally T-shaped recess in the upper surface of housing 200 adjacent the opening 202. The numeral 262 denotes a similar recess in that upper surface adjacent the opening 206; and the numeral 264 denotes a further similar recess in that upper surface adjacent the opening 214. The numeral 266 denotes a generally keyhole-shaped recess in the upper surface of housing 200; and that recess is vertically coextensive with part of the gear 244, as shown by FIG. 16.

Helical compression springs 268, 270 and 272, respectively, encircle the shafts 257, 253 and 249. Caps 274, 276 and 278 are pressed onto the upper ends of those shafts, respectively; and the upper ends of the springs 268, 270 and 272 bear against those caps to urge those shafts upwardly to the level occupied by the shafts 257 and 249 in FIG. 11. However, those springs can yield to permit those caps to be moved downwardly to cause the shafts 257, 253 and 249 to assume the position occupied by the shaft 253 in FIG. 11. As the caps 274, 276 and 278 and shafts 257, 253 and 249 are moved vertically, the gears 258, 254 and 250 also move vertically, and hence move the pins 259, 255 and 251 thereon vertically. Upward movement of gears 258, 254 and 250, and hence of caps 274, 276 and 278, of shafts 257, 253 and 249, and of pins 259, 255 and 251 is limited by the engagement of those gears with the under faces of bosses 224.

Referring particularly to FIGS. 19 and 20, the numeral 280 generally denotes a nickel-ejecting slide which has a concave forward edge 282, downwardly-extending flanges 284, wide leading edges 286 on those flanges, wide trailing edges 288 on those flanges, a thick body portion 290, an upstanding wall 292, a reduced-height, limited-length rear wall 294, a reduced-thickness portion 296 intermediate the walls 292 and 294, a notch 298 intermediate the free end portion of the wall 294 and the adjacent rear edge of the flange 284. It will be noted that the forward face of rear wall 294 has a convex forwardly-extending portion 300 which coacts with the confronting rear face of wall 292 to define a space which is slightly larger than the diameter of pin 255. As a result, that pin can fit between, and can move readily relative to, the wall 292 and the forwardly-extending portion 300 of wall 294. The radius of the convex forwardly-extending portion 300 does not exceed the radius of eccentricity of pin 255; and hence that pin can rotate approximately thirty degrees in the clockwise direction before it moves from the position of FIG. 28 until it engages the planar front face of rear wall 294. As a result, the gear train, of which gear 254 is a part, can attain a desirable amount of momentum before pin 255 is moved into engagement with the rear wall 294 of slide 280 to start moving that slide rearwardly relative to bottom plate 170.

The numeral 302 denotes a quarter-ejecting slide which has the same general configuration as the slide 280. However, the slide 302 is appreciably shorter, has a larger radius for the concave leading edge thereof, and has a thicker leading edge than does the nickel-ejecting slide 280. The numeral 304 denotes a dime-ejecting slide which has the same general configuration as the slide 280. However, the slide 304 is slightly shorter, has a smaller radius for the concave leading edge thereof, and has a thinner leading edge than does the nickel-ejecting slide 280. The concave leading edge of each of the slides 280, 302 and 304 is made just slightly thinner than the thickness of the thinnest authentic coin of the denomination to be ejected by that slide. As a result, each slide is able to eject each authentic coin of the corresponding denomination, even if that coin is worn by years of usage; and yet each slide has a leading edge that is thin enough so it will not simultaneously eject two such well-worn coins.

The thick body portion 290 of each slide overlies, but is movable relative to, the corresponding surface 182 on bottom plate 170. FIG. 21 shows the thick body portion 290 of slide 304 overlying the surface 182 which is disposed rearwardly of the abutment 180 between the grooves 176. That abutment and that thick body portion constitute abuttable surfaces which can limit movement of slide 304 forwardly relative to bottom plate 170. The reduced-thickness portion 296 of each slide will overlie, but will be movable relative to, the corresponding surface 184 of bottom plate 170; and FIG. 21 shows the reduced-thickness portion 296 of slide 304 overlying the surface 184.

Figure 28:
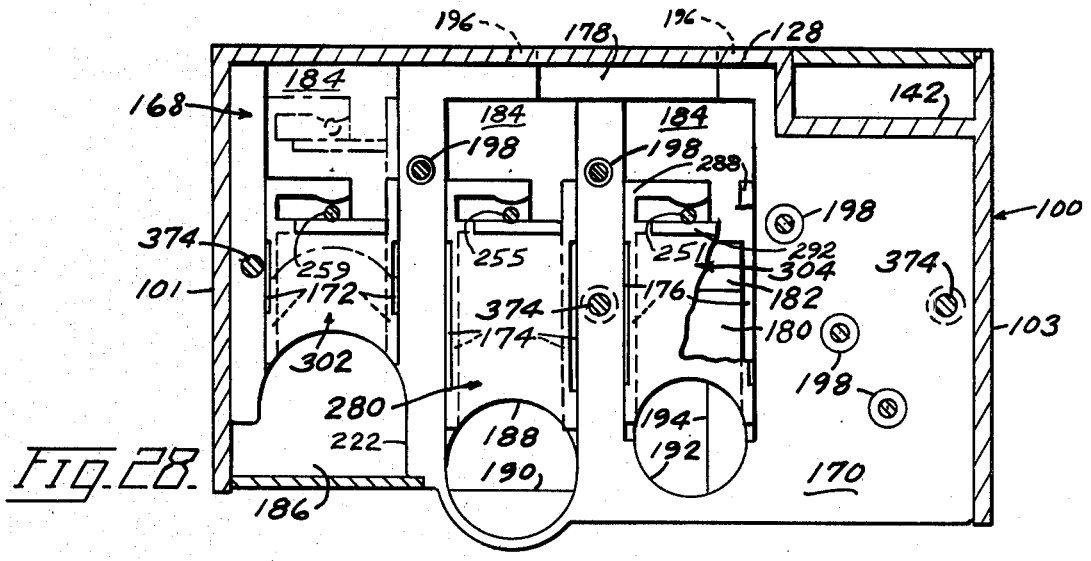
FIG. 28 is a partially broken-away, sectional view which is taken along the broken plane indicated by the broken line 28—28 in FIG. 11.

As emphasized particularly by FIGS. 21 and 28, the pins 251, 255 and 259, which depend downwardly from gears 250, 254 and 258, respectively, normally are in register with the spaces between the rear faces of walls 292 and the convex faces 300 of the slides 304, 280 and 302, respectively. The lower ends of pins 251 and 259 normally are spaced above the levels of all portions of the rear walls 294, but are spaced below the levels of the upper edges of the walls 292 of slides 304 and 302, respectively. However, the lower end of the pin 255 normally is spaced below the level of the upper edge of the wall 294, as indicated by FIG. 11. As a result, whenever the motor 230 drives the gears 250, 254 and 258, while those gears are in the positions shown by FIG. 11, the pins 251 and 259 will pass above the level of, and hence will not engage, the rear walls 294 of slides 304 and 302; but the pin 255 will engage the rear wall 294 of slide 280 and force that slide to move rearwardly. After the pin 255 has rotated slightly more than one hundred and eighty degrees, it will move out of engagement with the convex portion 300, and into engagement with the rear face of wall 292, of slide 280; and thereafter that pin will move that slide forwardly to the position of FIG. 28.

All of this means that if any of the pins 251, 255 and 259 is in its lower position when the motor 230 is driving the gears 250, 252 and 254, that pin will force the corresponding slide to move rearwardly from, and then move forwardly to, the position of FIG. 28. Each time the slide 280 is moved rearwardly from, and then back to, the position of FIG. 28, it will permit the lowermost nickel, within the opening 206, to move downwardly into engagement with the upper surface of the abutment 180 between grooves 174, and will then force that nickel to move forwardly into full registry with the opening 188. Thereafter, that nickel will fall downwardly into engagement with deflector 190, and then will pass downwardly through, and rearwardly from, that opening. In similar fashion, each time the slide 304 is moved rearwardly from, and then back to, the position of FIG. 28, it will cause the lowermost dime within opening 214 to be dispensed through opening 192; and each time the slide 302 is moved rearwardly from, and then back to, the position of FIG. 28, it will cause the lowermost quarter within opening 202 to be dispensed through opening 186.

To assemble the housing 200 and its contents with the bottom plate 170, that housing will be inverted, and an assembly fixture will be used to facilitate the insertion and holding of the various shafts and gears so those gears will mesh properly. That fixture will then be removed, and the slides 280, 302 and 304 will be held in position on the bottom plate 170. Thereafter, while those slides are held on that bottom plate with the walls 292 thereof disposed rearwardly of the pins 259, 255 and 251, respectively, of gears 258, 254 and 250, and while the sockets in the ends of bosses 198 on that bottom plate are aligned with the various shafts which are held by the various bosses of housing 200, that bottom plate will be moved into engagement with that housing. At such time, three screws 374 will be passed through openings in bottom plate 170 and seated in sockets in housing 200 to fixedly secure that bottom plate to that housing.

At this time, the assembler will telescope the pinion 232 on the output shaft of motor 230 downwardly through the opening 228 in the housing 200 until it meshes with the gear 234. Shallow aligning pins, not shown, on the lower face of the housing of motor 230 will seat within corresponding sockets, not shown, in the upper surface of housing 200 to prevent undesired rotation of that motor relative to housing 200. In the event the teeth on the pinion 232 are not precisely aligned with the corresponding teeth on the gear 234, the assembler need only, prior to the time those aligning pins are set within the sockets in the top of housing 200, rotate the motor 230 whatever short distance is needed to effect the desired alignment. Once the teeth of pinion 232 and of gear 234 have meshed, the assembler can rotate motor 230 until the aligning pins are in alignment with the sockets therefor.

Referring particularly to FIG. 30, the numeral 306 denotes a coil-type sensor and terminal block therefor which are disposed within the recess 260 in the upper surface of housing 200. A similar sensor and terminal block are denoted by the numeral 308 and are disposed within the recess 262. A third such sensor and terminal block 310 are disposed within the recess 264; and a fourth such sensor and terminal block 312 are disposed within the recess 266. The sensor 306 is located immediately adjacent the opening 202, and it serves as an "empty" sensor for quarters within that opening. The sensor 308 is located immediately adjacent the opening 206, and it serves as an "empty" sensor for nickels within that opening. The sensor 310 is located immediately adjacent the opening 214, and it serves as an "empty" sensor for dimes within that opening. The sensor 312 is located immediately adjacent the iron piece 248 on the upper surface of gear 244, as shown by FIG. 16; and that sensor will sense the position of the gap between the ends of that metal piece. The sensors 306, 308, 310 and 312 will be suitably held within the recesses therefor; and a sealing compound will preferably be used to keep metal dust or particles from entering those recesses.

A plate-like bearing block 314, which is shown by FIGS. 27 and 30, is formed integrally with, and extends upwardly from, the left-hand end of the upper surface of housing 200, as that housing is viewed in FIG. 30. A small slot 316 is formed in the upper edge of that block; and it extends downwardly to, and communicates with, a horizontally-directed cylindrical opening 318, which is shown by FIGS. 11 and 27. An opening 320 is formed in the block 314 below the level of the opening 318, as shown by FIG. 11; and the left-hand portion of opening 320 is enlarged to define a shoulder intermediate the ends of that opening. An arcuate slot 322, of approximately one hundred and eighty degrees angular extent, is provided in the block 314 below the level of opening 320; and that opening and that slot are concentric. The numeral 324 denotes a small boss of rectangular form at the left-hand face of block 314, as that block is viewed in FIGS. 11 and 30.

The numberal 326 in FIGS. 11 and 30 denotes a vertically-extending web which is integral with the pivot block 314, and which also is integral with a motor-mounting web 328 that has a concave notch 330 in the upper edge thereof. The numeral 332 denotes a further web which extends to the right of the web 328 and which is spaced forwardly of the web 326. A web 334, which is generally J-shaped in plan view, extends upwardly from the upper surface of housing 200; and it has the long arm thereof contiguous with the web 332, as indicated by FIG. 30. The upper portion of that J-shaped web is partially sectioned in FIG. 11; and a concave bearing surface 336 is provided in that upper portion. Two sockets 338 are provided in the upper surface of the J-shaped web 334; and two smaller-diameter sockets are provided in that upper surface to the right of sockets 338. Screws 340 extend downwardly through a bearing cap 342 to seat in the sockets 338; and guide pins, not shown, extend downwardly from that bearing cap to seat within the smaller-diameter sockets to the right of sockets 338. An inverted, generally L-shaped extension 344 of bearing cap 342 extends upwardly and to the left from the left-hand edge of that bearing cap, as shown by FIG. 11. The under surface of the foot of extension 344 is concave. As indicated by FIGS. 11 and 17, the upper edge of web 332 is located above the level of the upper edge of web 128 of frame 100. As indicated by FIG. 11, the upper edge of J-shaped web 334 is located above the level of the upper edge of web 332.

Referring particularly to FIGS. 23–27, the numeral 346 generally denotes a cam shaft which has a square left-hand end 348, as the cam shaft is viewed in FIG. 23. Single-lobe cams 350, 352 and 354 are formed integrally with that cam shaft; and a collar 356, a cylindrical portion 358, immediately adjacent the right-hand face of the cam 354, and a small diameter pin 360 also are formed integrally with that cam shaft. As shown by FIG. 11, the square end 348 of cam shaft 346 extends through the opening 320 in pivot block 314; and the adjacent cylindrical portion of that cam shaft is journaled in the right-hand portion of that opening. A gear 362 has a hub which extends freely into the left-hand portion of opening 320 in block 314; and that hub has a square passage therethrough which accommodates the square end 348 of cam shaft 346. That gear has an arcuate abutment 364 spaced from the axis of that gear; and that abutment is disposed within the arcuate slot 322 in pivot block 314, as shown by FIG. 27. A torsion spring 361 has a loop which is defined by a plurality of turns thereof and which surrounds the hub of gear 362. The arms of that spring extend downwardly past the ends of arcuate abutment 364 to bear against the sides of the boss 324. That spring normally maintains the cam shaft 346 in the position indicated by FIGS. 23–26; but it can yield to permit rotation of that cam shaft in either direction from that position. The arcuate slot 322 will permit, but will set limits for, rotation of cam shaft 346 away from the position of FIGS. 23–26.

To assemble cam shaft 346 with the housing 200, the bearing cap 342 will be separated from the J-shaped web 334, the square end 348 of that cam shaft will be aligned with opening 320 in pivot block 314, the gear 362 will have its hub set within the left-hand portion of that opening, and then that square end will be passed through that opening and pressed into the square passage within that hub. At such time, the cam 350 will be in register with the cap 274, the cam 352 will be in register with the cap 276, the thrust collar 356 will be immediately to the left of the closed end of J-shaped web 334, and the cam 354 will be in register with the cap 278. Also, the arcuate abutment 364 on gear 362 will be disposed within arcuate slot 322 in pivot block 314; and the lobe of cam 352 will be disposed so its axis is aligned with the abutment 364 on gear 362. The turns which define the loop of spring 361 have diameters which are greater than the diameters of the hub of gear 362 and of the left-hand portion of opening 320 in pivot block 314; and hence those turns do not impede the introduction of that hub into that left-hand portion. In their normal unstressed positions, the lower ends of spring 361 are close together; but those lower arms are readily spread apart to abut the opposite sides of abutment 364 and of boss 324.

In the normal position of cam shaft 346, the cam 352 holds cap 276, shaft 253, gear 254 and pin 255 in their lower positions, but cams 354 and 350 permit caps 278 and 274, shafts 249 and 257, gears 250 and 258, and pins 251 and 259 to remain in their upper positions. When that cam shaft is rotated in the clockwise direction in FIG. 24, until the abutment 364 engages the left-hand upper end of slot 322, the cam 354 will force cap 278, shaft 249, gear 250 and pin 251 down to their lower positions, cam 350 will permit cap 274, shaft 257, gear 258 and pin 259 to remain in their upper positions and cam 352 will permit cap 276, shaft 253, gear 254 and pin 255 to move to their upper positions. Conversely, when that cam shaft is rotated in the counterclockwise direction, until the abutment 364 engages the right-hand upper end of slot 322, the cam 350 will force cap 274, shaft 257, gear 258 and pin 259 down to their positions, cam 354 will permit cap 278, shaft 249, gear 250 and pin 251 to remain in their upper positions, and cam 352 will permit cap 276, shaft 253, gear 254 and pin 255 to move to their upper positions.

Referring particularly to FIGS. 11 and 17, the numeral 366 denotes a small, stall-type, electric motor which has a cylindrical bearing housing 368 that is dimensioned to fit within the circular opening 318 adjacent the top of pivot block 314, as shown by FIG. 11. The numeral 370 denotes the hub of a gear 372 which is intended to mesh with the gear 362 that is secured to the square end 348 of cam shaft 346, as shown by FIG. 11. The hub 370 has "flats" at the opposite sides thereof; and those flats are dimensioned to permit that hub to be moved upwardly or downwardly through the slot 316 in the upper edge of pivot block 314. As a result, gear 372 can be pressed onto the output shaft 367 of motor 366 before that motor is assembled with pivot block 314.

To assemble the motor 366 with pivot block 314, the "flats" on hub 370 will be set vertical, and then will be passed downwardly through slot 316 while bearing housing 368 of that motor is disposed to the right of that pivot block. As that bearing housing moves down into register with opening 318, adjacent the top of pivot block 314, the motor 366 will be shifted axially to the left until that bearing housing moves into, and is centered and supported by, the opening 318. At this time, the right-hand portion of the housing of motor 366 will rest in the concave notch 330 in the upper edge of web 328. Thereupon, the bearing cap 342 will be set in position to confine the right-hand end of cam shaft 346, and also to cause the concave under surface of extension 344 to engage a cylindrical bearing housing 369 at the right-hand end of motor 366, as that motor is viewed in FIG. 11. Thereafter, the screws 340 will be seated to hold motor 366 and cam shaft 346 in position.

The numeral 376 generally denotes a gate which has a passage therethrough that is large enough to accommodate dollars which are to be returned or accepted by the coin changer. That passage extends all the way to the left-hand edge of that gate, so that passage has an open left-hand side. Two small-diameter bosses 378 extend beyond the left-hand edge of gate 376 to bear against the inner surface of the left-hand wall 103 of frame 100. Those bosses will prevent shifting of gate 376 to the left while minimizing frictional losses between that gate and that inner surface. A cylindrical boss 380 extends beyond the right-hand edge of gate 376, as that gate is viewed in FIG. 17; and that boss has a crank arm 382 thereon, as indicated by FIG. 21. A pin 384 projects from crank arm 382; and that pin is shown by FIG. 21. The upper end of the gate 376 has a rounded surface which defines coin-supporting areas 386 and 388 at opposite sides of the entrance to the passage through that gate. An elongated shaft 390 is secured to, and extends to the right from, the boss 380.

The numeral 392 generally denotes a mounting bracket which has upstanding bearing-defining arms 394 that have notches at the rear faces thereof which encircle and support the shaft 390, as shown by FIG. 18. A circular boss 396 extends outwardly from the bracket 392, and it has a vertically-directed slot 398 therein. A vertical blade, not shown, at the rear surface of bracket 392 is disposed within a vertical slot, not shown, in the front surface of median wall 102; and that blade and that slot confine and guide that bracket for limited vertical adjusting movement. A screw 400 passes through slot 398 in boss 396 to seat in a socket in median wall 102; and loosening and tightening of that screw permits adjustment of the vertical position of bracket 392, and hence of gate 376. Because the bracket 392 will be held vertical in all adjusted positions thereof, shaft 390 and the axis of gate 376 will always be held horizontal as that bracket, shaft and gate are adjusted vertically. The notches in the rear faces of the bearing-defining arms 394 of bracket 392 are large enough to permit ready rotation of shaft 390 and of gate 376, but are small enough to hold that shaft and that gate against tilting. The bracket 392 will not be used to secure shaft 390 and gate 376 to the median wall 102 until after the wall 144 has been secured to that median wall. The coil-type sensor 149 will be suitably held within the arcuate rib 147 on the wall 144 by cement, clamps, or other methods used in the trade before that wall is secured to the median wall 102 by the screw 146.

In assembling the gate 376 and the bracket 392 with the median wall 102, that gate is set in the position shown by FIGS. 17 and 18; and then the blade on the rear of that bracket is introduced into the slot in the median wall 102. Thereafter, the screw 400 is passed through the slot 398 in the boss 396 and seated in that median wall. That screw will be tightened sufficiently to cause the notches in the rear of the bearing-defining arms 394 to hold the shaft 390 close to the position shown by FIGS. 17 and 18; but that screw will not be fully seated at this time. In that position, the shaft 390 is in register with, and is immediately adjacent, the abutments 105 on the median wall 102.

After the bracket 392 and the gate 376 have been assembled with the median wall 102 of frame 100, the dollar return chute 152 will have the pin 166 thereof set within the circular opening 122 in side wall 103 of that frame. Also, that chute will have the lower portion of the flange 160 thereof and the lower portion of the flange 164 thereof moved rearwardly into engagement with the forward face of web 128 and into position intermediate the ribs 131 on that web. At this time, the sub-assembly 168 will be assembled with frame 100; and a portion of the rear surface of the housing 200 will be set immediately adjacent the lower portion of the chute 142. At this time, the upper portion of chute 152 will overlie the lower portion of bracket 392; but the notch 162 in the upper edge of that chute will provide full access to the screw 400, as shown particularly by FIG. 17.

The numeral 402 denotes an elongated connecting rod which has openings in the opposite ends thereof. The opening in the upper end of that connecting rod encircles the pin 384 on crank arm 382 of gate 376; and the opening in the lower end of that connecting rod encircles the pin 360 on the cylindrical portion 358 of cam shaft 346, all as shown by FIG. 21. That connecting rod will be assembled with pin 384 and with pin 360 during the assembling of the sub-assembly 168 with the frame 100.

In assembling the sub-assembly 168 with frame 100, the projections 196 at the rear of bottom plate 170 of that sub-assembly will be aligned with the two slots 129 in the web 128 at the rear of that frame. Also the ears 199 and 201 on the housing 200 of that sub-assembly will be generally aligned with the horizontally-directed slots 108 and 124 in the side walls 101 and 103, respectively. As those ears enter those slots, the projections 196 will approach the slots 129 and, just prior to the time the downwardly-directed lips on those ears approach the rear faces of the abutments 110 and 126 at the lower edges of those slots, those abutments will enter those slots. At the time the projections 196 fully enter the slots 129 in web 128, the thin, downwardly-depending lips on the ears 199 and 201 will move rearwardly of the abutments 110 and 126 and will be moved downwardly behind those abutments. Also, at that time, the sides of the opening 178 in the rear edge of bottom plate 170 will be aligned with the inner faces of the flanges 160 and 164 on chute 142. Further, a portion of the housing 200 of sub-assembly 168 will abut the front surface of that chute to hold that chute in abutting engagement with web 128 and in position between ribs 131. At that time, the projections 196 will coact with slots 129, and the lips on the ears 199 and 201 will coact with the reduced-thickness walls 113 and 125 and with the projections 110 and 126 to mechanically lock the sub-assembly 168 against forward, sideward, rearward and downward movement relative to frame 100.

Referring particularly to FIG. 15, the numeral 404 generally denotes a generally-flat wall which has a semi-cylindrical section 406 adjacent the lower left-hand portion thereof; and that section has a reduced-thickness bottom edge 408 which is complementary to and fits within the rear half of the annular groove 204 at the upper end of opening 202 in the housing 200. A further semi-cylindrical portion 410 of wall 404 is located above the level of section 406; and a still further semi-cylindrical section 412 is located adjacent the upper left-hand corner of that wall. Concave vertically-directed portions of wall 404 connect, and conform to, the rearmost portions of those semi-cylindrical sections 406, 410 and 412; but those connecting portions are appreciably less than one hundred and eighty degrees in angular extent. The sections 406, 410 and 412 and the intervening concave vertically-directed portions define the rear half of a reservoir for quarters; and other portions of wall 404 define the rear surface of a plural-branch passageway for quarters.

Shallow notches 414 are provided in the upper edge of wall 404; and an upwardly and rearwardly inclined chamfer 418 is provided adjacent the upper right-hand corner of that wall. A vertically-directed notch 420 is provided in the right-hand edge of wall 404 close to that chamfer. A small-diameter circular pin 422 is provided at the rear of the plate 404; and that pin is shown by dotted lines in FIG. 15. That pin coacts with the socket 115, shown by FIG. 17, in the median wall 102 to help restrain and position the upper end of wall 404.

An arcuate runway 424 inclines downwardly and to the left from the right-hand end of chamfer 408; and that runway is the upper surface of a forwardly-extending portion 426 of wall 404 which has an elongated, vertically-directed, left-hand edge, has a horizontal offset at the bottom of that edge, has an inclined portion below that offset, has a further horizontal offset below that inclined portion, and has a vertically-directed portion below that further horizontal offset. The right-hand edge of the portion 426 is flush with the right-hand edge of wall 404. Small circular sockets 428 and a keyhole-shaped opening 430 are provided in the forwardly-extending portion 426. A short and narrow forwardly-extending portion 432 of wall 404 is located to the left of the forwardly-extending portion 426, and has a vertical right-hand face that confronts, but is spaced from, the elongated, vertically-directed left-hand edge of portion 426 to define part of one branch of the passageway for quarters. A straight runway 434, which inclines downwardly from left to right, is provided by the top of a further forwardly-extending portion of wall 404 adjacent the lower edge of that wall. That runway terminates at the lower edge of the elongated left-hand side of a notch 436 in the lower edge of wall 404; and that notch accommodates the left-hand wall of the cash box chute 142. The slot 143 in that left-hand wall is in register with the lower end of runway 434. The right-hand edge of that notch is defined by a portion of the lower edge of wall 404 which is disposed within the upper portion of the cash box chute 142; and that portion of that lower edge is horizontally directed. The left-hand and bottom surfaces of that portion of the lower edge of wall 404 are chamfered, as indicated by the numeral 438, to keep those surfaces from interfering with quarters which roll along runway 434 and pass through slot 143 to enter the cash box chute.

A further forwardly-extending portion 440 is provided on the wall 404; and that portion is adjacent the upper edge of that wall and is intermediate the semi-cylindrical section 412 and right-hand notch 414. The left-hand notch 414 is in that portion; and the lower surface of that portion and the right-hand upper edge of the semi-cylindrical section 410 coact to define the rear half of an upper entrance 442 for the quarter reservoir. In one preferred embodiment of the present invention, that entrance is about two inches high. The numeral 444 defines a lower entrance for the quarter reservoir which is located between the bottom of the semi-cylindrical section 410 and the upper end of the semi-cylindrical section 406. In the said preferred embodiment, that entrance is about one and thirteen-sixteenths inch high.

The numerals 446, 448, 450, 452, 454, 456 and 458 denote small circular sockets which are formed in the front surface of wall 404. Sockets 446 and 448 and sockets 446 and 450 selectively receive pins 460 and pin 462 on the rear surface of a runway 464, which is shown by solid lines and also by dotted lines in FIG. 15. If that runway is set in its solid-line position, the upper surface thereof will act as an extension of the runway 424 and hence will direct quarters toward the entrance 442 along the path indicated by the arrow 466. However, if that runway is set in its dotted-line position, the right-hand surface thereof will keep quarters from passing to the entrance 442 and, instead, will force those quarters to move downwardly along the path indicated by the arrow 468 in the branch passageway which is defined by the confronting faces of the forwardly-extending portions 426 and 432. A curved portion of the upper right-hand edge of runway 464 will help cause quarters to start moving downwardly along the path 468 whenever that runway is set in its dotted-line position. The position in which the runway 464 will be set will be determined by the purchaser of the coin changer; and that position will be noted on a factory assembly sheet to guide the assembler.

The numeral 470 denotes a deflector which has pins 472 and 474 at the rear surface thereof that are disposable within the sockets 452 and 454 or within the sockets 456 and 458 in wall 404 to dispose that deflector in its solid-line or its dotted-line position. When that deflector is set in its solid-line position, any quarter which leaves runway 464 and attempts to, but cannot, pass through the entrance 442 will fall downwardly through the path indicated by the arrow 476 and strike deflector 470. Also any quarter which moved slowly as it left runway 464 would fall downwardly along the path indicated by the arrow 478 and strike that deflector. In either event, that deflector would direct that quarter toward the entrance 444. If the quarter reservoir was full, the quarter would follow the lower part of path 476 to the runway 434, and then would roll along that runway to the cash box chute 142. If the quarter reservoir was not full, the quarter would follow the lower part of the path 478 and enter that reservoir.

The runway 464 and the deflector 470 will be set in their solid-line positions whenever the purchaser wishes to store an appreciable number of quarters in the quarter reservoir. In such event, that runway will direct each quarter toward the entrance 442 along the path 466. However, if a purchaser wanted to store only a limited number of quarters in the quarter reservoir, the runway 464 and the deflector 470 would be set in their dotted-line positions. Where that was done, the runway 464 would keep quarters from following the path 466 and, instead, would force those quarters to follow the path 468. As each quarter reached the arcuate portion of the dotted-line deflector 470, it would be directed to the left along a path 482 which leads to the entrance 444. If the level of the quarters in the quarter reservoir was low enough, that quarter would move inwardly through the entrance 444 and come to rest within that reservoir. However, if the level of the quarters within the quarter reservoir was so high that the uppermost quarter or quarters kept a further quarter from passing through the entrance 444, that further quarter would follow a path denoted by the arrow 484, and then would follow the bottom portion of the path 476 until it passed through slot 143 and entered the cash box chute 142.

In the event the purchaser of the coin changer did not want to dispense quarters as change, the runway 464 would be set in its dotted-line position but the deflector 470 would be set in its solid-line position. In such event, that runway would cause quarters to follow the path 468; and that deflector would then cause those quarters to follow a path, which is indicated by the arrow 480, and which leads to the cash box chute 142.

A circular opening 433 extends through the short and narrow forwardly-extending portion 432 on wall 404. That opening is aligned with an opening 107 in the median wall 102, as shown by FIG. 21.

The numeral 486 denotes a coil-type sensor which is disposed within a recess 488 of keyhole-shape in the rear surface of wall 404. That sensor is shown by solid lines in FIG. 7 and by dotted lines in FIG. 15; and it is adjacent both of the paths 466 and 468. As a result, that sensor will be able to sense the movement of each quarter which rolls along the runway 424, regardless of the position of runway 464 and of the path which that runway carries that quarter to follow. The sensor 486 will perform the function which is customarily performed by mechanical, photoelectric or magnetic switches in coin changers, namely, to indicate the passage of a coin past it. Wires, not shown, extend rearwardly from the sensor 486 through the keyhole-shaped opening 138 in median wall 102 to a suitable connecting block, not shown.

Referring particularly to FIG. 12, the numeral 490 generally denotes a generally-flat wall which has a semi-cylindrical section 492 that extends downwardly from about the midpoint of that wall to constitute the lowermost part of that wall. That semi-cylindrical section serves as the major part of the rear portion of a reservoir for dimes; and a bottom edge 494 of that semi-cylindrical section is complementary to, and extends into, the rear half of the annular groove 216 at the upper end of the opening 214 in the housing 200. Vertically-aligned ribs 496 and 498 define the left-hand edge of wall 490; and rib 496 is dimensioned to fit between the right-hand edges of the semi-cylindrical sections 412 and 410 of wall 404 when the wall 490 is set in confronting relation with, and immediately forwardly of, wall 404. The rib 498 is dimensioned to fit between the righthand edges of the semi-cylindrical sections 410 and 406 of wall 404 when the wall 490 is set in confronting relation with, and immediately forwardly of, wall 404. The rear surface of wall 490 will coact with the front surface of wall 404 to define the passageway for quarters whenever those walls are held in assembled relation. The rear face of rib 496 defines the front edge of the entrance 442; and the rear face of rib 498 defines the front edge of the entrance 444.

The numeral 500 denotes a small circular socket adjacent the upper edge of wall 490; and that socket will accommodate a pin 533, shown in part by FIG. 10, at the rear of wall 524 which is disposed immediately forwardly of wall 490. The numerals 502 denote notches in the upper edge of wall 490 which are in register with the notches 414 in the upper edge of wall 404. The numeral 504 denotes a forwardly-extending portion of wall 490; and the right-hand edge of that portion constitutes the left-hand edge of a passageway for dimes. A small opening 505 is provided in the portion 504, and that opening is in register with the opening 433 in the forwardly-extending portion 432 on wall 404. The bottom of the forwardly-extending portion 504 overlies the upper end of the semi-cylindrical section 492. An entrance 508 into the dime reservoir is defined, in part, by the upper edge of semi-cylindrical section 492 and the lower edge of the forwardly-extending portion 504. A concave portion of wall 490 extends upwardly from the upper edge of semi-cylindrical section 492 to the lower edge of forwardly-extending portion 504 to serve as the upper end of the rear portion of the dime reservoir. A vertically-directed, forwardly-extending portion 510 is provided at the right-hand edge of wall 490; and the upper part of that portion parallels, but is spaced to the right from, the right-hand edge of forwardly-extending portion 504 to help define the upper portion of the dime passageway, and thereby cause dimes to follow the path which is indicated by arrow 506. A concave surface on portion 510 inclines downwardly from upper right to lower left to guide dimes toward the entrance 508. In the event the dime reservoir is full, an incoming dime will strike one of the uppermost dimes in that reservoir and rebound toward the cash box chute 142 along the path indicated by the arrow 512. A further forwardly-extending portion 514 is provided adjacent the upper end of the right-hand edge of the semi-cylindrical section 492; and the upper end of that forwardly-extending portion inclines downwardly toward the cash box chute at a steep angle.

The numeral 516 denotes small circular pins at the rear of wall 490 which extend into the sockets 428 in wall 404 when the former wall is moved into engagement with the latter wall. Those pins and sockets partially restrain and position the wall 490. The numeral 518 denotes a keyhole-shaped recess in the rear surface of wall 490; and that recess is in register with the upper portion of the path 506 for dimes. As a result, every dime which enters the coin changer will have to move past, and be sensed by, a coil-type sensor 520 which is mounted within that recess. Wires, not shown, which are attached to that sensor will pass rearwardly through notch 420 adjacent the keyhole-shaped opening 430 in wall 404.

A small notch 522 is provided in the upper portion of the right-hand edge of the forwardly-extending portion 510 on wall 490. That notch is in register with the notch 420 in wall 404; and those notches will accommodate the wires from a coil-type sensor 574 which is secured within a keyhole-shaped recess 572 in the front surface of a wall 558.

The wall 524 is shown particularly by FIG. 10; and it generally resembles an inverted J. The numeral 548 denotes a forwardly-extending, vertically-directed section and that section defines the left-hand edge of wall 524, has a semi-cylindrical surface 550 at the rear thereof that serves as the front half of the quarter reservoir, and has a generally-planar surface at the front thereof that serves as the rear of a return coin chute 583, all as shown by FIG. 8. That coin return chute will receive coins or slugs from the slug rejector, not shown, which will be mounted above the walls 404, 490 and 524; and that coin return chute will direct those coins and slugs to the space which is defined, in part, by the cut-away portion 222 of the housing 200. The upper portion 546 of the front surface of section 548 inclines rearwardly at an angle of about forty-five degrees; and it serves as a closure for the quarter reservoir. A vertically-directed slot 556 is located in the portion 546, as shown by FIG. 10. That slot is tall enough and wide enough to accommodate quarters, whenever those quarters are moved toward that slot in a direction which is substantially at right angles to the plane of the paper, in a direction which is substantially at right angles to the plane of portion 546, or in any intermediate direction. However, the angle of portion 546 and the height of slot 556 coact to prevent the passage through that slot of quarters which move toward that slot in a direction that is parallel to the axis to the quarter reservoir. In fact, the angle of portion 546 and the height of slot 556 coact to prevent the passage through that slot of nickels or dimes which move toward that slot in a direction that is parallel to the axis of the quarter reservoir. The semi-cylindrical rear surface 550 of section 548 has a reduced-thickness bottom edge, not shown, which is complementary to, and which fits within, the front half of the annular groove 204 at the upper end of opening 202 in housing 200. That reduced-thickness bottom edge and the reduced-thickness bottom edge 408 on the semi-cylindrical section 406 of wall 404 will coact with that annular groove to prevent forward, rearward, downward or sideward movement of the lower portions of section 548 of wall 524 or of section 406 of wall 404 relative to the sub-assembly 168 or the frame 100. Openings 552 in the front surface of section 548 make it possible to visually determine the number of quarters in the quarter reservoir.

The numeral 526 denotes a semi-cylindrical section which abuts the right-hand edge of the forwardly-extending section 548; and a reduced-thickness bottom edge 528 on that section is complementary to, and fits within, the rear half of the annular groove 208 at the top of the opening 206 in housing 200. The semi-cylindrical section serves as the major part of the rear half of a reservoir for nickels; and the portion of wall 524 which is immediately above the right-hand edge of that semi-cylindrical section constitutes an entrance 530 for that reservoir. A concave vertically-directed portion of wall 524 constitutes an upward extension of semi-cyindrical section 526, and hence serves as the upper part of the rear half of the nickel reservoir.

A small circular socket 532 is provided adjacent the upper edge of wall 524; and that socket will accommodate an aligning pin 576 at the rear surface of the wall 558. The aligning pin 533, which extends rearwardly from the rear surface of wall 524, to fit into the aligning socket 500 in wall 490, is in register with the opening 532. Notches 534 in the upper edge of wall 524 will be aligned with the notches 502 in wall 490 and with the notches 414 in wall 404 whenever those three walls are set in closely spaced registry with each other.

A chamfer 536 is provided adjacent the right-hand end of the upper edge of wall 524; and a forwardly-extending portion 538 is disposed below that chamfer. The upper end of that forwardly-extending portion is concave and inclines downwardly from upper right to lower left; and it will direct nickels toward the entrance 530 of the nickel reservoir along a path indicated by the arrow 540. If the nickel reservoir is full, an incoming nickel will strike one of the uppermost nickels in that reservoir and rebound to the right along the path which is indicated by the arrow 542. That path leads downwardly to the cash box chute 142. The lower part of the forwardly-extending portion 538 is vertically-directed; and it helps define the vertically-directed part of path 542. A forwardly-extending portion 544, which generally resembles an inverted L, has a vertically-directed part which helps define the vertically-directed part of path 542. That portion has an upper part which extends to the right from the lower end of entrance 530 and then inclines downwardly from left to right to constitute a runway along which rebounding nickels can roll toward the vertically-directed part of path 542. The forwardly-extending portion 544 has a small opening 545 therein which is in register with the openings 505 and 433 in the walls 490 and 404. That forwardly-extending portion has a narrow elongated path which abuts the right-hand edge of the semi-cylindrical section 526; and that part, the runway-defining part, and the right-hand part of that portion coact to define a notch which provides the J-shaped configuration for wall 524 and also accommodates the front of the semi-cylindrical section 492 on wall 490.

A small notch 554 is provided in the right-hand edge of the forwardly-extending portion 538 of wall 524. That notch is in register with the notch 522 of wall 490, and also is in register with the notch 420 in wall 404. The notch 554 will accommodate wires from the coil-type sensor 574.

The right-hand portion of the rear surface of wall 524 coacts with the right-hand portion of the front surface of wall 490 to define the dime passageway. The front surface of wall 524 constitutes the rear surface of the nickel passageway.

The wall 558 is shown particularly by FIG. 6; and it has a vertically-directed essentially-planar section 560 at the left-hand edge thereof, has a semi-cylindrical section 562 disposed to the right of section 560, has a further semi-cylindrical section 564 that is spaced a short distance to the right of section 562, and has a planar section 566 of lesser vertical extent which abuts the right-hand edge of section 564. A vertically-directed, rearwardly-extending connecting portion 582 of wall 558 interconnects the right-hand edge of planar section 560 with the left-hand edge of semi-cylindrical section 562, as indicated by FIG. 7. A chamfer 568 is provided at the rear face of the right-hand end of the upper edge of the wall 558, as shown by FIG. 2; and that chamfer is in register with the chamfer 536 at the right-hand end of the upper edge of the forward face of wall 524. Those chamfers coact to facilitate the movement of nickels into the nickel passageway which has the paths 540 and 542 and which is defined by the forward surface of wall 524 and by the rear surface of the planar section 566 of wall 558.

The numeral 570 denotes a notch in the upper portion of the right-hand edge of the wall 558; and that notch will be in register with the notch 554 of wall 524, notch 522 of wall 490, and notch 420 of wall 404 whenever those walls are in assembled relation. Those notches accommodate wires from the coil-type sensor 574 which is held by the keyhole-shaped recess 572 in the front surface of wall 558. The numeral 578 denotes an opening which is located above the semi-cylindrical section 564; and that opening will be in register with the openings 545 of wall 524, 505 of wall 404 and opening 433 of wall 404 whenever those walls are in assembled relation.

The planar section 560 of wall 558 is displaced forwardly of the section 548 of wall 524 to constitute the forward surface of the return coin chute 583. Openings 561 in that planar section are in register with the openings 552 in that portion 548 of wall 524; and hence make it possible to visually determine the level of the quarters in the quarter reservoir. Three ears 580 extend outwardly beyond the left-hand edge of the planar section 560; and two of those ears are lodged within the slots 104 in side wall 101, while the other of those ears is lodged within the slot 106, all as shown by FIG. 4. Those two ears and the slots 104 hold the left-hand edge of wall 558 against movement forwardly, rearwardly, or downwardly relative to side wall 101. The bottom of the planar section 560 extends into the space which is defined by the cut-away portion 222 of the housing 200, as indicated by FIG. 3. A small notch 584 is provided in the right-hand edge of the planar section 560, and also in the forward edge of the connecting portion 582, as indicated by FIG. 6; and that notch is for tooling purposes. The connecting portion 582, the flange 101, the planar section 560, and the portion 548 of wall 524 define the coin return chute 583; and a suitable conduit, not shown, will be disposed beneath that chute to conduct coins to a coin cup at the exterior of the machine in which the coin changer will be mounted. That conduit, or further conduits, will underlie the openings 186, 188, 192 and 178 in the bottom plate 170. A further conduit, not shown, will underlie the cash box chute 142; and it will conduct coins to the cash box of that machine.

A planar portion 586, at the top of the planar section 560 of the wall 558, inclines upwardly and rearwardly from the plane of that section at an angle of about ten degrees from the vertical, as indicated particularly by FIG. 2. Because the upper portion 546 of the generally-planar front surface of the section 548 of wall 524 inclines upwardly and rearwardly from that front surface at an angle of about forty-five degrees, the portions 586 and 546 define an upwardly-diverging coin-receiving entrance for the coin return chute 583. A vertically-directed slot 588 is formed in the inclined portion 586; and the edges of that slot are chamfered, as indicated by FIGS. 1, 2 and 6. The upper edge of slot 588 is located above the level of the upper edge of slot 556 in the inclined portion 546 of wall 524; and the bottom edge of slot 588 is located above the level of the bottom edge of slot 556. The rear surface of planar section 560 is spaced only about five-sixteenths of an inch forwardly of the lower edge of the slot 556 in the inclined portion 546. The height and width of slot 588 are large enough to permit quarters to pass through that slot in a direction which is at right angles to the plane of the paper, and also to pass through that slot in a direction which is at right angles to the plane of inclined portion 586. The height of slot 556 in the portion 546 of section 548 of wall 524, the angle of that portion, the closeness of planar section 560 to the lower edge of slot 556, and the disposition of the upper and lower edges of that slot below the levels, respectively, of the upper and lower edges of the slot 588 in the portion 586 of section 558, easily permit quarters to pass successively through slot 588, through coin return chute 583, and slot 556 to enter the quarter reservoir. However, a horizontal projection of the slot 556 would extend such a short distance into the quarter reservoir that it would be impossible for a nickel or a dime to have a straight-line path, which was parallel to the axis of that quarter reservoir, through that slot. Moreover, the upper end of the slot 556 in the portion 546 is so close to the upper edge of the coin changer that any coin or slug which was rejected by the slug rejector would be held essentially parallel to that axis of the coin return chute 583, which is parallel to the plane of the paper, until the lower edge of that coin or slug had moved downwardly below the upper edge of that slot; and hence that coin or slug would be displaced about ninety degrees from the path which quarters follow in passing successively through slots 588 and 556. As a result, even very thin and small diameter coins or slugs, which were rejected by the slug rejector, would pass downwardly through the coin return chute 583 and pass by the quarter reservoir—even if those coins or slugs engaged the portion 546 of wall 524 at points close to the slot 556. In this way, each patron is assured of receiving any coins or slugs which were rejected by the slug rejector.

The semi-cylindrical section 564 of wall 558 has a reduced-thickness bottom edge 567; and that reduced-thickness bottom edge and the reduced-thickness bottom edge 494 on the semi-cylindrical section 492 of wall 490 fit into the annular groove 216 at the upper end of the opening 214 in housing 200, as shown by FIG. 21. In doing so, those bottom edges prevent forward, rearward, downward or sideward movement of the lower ends of those semi-cylindrical sections relative to the sub-assembly 168, and hence relative to frame 100. The semi-cylindrical sections 564 and 492 constitute the major portions of the dime reservoir. Openings 565 in the semi-cylindrical section 564 permit visual determination of the level of dimes within the dime reservoir.

The semi-cylindrical section 562 of wall 558 has a reduced-thickness bottom edge, not shown, which resembles the reduced-thickness bottom edge 528 of the semi-cylindrical section 526 of wall 524. Those reduced-thickness bottom edges fit into the annular groove 208 at the upper end of the opening 206 in housing 200; and, in doing so, prevent forward, rearward, downward or sideward movement of the lower ends of those semi-cylindrical sections relative to the sub-assembly 168, and hence relative to the frame 100. The semi-cylindrical sections 562 and 526 constitute the major portions of the nickel reservoir. Openings 563 are provided in the semi-cylindrical section 562 to permit visual determination of the level of the nickels within that nickel reservoir.

The planar section 566 constitutes the right-hand edge of wall 558. A portion of that section overlies, but is spaced above the level of, a squared-off entrance 569 at the upper end of the semi-cylindrical section 562. That squared-off entrance permits a service man to introduce nickels into the nickel reservoir. A further portion of the planar section 566 overlies, but is spaced above the level of, a squared-off entrance 571 at the upper end of the semi-cylindrical section 564. That squared-off entrance permits a service man to introduce dimes into the dime reservoir.

Referring particularly to FIG. 1, the numeral 590 denotes a cover plate which has a horizontally-directed slot 592 adjacent the upper edge thereof, has a forwardly-extending portion 594 adjacent the bottom thereof, has a rearwardly-displaced rectangular portion 596 with an opening 598 therein, has a portion which overlies and is displaced upwardly from the entrance 569 for nickels, and has a portion which overlies and is displaced upwardly from the entrance 571 for dimes. In addition, ears 599 are provided at the right-hand edge of cover plate 590 to fit into the slots 112, 114 and 116 in side wall 103 of frame 100. The engagements between those ears and slots partially restrain and position that cover plate. The forwardly-extending portion 594 has a rearwardly-directed web 602 which will overlie and engage the upper surface of the motor 230 and will serve to hold that motor in assembled relation with the cover 200 whenever the cover plate 590 is assembled with the wall 558 and with frame 100. As shown by FIG. 21, the opening 598 accommodates an elongated screw 600 which passes through the opening 598, the opening 578 in the planar section 566 of wall 558, the opening 545 in the forwardly-extending portion 544 of wall 524, the opening 505 in the forwardly-extending portion 504 of wall 490, the opening 433 in the forwardly-extending portion 432 of wall 404, and the opening 107 in median wall 102 to seat in the nut 109.

A horizontally-directed web 604 is provided at the rear surface of cover plate 590 adjacent the upper edge of that cover plate; and that web extends rearwardly to engage the front surface of the upper portion of the planar section 566 of wall 558, all as shown by FIG. 21. A slide, which is generally denoted by the numeral 606, is shown in FIGS. 6 and 21; and it has a finger-receiving ear 608 that extends forwardly through the slot 592 in the upper portion of the cover plate 590. That slot is shown by dotted lines in FIG. 6 to show its relative position to the slide 606. A flexible detent 610 is provided at the lower edge of slide 606; and that detent is selectively engageable with various of the teeth on a rack 612 which is formed integrally with the upper surface of the web 604, as indicated by FIG. 21. Cams 614 and 616 and a wide-faced cam 618 are provided at the rear of the slide 606, as indicated particularly by FIG. 6; and those cams are selectively engageable with push pins 620 and 622. Those push pins are slidably disposed within, and guided by, notches 534 in wall 524, notches 502 in wall 490, notches 414 in wall 404, and by openings 135 in median wall 102. The rear ends of those push pins will be adjacent switches, not shown, on a printed circuit board, not shown. Those push pins will be set in position relative to the walls 404, 490, 524 and 558 after those walls have been set in position relative to sub-assembly 168 and frame 100. Those push pins, those switches, and that printed circuit board are not, per se, parts of the present invention, and hence are not being described in detail.

Whenever the slide 606 is in the right-hand position indicated by FIGS. 1 and 6, none of the cams 614, 616 and 618 will be in engagement with push pin 620 or push pin 622, and hence those push pins will be in their normal forward positions. When that slide is shifted a short distance to the left of the position shown by FIG. 6, cam 614 will cause the push pin 620 to move rearwardly and close the switch which is adjacent the rear end thereof but push pin 622 will be permitted to remain in its forward position. When the slide 606 is shifted still further to the left, the cam 614 will permit the push pin 620 to move forwardly to its forward position but the cam 618 will cause the push pin 622 to move rearwardly and close the switch adjacent the rear end thereof. When the slide 606 is shifted to the left until the ear 608 thereon engages the left-hand end of slot 592, the cam 616 will cause the push pin 620 to move rearwardly and close the switch which is adjacent the rear end thereof and the wide-faced cam 618 will continue to cause push pin 622 to hold the switch adjacent the rear end thereof closed.

At the time the sub-assembly 168 has its projections 196 set within the slots 129 in web 128 and has its ears 199 and 201 set in position at the rear faces of abutments 110 and 126, that sub-assembly will be held against forward, rearward, sideward and downward movement; but it will not be held against upward movement. When the reduced-thickness bottom edge 408 of the semi-cylindrical section 406 of wall 404 is set within the rear half of the annular groove 204 at the upper end of opening 202 in housing 200, that wall will be partially restrained and positioned by that annular groove, by the engagement of pin 422 at the rear of that wall with the socket 115 in median wall 102, and by the engagement of the rear of wall 404 with the L-shaped forwardly-extending portion 134 of that median wall. As a result, the wall 404 will be held against downward, upward, sideward and rearward movement, but it will not be held against forward movement relative to sub-assembly 168 or frame 100.

When the reduced-thickness bottom edge 494 of the semi-cylindrical section 492 of wall 490 is set within the rear half of the annular groove 216 at the upper end of opening 214 in housing 200, that wall will be partially restrained and positioned by that annular groove, by the engagement of pins 516 at the rear of that wall with the sockets 428 in wall 404, and by the engagement of the rear of wall 490 with the forwardly-extending portions 426, 432 and 440 of wall 404. As a result, the wall 490 will be held against downward, upward, sideward and rearward movement, but it will not be held against forward movement relative to sub-assembly 168 or frame 100.

When the reduced-thickness bottom edge 528 of the semi-cylindrical section 526 of wall 524 is set within the rear half of the annular groove 208 of the upper end of opening 206 in housing 200, that wall will be partially restrained and positioned by that annular groove, by the engagement of the pin 533 with the socket 500 in wall 490, and by the engagement of the rear of wall 524 with the forwardly-extending portions 504, 510 and 514 of wall 490. As a result, the wall 524 will be held against downward, upward, sideward and rearward movement, but it will not be held against forward movement relative to sub-assembly 168 or frame 100.

When the reduced-thickness bottom edges of the semi-cylindrical surface 550 and of the semi-cylindrical sections 562 and 564 of wall 558 are set within the front halves of the annular grooves 204, 208 and 216, respectively, of the openings 202, 206 and 214 in housing 200, that wall will be partially restrained and positioned by those annular grooves, by the engagement of pin 576 at the rear of that wall with the socket 532 in wall 524, by the engagement of the rear of wall 558 with the forwardly-extending portions 538 and 544 of wall 524, by the engagement of the semi-cylindrical surface 550 with the semi-cylindrical sections 406, 410 and 412 of wall 404, by the engagement of the semi-cylindrical section 562 with the semi-cylindrical section 526 of wall 524, and by the engagement of the semi-cylindrical section 564 with the semi-cylindrical section 492 of wall 490. As a result, the wall 558 will be held against downward, upward, sideward and rearward movement, but it will not be held against forward movement relative to sub-assembly 168 or frame 100.

When the ears 599 on cover plate 590 are set within the slots 112, 114 and 116 of side wall 103, and the rear surface of that cover plate is set against the planar section 566 of wall 558, that cover plate will be partially restrained and positioned. Also, the web 602 will be engaging and restraining the motor 230 atop the housing 200.

At this time, the openings 107 in median wall 102, 433 in wall 404, 505 in wall 490, 545 in wall 524, 578 in wall 558, and 598 in cover plate 590 will be in register. Thereupon, the elongated screw 600 will be passed through those aligned openings and seated in the nut 109. That screw will constitute the only fastener which is needed to hold all of walls 404, 490, 524, and 558 and the cover plate 590 in assembled relation with the frame 100. Moreover that screw will cause those walls to prevent upward movement of the sub-assembly 168, and will thereby make that screw the only fastener which is needed to hold that sub-assembly within the frame 100. All of this means that an assembler can dispose the sub-assembly 168 in engagement with the frame 100, and thereby hold the dollar return chute 152 within that frame, without using a fastener to hold that sub-assembly in position. Thereafter, that assembler can dispose each of the walls 404, 490, 524, and 558 and cover plate 590 in engagement with frame 100 and sub-assembly 168, and then use just the elongated screw 600 to fixedly secure that return chute, that sub-assembly, those walls, and that cover plate to frame 100. As a result, rapid and easy assembling of dollar return chute 152, sub-assembly 168, walls 404, 490, 524 and 558, and cover plate 590 with frame 100 is attained.

After the screw 600 has been tightened relative to the nut 109, the assembler will check the position of the passage in the gate 376 relative to the exit of the dollar passageway which is defined by the median wall 102 and the cover plate 144. If, because of manufacturing tolerances, the passage in that gate is not precisely aligned with that exit, the assembler will shift the bearing bracket 392 upwardly or downwardly, and will thereby shift the vertical position of shaft 390. That vertical shift of that shaft will act through the crank arm 382 and the connecting rod 402 to cause the passageway in the gate 376 to be precisely aligned with the exit of the dollar passageway.

FIGS. 31–37 show a coin-dispensing sub-assembly 699 wherein three solenoids 700, 712 and 728 have been used to replace cam shaft 346, selector motor 366, and gears 362 and 372. Many of the components of the coin-dispensing sub-assembly 699 are identical to the identically-numbered components of the coin-dispensing sub-assembly 168 of FIGS. 1–30; and those components perform the same functions in both coin-dispensing sub-assemblies.

The numeral 676 in FIGS. 32, 33, 36 and 37 generally denotes a gate which is essentially identical to the gate 376; but it differs from the latter gate in not having a crank arm 382 or a pin 384. As a result, the hub 680 is cylindrical throughout its length. Small diameter bosses 678 extend beyond the left-hand edge of gate 676 to bear against the inner surface of side wall 103 of frame 100. A coin-supporting area 686 and a further coin-supporting area 688 are provided at the upper surface of gate 676 at opposite sides of the entrance to the passage through that gate. Those coin-supporting areas preferably are identical to the coin-supporting areas 386 and 388 of gate 376.

The numeral 690 denotes a shaft which resembles, but which is longer than, the shaft 390. Shaft 690 will be held for rotation about its axis by the front faces of abutments 105 and by notches in the rear faces of the bearing-supporting arms of bracket 392. The bosses 678 and the hub 680 hold shaft 690 and gate 676 against axial shifting.

The solenoid 700 has a bobbin 702; and the lower end of that bobbin is seated within an annular socket 701 in the upper surface of the housing 200. A combination guide and stop 704 is fixedly mounted within the lower end of bobbin 702; and it has a vertically-directed passage therethrough which rotatably and slidably accommodates a shaft 706. A flanged sleeve 708 is pressed onto, and will rotate and translate with, the shaft 706; and the gear 254 is pressed onto, and will rotate and translate with, the lower end of that shaft. A helical compression spring 710 encircles the upper portion of the flanged sleeve 708; and it bears against the upper end of bobbin 702 and against the lower surface of the sleeve of flanged sleeve 708. That spring urges sleeve 708, shaft 706 and gear 254 upwardly to the position shown by FIG. 31; but that spring can yield, in response to energization of solenoid 700, to permit the gear 254 to move downwardly far enough to dispose the lower end of pin 255 below the level of the upper edge of wall 294 on slide 280. The combination guide and stop 704 will limit downward, as well as upward, movement of sleeve 708, shaft 706, gear 254 and pin 255.

The solenoid 712 will be essentially identical to the solenoid 700, but the bobbin thereof is denoted by the numeral 711, the combination guide and stop thereof is denoted by the numeral 714, and the flanged sleeve thereof is denoted by the numeral 716. A shaft 715 is rotatably and slidably guided by the combination guide and stop 714; and it has the sleeve 716 pressed onto the upper end thereof and has the gear 250 pressed onto the lower end thereof. A helical compression spring 718 surrounds the upper portion of sleeve 716 to urge gear 250 upwardly to the position shown by FIG. 31. However, that spring can yield, in response to energization of solenoid 712, to permit the pin 251 on gear 250 to be disposed below the level of the upper edge of wall 294 on slide 304.

Figures 31, 32, 33, 34, 35, 36, 37:
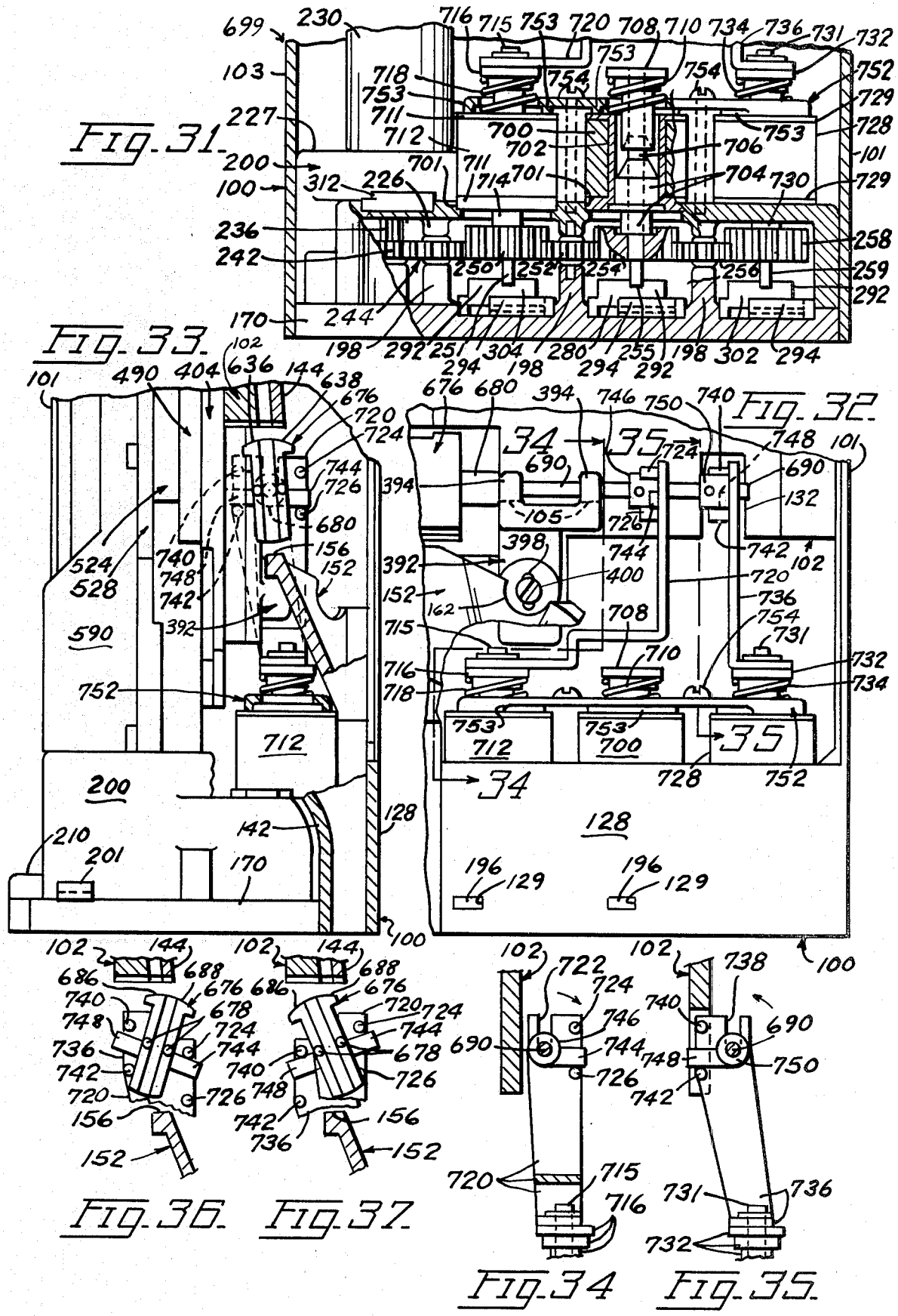
FIG. 31 is a rear view, partly in section and partly in elevation, of an alternate coin-dispensing sub-assembly.
FIG. 32 is a broken-away rear elevational view of the coin-dispensing sub-assembly of FIG. 31 and of a gate operated thereby.
FIG. 33 is a view, which is partially in section and partially in elevation, of the left-hand end of the coin-dispensing sub-assembly of FIG. 31.
FIG. 34 is a sectional view which is taken along the broken plane indicated by the broken line 34—34 in FIG. 32.
FIG. 35 is a sectional view which is taken along the plane indicated by the line 35—35 in FIG. 32.
FIG. 36 is a view of part of the structure shown in FIG. 33, and it shows the gate of that structure in position to direct dollars to a cash box chute.
FIG. 37 is a view of the structure shown in FIG. 36, but it shows the gate in position to direct dollars to the dollar return chute.

A bracket 720 which has a horizontally-directed portion, a short upwardly-directed portion, a second horizontally-directed portion, and an elongated upwardly-directed portion is generally L-shaped with a downwardly-offset foot, as shown by FIG. 32. A short vertically-directed notch 722 is provided in the upper edge of the elongated upwardly-directed portion of bracket 720, as indicated by FIG. 34. Short, cylindrical pins 724 and 726 extend to the left from the left-hand face of the elongated vertically-directed portion of bracket 720, as indicated by FIG. 32. The downwardly-stepped foot of bracket 720 is secured to the shaft 715 so that bracket will move upwardly and downwardly with that shaft but will permit rotation of that shaft relative to it.

The solenoid 728 will be essentially identical to the solenoid 700; but the bobbin thereof is denoted by the numeral 729, the combination guide and stop thereof is denoted by the numeral 730, and the flanged sleeve thereof is denoted by the numeral 732. A shaft 731 is rotatably and slidably guided by the combination guide and stop 730; and it has the sleeve 732 pressed onto the upper end thereof and has the gear 258 pressed into the lower end thereof. A helical compression spring 734 surrounds the upper portion of sleeve 732 to urge gear 258 upwardly to the position shown by FIG. 31. However, that spring can yield, in response to energization of solenoid 728, to permit the pin 259 on gear 258 to be disposed below the level of the upper edge of wall 294 on slide 302. The numeral 736 denotes an L-shaped bracket which has the foot thereof secured to the shaft 731 so that bracket will move upwardly and downwardly with that shaft but will permit that shaft to rotate relative to it. A short vertically-directed notch 738 is formed in the upper edge of bracket 736, as indicated by FIG. 35; and short cylindrical pins 740 and 742 extend to the left from the upper end of bracket 736, as indicated by FIG. 32. The leg of bracket 736 inclines upwardly and to the left from the foot of that bracket. As a result, the pins 740 and 742 on that bracket are disposed to the left of the elongated vertically-directed portion of bracket 720 as indicated particularly by FIGS. 33, 36 and 37.

The numeral 744 denotes a short lever which has a hub 746 that is pinned or otherwise fixedly secured to shaft 690; and the free end of that lever is disposed between, and in register with, the pins 724 and 726 on bracket 720, as shown by FIG. 34. The numeral 748 denotes a short lever which has a hub 750 that is pinned or otherwise fixedly secured to shaft 690; and the free end of that lever is disposed between, and in register with, the pins 740 and 742 on bracket 736, as shown by FIG. 35.

The numeral 752 generally denotes a generally-flat bracket which has three openings therein that are large enough to freely accommodate the helical compression springs 718, 710 and 734. Also, that bracket has generally-annular, downwardly-depending ribs 753 which bear against the upper ends of the bobbins 711, 702 and 729, respectively, of solenoids 712, 700 and 728. Fasteners 754, which are shown as screws, extend downwardly through openings in the bracket 752 to fixedly secure that bracket to the housing 200. Those fasteners and that bracket fixedly secure the solenoids 712, 700 and 728 to housing 200.

Figure 38:
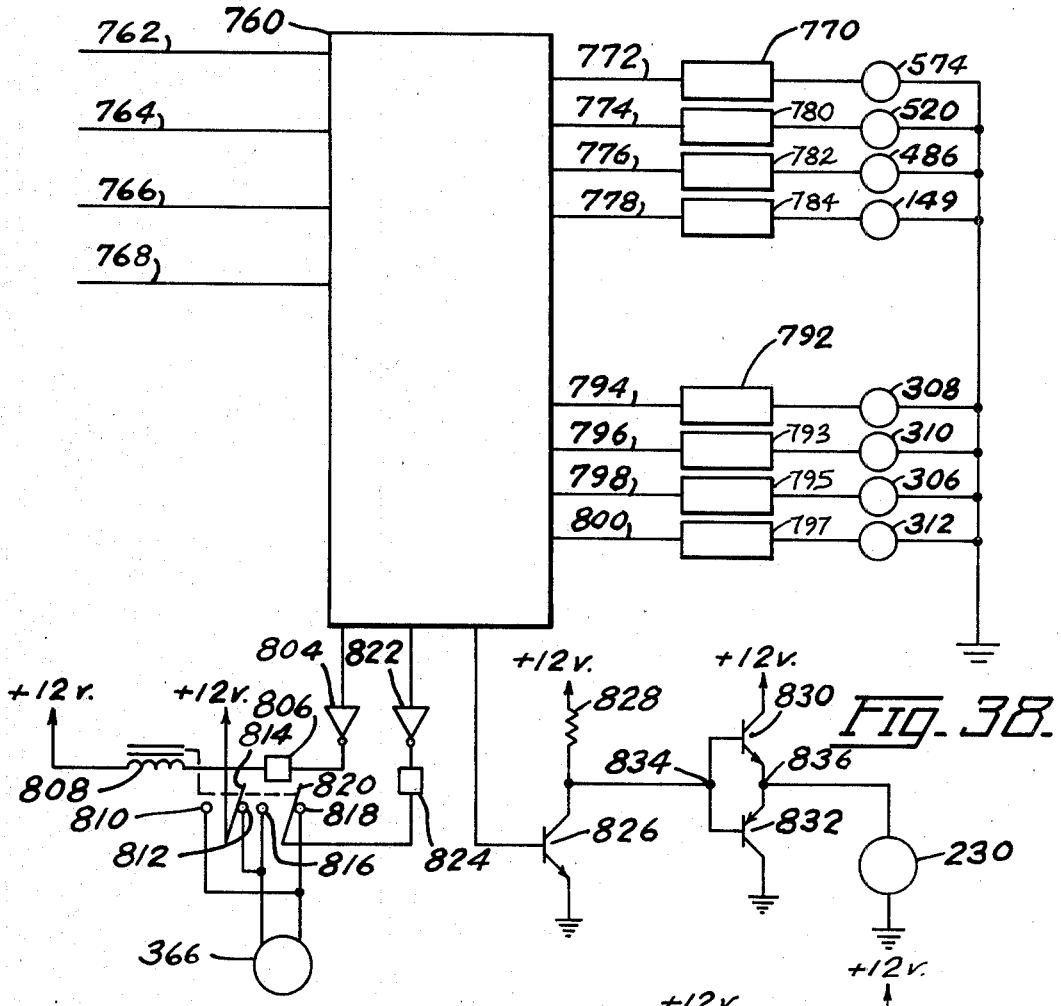
FIG. 38 is a schematic diagram of the circuit of the coin changer of FIGS. 1–30.

FIG. 38 shows a circuit which is used with the coin changer of FIGS. 1–30 whenever that coin changer is equipped with a mechanical-type slug rejector. In FIG. 38, the numeral 760 denotes a microprocessor of standard and usual design; and one such microprocessor is a Fairchild F3870 microprocessor. Four conductors 762, 764, 766 and 768 extend from selection switches, not shown, to I/O ports of that microprocessor. The numerals 770, 780, 782, 784, 792, 793, 795 and 797 denote integrated circuits which are connected, respectively, to conductors 772, 774, 776, 778, 794, 796, 798 and 800 to further I/O ports of microprocessor 760. The coil-type sensors 574, 520, 486, 149, 308, 310, 306 and 312 are connected, respectively, between those integrated circuits and ground. If desired, Siemens TCA 205 proximity switches and the resistors and resonating and integrating capacitors used therewith could be used as the integrated circuits 770, 780, 782, 784, 792, 793, 795 and 797, or Nucleonic Products Company NPC 31 proximity detectors and the resistors and resonating and integrating capacitors used therewith could be used as those integrated circuits. In actual practice, a single custom-made integrated circuit, which performs the functions of the integrated circuits 770, 780, 782 and 784, will be substituted for those four integrated circuits; and another single, custom-made integrated circuit, which performs the functions of the integrated circuits 792, 793, 795 and 797 will be substituted for those four integrated circuits. The integrated circuits 770, 780, 782 and 784 will coact, respectively, with the coil-type sensors 574, 520, 486, and 149 to supply a "bounce-free" signal to the microprocessor 760 whenever a coin moves past one of those coil-type sensors. The integrated circuits 792, 793, 795 and 797 will coact, respectively, with the coil-type sensors 308, 310, 306 and 312 to supply a "bounce-free" signal to the microprocessor 760 whenever a coin is present adjacent coil-type sensor 308, 310, or 306 or the gap between the ends of the piece 248 of iron, or gear 244, is adjacent coil-type sensor 312.

The numeral 804 denotes an inverter which is connected to an I/O port of microprocessor 760; and a driver stage 806 of standard and usual design connects the output of that inverter to a relay coil 808. The other terminal of that coil is connected to a source of positive twelve volts. Movable contacts 814 and 820 are controlled by that relay coil, and they normally are in engagement with stationary contacts 812 and 818, respectively. However, whenever that relay coil is energized, those movable contacts will move into engagement with stationary contacts 810 and 816, respectively. Stationary contacts 810 and 818 are connected together and to one terminal of selector motor 366; and stationary contacts 812 and 816 are connected together and to the other terminal of that motor. Movable contact 814 is connected to the source of positive twelve volts. An inverter 822 is connected to another I/O port of microprocessor 760; and a driver stage 824 of standard and usual design connects the output of that inverter to movable contact 820.

The numeral 826 denotes an NPN transistor which has the emitter thereof grounded and which has the collector thereof connected to the positive source of twelve volts by a resistor 828. The base of that transistor is connected to yet another I/O port of microprocessor 760. The numeral 830 denotes an NPN transistor which has the collector thereof connected to the positive source of twelve volts, and the numeral 832 denotes a PNP transistor which has the collector thereof grounded. A junction 834 connects the collector of transistor 826 to the bases of transistors 830 and 832; and a further junction 836 connects the emitters of transistors 830 and 832 together and to one terminal of the payout motor 230. The other terminal of that motor is connected to ground.

Figure 39:
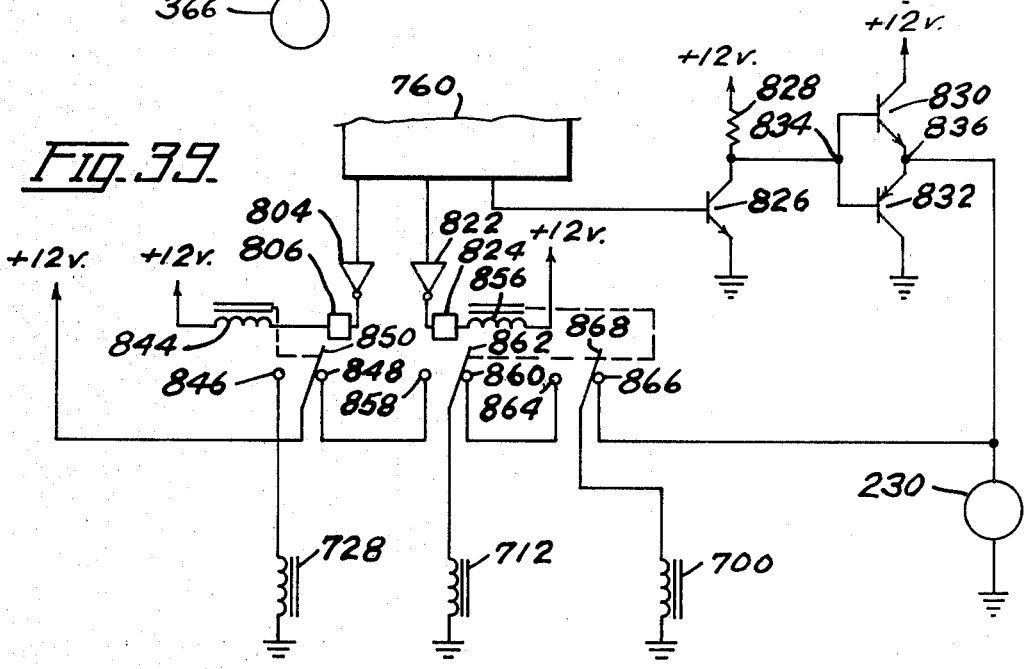
FIG. 39 is a schematic diagram of the lower portion of the schematic diagram in FIG. 38 as it is modified to operate the coin-dispensing sub-assembly of FIGS. 31–37.
Figure 40:
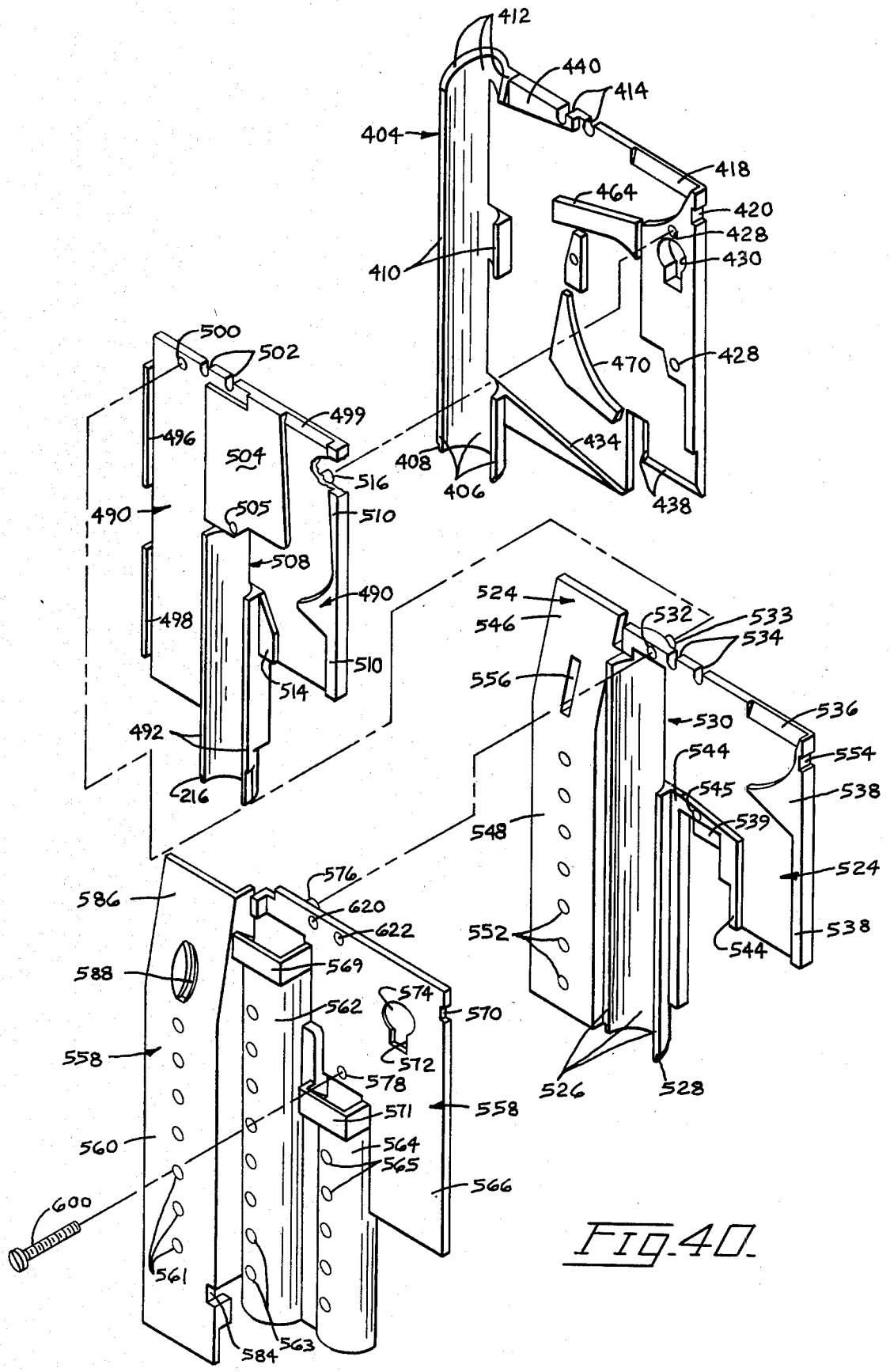
FIG. 40 is an exploded view of the passageway-defining walls of the change-making device.
Figure 41:
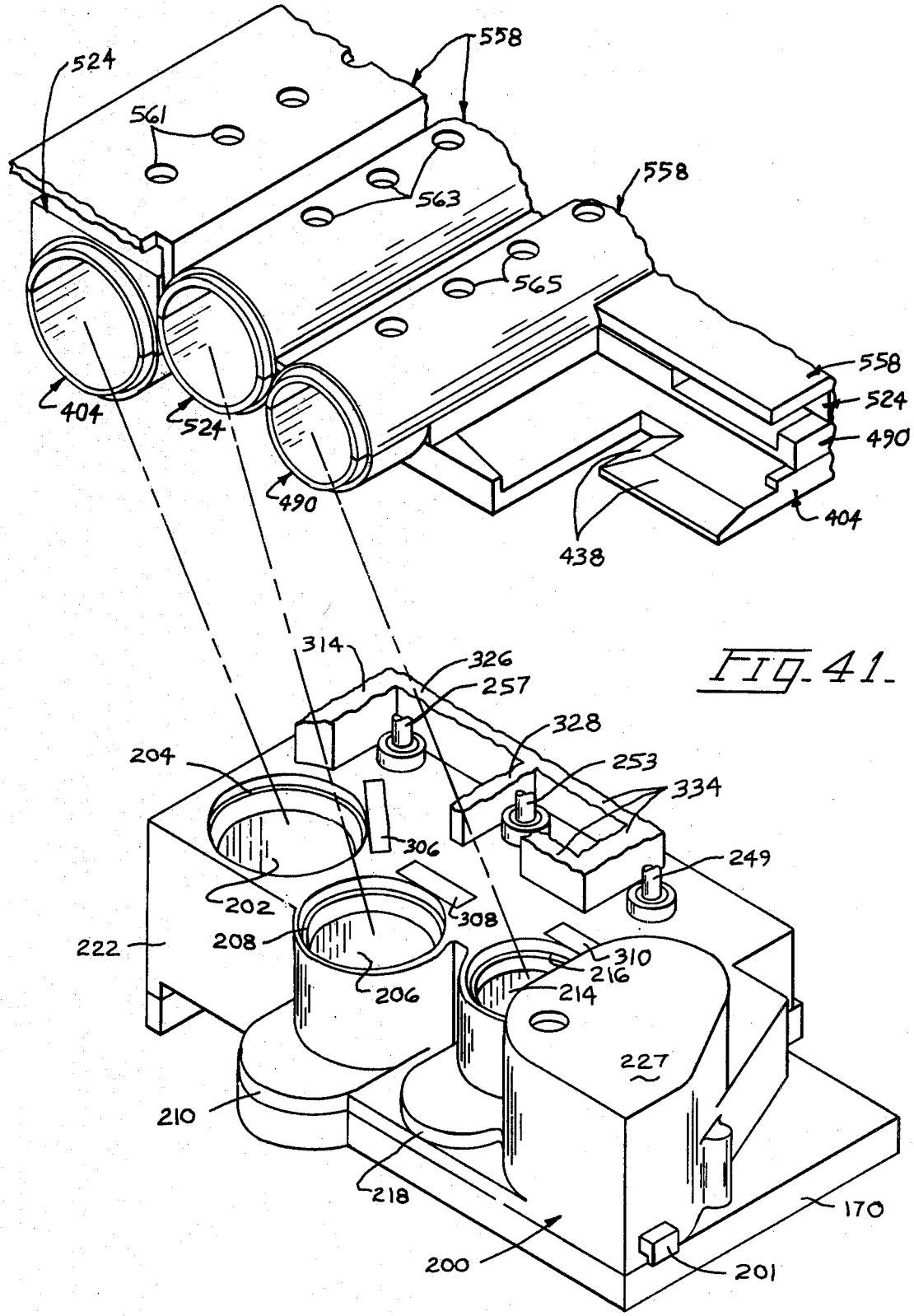
FIG. 41 is an exploded view showing the coin-dispensing sub-assembly of FIGS. 31–37 with the assembled passageway-defining walls thereabove.

FIG. 39 shows a modification of the circuit of FIG. 38 which would be required if the coin changer used the coin-dispensing, sub-assembly 699 of FIGS. 31–37 rather than the coin-dispensing, sub-assembly 168 of FIGS. 1–30. In FIG. 39, the microprocessor 760, the inverters 804 and 822, the driver stages 806 and 824, the transistors 826, 830 and 832, the resistor 828, and the junctions 834 and 836 are identical to the identically-numbered microprocessor, inverters, driver stages, transistors, resistor and junctions of FIG. 38. The output of driver stage 806 is connected to one terminal of a relay coil 844; and the other terminal of that relay coil is connected to the source of positive twelve volts. A movable relay contact 850 normally engages a stationary contact 848, but it will move into engagement with a stationary contact 846 whenever relay coil 844 is energized. Stationary contact 846 is connected to one terminal of the solenoid 728; and the other terminal of that solenoid is connected to ground. The movable contact 850 is connected to the positive source of twelve volts.

The output of driver stage 824 is connected to one terminal of a relay coil 856; and the other terminal of that relay coil is connected to the positive source of twelve volts. Movable relay contacts 862 and 868 normally are in engagement with stationary contacts 860 and 866, respectively; but they will respond to energization of relay coil 856 to move into engagement with stationary contacts 858 and 864. The movable contact 862 is connected to one terminal of solenoid 712; and the other terminal of that solenoid is connected to ground. The movable contact 868 is connected to one terminal of the solenoid 700; and the other terminal of that solenoid is connected to ground. The stationary contacts 860 and 864 are connected together; and the stationary contacts 848 and 858 are connected together.

The junction 836 connects the emitters of transistors 830 and 832 together and to one terminal of the payout motor 230. The stationary contact 866 also is connected to that terminal; and the other terminal of that motor is connected to ground.

The microprocessor 760 in FIG. 38 will normally apply a logic "1" to the base of transistor 826; and hence that transistor will normally be conductive and will apply a logic "0" to the bases of transistors 830 and 832. As a result, transistor 830 will normally be non-conductive because it is back biased, and transistor 832 will normally be non-conductive because it does not have sufficient voltage applied to the emitter thereof. Consequently, the payout motor 230 will normally be de-energized. That microprocessor will normally apply logic "1"s to the inverters 804 and 822; and the driver stages 806 and 824 will respond to the resulting logic "0"s at the inputs thereof to leave relay coil 808 and collector motor 366 de-energized.

The microprocessor 760 in FIG. 39 will normally apply a logic "1" to the base of transistor 826; and hence that transistor will normally be conductive and will apply a logic "0" to the bases of transistors 830 and 832. As a result, transistor 830 will normally be non-conductive because it is back biased, and transistor 832 will normally be non-conductive because it does not have sufficient voltage applied to the emitter thereof. That microprocessor will normally apply logic "1"s to the inverters 804 and 822, and the driver stages 806 and 824 will respond to the resulting logic "0"s at the inputs thereof to leave relay coils 844 and 856 de-energized. Consequently, the payout motor 230 and the solenoids 728, 712 and 700 will normally be de-energized.

Prior to the time a patron presses one of the selection switches, the microprocessor 760 of FIG. 38 will cause coin return electromagnets, not shown, to be energized. As a result, those coin return electromagnets will hold coin-rejecting fingers out of the coin passageways in the slug rejector to enable that slug rejector to accept and sort authentic nickels, dimes, quarters and dollars. Similarly, prior to the time a patron presses one of the selection switches, the microprocessor 760 of FIG. 39 will cause coin return electromagnets, not shown, to be energized. As a result, those coin return electromagnets will hold coin-rejecting fingers out of the coin passageways in the slug rejector to enable that slug rejector to accept and sort authentic nickels, dimes, quarters and dollars.

OPERATION OF COIN CHANGER OF FIGS. 1-30 AND 38

The coin-operated machine, in which the coin changer of the present invention will be mounted, will have a coin slot and a coin chute that will direct all inserted coins to the inlet of the slug rejector which will be mounted within the frame 100 above the level of that coin changer. That slug rejector will reject all slugs and all undesired coins and direct them to the return coin chute 583; and it will sort all authentic coins and direct them to four spaced-apart outlets. The dollar outlet will be in register with the dollar passageway, the quarter outlet will be in register with the quarter passageway, the dime outlet will be in register with the dime passageway, and the nickel outlet will be in register with the nickel passageway.

The first dollar which a patron inserts in any given transaction will pass downwardly through the dollar passageway, enter the passage in gate 376, and come to rest with its rim resting on the abutment 156 at the upper edge of the inclined portion 154 of the dollar return chute 152. A second dollar will pass downwardly through that passageway and come to rest with its rim resting upon the rim of the first-inserted dollar. A third, fourth and fifth dollar will pass downwardly through that passageway and come to rest with their rims resting upon the rims of the next-lower dollars. In this way, the dollar passageway and the gate 376 can escrow all dollars which are inserted during any given transaction. Each dollar will be sensed by the sensor 149; and that sensor and the integrated circuit 784 will apply a signal to microprocessor 760 which will cause that microprocessor to add a dollar value to any value in the coin register of that microprocessor.

Quarters which are introduced during that transaction will be guided to the left by the concave portion 424 of forwardly-extending portion 426 on wall 404 and, depending upon the positions of runway 464 and deflector 470, will be directed toward the upper entrance 442, toward the lower entrance 444, or toward the cash box chute 142. For the purposes of this description, it will be assumed that runway 464 and deflector 470 are set in the dotted-line positions of FIG. 15, and that the level of quarters in the quarter reservoir is below the level of the upper edge of the runway 434. As a result, any inserted quarter will follow the path 468-482 and enter that quarter reservoir.

Whether runway 464 and deflector 470 are set to cause quarters to follow the path 468-482, the path 468-80, the path 466, the path 466-476 or the path 478, each quarter will move close to, and be sensed by, the sensor 486. That sensor and the integrated circuit 782 will apply a signal to microprocessor 760 which will cause the microprocessor to add a quarter value to any value in the coin register of that microprocessor.

Dimes which are introduced during that transaction will be guided to the left by the concave surface of the forwardly-extending portion 510 on wall 490 and will be directed toward the entrance 508 of the dime reservoir along path 506. However, if that dime strikes one of the uppermost dimes in that reservoir, it may rebound toward the cash box chute 142 along the path 512. Each dime will move close to, and be sensed by, the sensor 520; and that sensor and the integrated circuit 780 will apply a signal to microprocessor 760 which will cause that microprocessor to add a dime to any value in the coin register of that microprocessor.

Nickels which are introduced during that transaction will be guided to the left by the concave surface of the forwardly-extending portion 538 on wall 524 and will be directed toward the entrance 530 of the nickel reservoir along path 540. However, if that nickel strikes one of the uppermost nickels in that reservoir, it may rebound toward the cash box chute 142 along the path 542. Each nickel will pass close to, and be sensed by, the sensor 574; and that sensor and the integrated circuit 770 will apply a signal to microprocessor 760 which will cause that microprocessor to add a nickel value to any value in the coin register of that microprocessor.

After the patron has inserted enough money to equal or exceed the price of the desired product, he or she will press a selection switch, not shown, which is connected to one of the conductors 762, 764, 766 or 768. Thereupon, the microprocessor 760 will supply a vend signal to the product-dispensing equipment, not shown, of the machine. Because that equipment is not, per se, a part of the present invention, it will not be described in detail. Also, that microprocessor will provide a signal which will de-energize the coin return electromagnets, and thereby prevent the acceptance of further coins until the desired product is dispensed.

If it is assumed that the patron inserted three dollars, three quarters, one dime and one nickel, and if it further is assumed that the price of the selected product was two dollars and fifty cents, the coin changer would have to dispense a dollar and forty cents as change. After the microprocessor 760 causes the product-dispensing equipment to start dispensing the desired product, it will change the logic "1" at the input of inverter 822 to a logic "0"; and driver stage 824 will respond to the resulting "1" at the input thereof to energize the selector motor 366 in the "run" direction. The consequent rotation of output shaft 367 in the clockwise direction in FIG. 27 will act through gears 372 and 362 to rotate cam shaft 346 in the counter clockwise direction until the abutment 364 on gear 362 engages, and is held by, the right-hand end of slot 322 in block 314. Cam 352 on that cam shaft will permit gear 254 to move pin 255 upwardly out of register with wall 294 on slide 280, cam 354 will cause gear 250 to move pin 251 down into register with wall 294 on slide 304, and pin 360, connecting rod 402, pin 384 and crank arm 382 will rotate gate 376 in the clockwise direction from the position of FIG. 22 to a position wherein it will direct the first-inserted dollar to the cash box chute 142. Although pin 251 on gear 250 will be in register with wall 294 on slide 304, a dime will not be paid out because payout motor 230 will remain de-energized and will not rotate gear 250. The second-inserted dollar will move downwardly as the gate 376 moves out of the position of FIG. 22; but the surface 386 on that gate will intercept that dollar and hold it within the dollar passageway.

The microprocessor will then re-apply logic "1" to the input of inverter 822; and driver stage 824 will respond to the resulting logic "0" at its input to permit selector motor 366 to become de-energized. At this time, the spring 361 will act through abutment 364 to return cam shaft 346 to the position of FIGS. 23-27; and, thereupon, gear 250 and pin 251 will move to their upper positions, gear 254 and pin 255 will move to their lower positions, and gate 376 will return to the position of FIG. 22. As the passage in that gate moves into register with the exit of the dollar passageway, the second-inserted dollar will move down into that gate and rest upon the edge 156 of portion 154 of the dollar return chute 152.

The microprocessor will then re-apply logic "0" to the input of inverter 822; and driver stage 824 again will respond to the resulting logic "1" at its input to again energize the selector motor 366 in the "run" direction. The consequent rotation of output shaft 367 in the clockwise direction in FIG. 27 will again act through gears 372 and 362 to rotate cam shaft 346 in the counter clockwise direction until the abutment 364 on gear 362 engages, and is held by, the righthand end of slot 322 in block 314. Cam 352 on that cam shaft will permit gear 254 to move pin 255 upwardly out of register with wall 294 on slide 280, cam 354 will cause gear 250 to move pin 251 down into register with wall 294 on slide 304, and pin 360, connecting rod 402, pin 384 and crank arm 382 will rotate gate 376 in the clockwise direction from the position of FIG. 22 to a position wherein it will direct the second-inserted dollar to the cash box chute 142. Although pin 251 on gear 250 will be in register with wall 294 on slide 304, a dime will not be paid out because payout motor 230 will remain de-energized and will not rotate gear 250. The third-inserted dollar will move downwardly as the gate 376 moves out of the position of FIG. 22; but the surface 386 on that gate will intercept that dollar and hold it within the dollar passageway.

The microprocessor will then re-apply logic "1" to the input of inverter 822; and driver stage 824 will respond to the resulting logic "0" at its input to permit selector motor 366 to become de-energized. At this time, the spring 361 will act through abutment 364 to return cam shaft 346 to the position of FIGS. 23–27; and, thereupon, gear 250 and pin 251 will move to their upper positions, gear 254 and pin 255 will move to their lower positions, and gate 376 will return to the position of FIG. 22. As the passage in that gate moves into register with the exit of the dollar passageway, the third-inserted dollar will move down into that gate and rest upon the edge 156 of portion 154 of the dollar return chute 152.

The microprocessor will then apply logic "0" to the input of inverter 804 and will re-apply logic "0" to the input of inverter 822. Driver stage 806 will respond to the resulting logic "1" at its input to energize relay coil 808; and hence movable contacts 814 and 820 will shift out of engagement with stationary contacts 812 and 818 and into engagement with stationary contacts 810 and 816. As a result, when driver stage 824 responds to the resulting logic "1" at its input to supply power to selector motor 366, that motor will rotate its output shaft in the counter clockwise direction in FIG. 27 until the abutment 364 on gear 362 engages, and is held by, the left-hand end of slot 322 in block 314. Cam 352 on that cam shaft will permit gear 254 to move pin 255 upwardly out of register with wall 294 on slide 280, cam 350 will cause gear 258 to move pin 259 down into register with wall 294 on slide 302, and pin 360, connecting rod 402, pin 384 and crank arm 382 will rotate gate 376 in the counter clockwise direction from the position of FIG. 22 to a position wherein it will direct the third-inserted dollar to the dollar return chute 152. Although pin 259 on gear 258 will be in register with wall 294 on slide 302, a quarter will not be paid out because payout motor 230 will remain de-energized and will not rotate gear 258. If a fourth-inserted dollar had been held within the gate 376, that dollar would have moved downwardly as the gate 376 moved out of the position of FIG. 22; but the surface 388 on that gate would have intercepted that dollar and held it within the dollar passageway.

The microprocessor will then re-apply logic "1"s to the inputs of inverters 804 and 822; and driver stage 806 will respond to the resulting logic "0" at its input to permit relay coil 808 to become de-energized, and driver stage 824 will respond to the resulting logic "0" at its input to permit selector motor 366 to become de-energized. At this time, the spring 361 will act through abutment 364 to return cam shaft 346 to the position of FIGS. 23–27; and, thereupon, gear 258 and pin 259 will move their upper positions, gear 254 and pin 255 will move to their lower positions, and gate 376 will return to the position of FIG. 22.

In this way, the coin changer will direct the first-inserted dollar to the cash box chute 142, will direct the second-inserted dollar to that cash box chute, and will direct the third-inserted dollar to the dollar return chute 152. Thereafter the microprocessor will initiate the paying out of the lesser value coins; and, in doing so, will re-apply logic "0" to the inputs of inverters 804 and 822 and also will apply a logic "0" to the base of transistor 826. The resulting energization of relay coil 808 by driver stage 806 and the resulting energization of selector motor 366 by driver stage 824 will rotate gate 376 in the counter clockwise direction from the position of FIG. 22, will permit gear 254 to move pin 255 upwardly out of register with the wall 294 on slide 280, and will cause gear 258 to move pin 259 downwardly into register with the wall 294 on slide 302, in the manner described hereinbefore. However, because the gate 376 is empty, the movement of that gate will not be significant at this time. The application of the logic "0" to the base of transistor 826 will render that transistor non-conductive; and the resulting application of logic "1" to the bases of transistors 830 and 832 will forward-bias transistor 830 but will back-bias transistor 832. As transistor 830 becomes conductive, it will energize the payout motor 230; and the consequent rotation of gear 258 will move slide 302 rearwardly to permit the lowermost quarter in the quarter reservoir to move down onto the projection 180 beneath the slide 302 and then will move that slide forwardly to cause that quarter to move into register with the opening 186 in the bottom plate 170. That quarter will then fall downwardly and be directed to the patron.

As the pins 251, 255 and 259, respectively, on the gears 250, 254 and 258 approach the positions shown by FIGS. 28 and 29, the gap in the iron piece 248 atop gear 244 will approach the sensor 312. That sensor will then apply a signal to the integrated circuit 797; and that circuit will apply a corresponding signal via conductor 800 to microprocessor 760. Thereupon, that microprocessor will re-apply a logic "1" to the base of transistor 826 to again render it conductive; and the resulting logic "0"s at the bases of transistors 830 and 832 will again render transistor 830 non-conductive and will again forward-bias transistor 832. The residual energy within the winding of the motor 230 will quickly dissipate through a sub-circuit which includes that winding, ground, and the transistor 832; and hence that motor will quickly come to rest. In this way, the coin changer will direct a quarter to the patron.

Thereafter the microprocessor will re-apply a logic "0" to the input of inverter 822 and a logic "0" to the base of transistor 826. The resulting energization of selector motor 366 by driver stage 824 will rotate gate 376 in the clockwise direction from the position of FIG. 22, will permit gear 254 to move pin 255 upwardly out of register with the wall 294 on slide 280, and will cause gear 250 to move pin 251 downwardly into register with the wall 294 on slide 304, in the manner described hereinbefore. However, because the gate 376 is empty, the movement of that gate will not be significant at this time. The application of the logic "0" to the base of transistor 826 will cause motor 230 to become energized in the manner described hereinbefore; and the consequent rotation of gear 250 will move slide 304 rearwardly to permit the lowermost dime in the dime reservoir to move down onto the projection 180 beneath the slide 304 and then will move that slide forwardly to cause that dime to move into register with the opening 192 in the bottom plate 170. That dime will then fall downwardly and be directed to the left by the deflector 194, and hence to the patron.

As the pins 251, 255 and 259, respectively on the gears 250, 254 and 258 again approach the positions shown by FIGS. 28 and 29, the microprocessor 670 will respond to a signal from sensor 312 and integrated circuit 797 to effect de-energization of selector motor 366 and of motor 230. In this way, the coin changer will direct a dime to the patron.

Thereafter the microprocessor will leave the logic "1"s at the inputs of inverters 804 and 822, and hence will leave cam shaft 346, gears 250, 254 and 258 and gate 376 in their normal positions; but it will re-apply logic "0" to the base of transistor 826. The resulting energization of motor 230 and rotation of gear 254 will move the slide 280 rearwardly to permit the lowermost nickel in the nickel reservoir to move down onto the projection 180 beneath the slide 280, and then will move that slide forwardly to cause that nickel to move into register with the opening 188 in the bottom plate 170. That nickel will then fall downwardly and be directed rearwardly by the deflector 190, and hence to the patron.

As the pins 251, 255 and 259, respectively, on the gears 250, 254 and 258 again approach the positions shown by FIGS. 28 and 29, the microprocessor 670 will respond to a signal from sensor 312 and integrated circuit 797 to effect de-energization of selector motor 366 and of motor 230. In this way, the coin changer will direct the nickel to the patron.

The microprocessor 760 will respond to a timed signal which it will generate, or will respond to a signal from the product-dispensing equipment, to re-set the coin changer and the machine in which it is mounted. As part of the resetting of the coin changer, the coin return electromagnets will be re-energized to permit further coins to be introduced into the slug rejector. During the transaction described hereinbefore, the patron received the desired product, one of the inserted dollars as part of the change, a quarter from the quarter reservoir and a dime from the dime reservoir and a nickel from the nickel reservoir as the rest of the change, two of the inserted dollars were directed to the cash box, and the three inserted quarters, the inserted dime and the inserted nickel were directed, respectively, to the quarter, dime and nickel reservoirs. However, that transaction is merely illustrative of the fact that the coin changer can direct any desired proportion of the inserted dollars to the cash box or to the patron and also can dispense the required number of quarters, dimes and nickels.

If, instead of pressing a selection switch, the patron had pressed the cancel sale switch of the machine, the coin changer would have returned all three of the dollars to that patron on a step-by-step basis. Thereafter, that coin changer would have cycled selector motor 366 and motor 230 three times to dispense quarters from the quarter reservoir, would have cycled those motors an additional time to dispense a dime, and then would have cycled the motor 230 once to dispense a nickel.

OPERATION OF COIN CHANGER OF FIGS. 31–37 AND 39

For the purposes of this description, it will be assumed that the introduction of coins to establish credit, the selection of the desired product, and the development of signals by the microprocessor 760 of the coin changer of FIGS. 31–37 and 39 will be identical to the introduction of coins, the selection of the product, and the development of signals by the microprocessor of the coin changer of FIGS. 1–30 and 38. However, when a logic "0" is applied to the inverter 822 to effect the directing of the first-inserted dollar to the cash box chute 142, that inverter and driver stage 824 will energize relay coil 856. The resulting shifting of the movable contacts 862 and 868 out of engagement with stationary contacts 860 and 866 and into engagement with stationary contacts 858 and 864 will keep the solenoid 700 from becoming energized but will cause solenoid 712 to become energized. The latter solenoid will act through the bracket 720, the pin 724, the lever 744 and the shaft 690 to rotate the gate 676 to the position of FIG. 36; and it also will move the gear 250 downwardly to dispose the pin 251 in register with the wall 294 of slide 304. The spacing between the pins 740 and 742 on the bracket 736 is great enough to permit the gate 676 to rotate to the position of FIG. 36 without causing lever 748 to engage pin 740. As a result, the downward movement of bracket 720 will cause the gate 676 to direct the first-inserted dollar to the cash box 142 without affecting the position of bracket 736 or the shaft 731. The signal which is applied to the transistor 826 in FIG. 39 will continue to be a logic "1", and hence that transistor will continue to remain energized. The continued logic "0" at the bases of transistors 830 and 832 will cause the transistor 830 to continue to be non-conductive and hence leave the motor 230 de-energized. All of this means that the coin changer of FIGS. 30–31 and 39, like the coin changer of FIGS. 1–30 and 38, can direct a dollar to the cash box chute 142 without dispensing any lesser-denomination coins.

When the microprocessor 760 again supplies logic "1" to the inverter 822 of FIG. 39, the driver stage 824 will permit the relay coil 856 to be de-energized; and thereupon the returning spring 718 of the solenoid 712 will move the pin 726 upwardly into engagement with the lever 744 to rotate the gate 676 to the position shown by FIG. 33. In that position, the pin 742 on bracket 736 will abut the lever 748; and hence the gate 676 will be held in the position of FIG. 33 by pins 726 and 742 and levers 744 and 748.

The second-inserted dollar also will be directed to the cash box chute 142; and the pin 251 will again be moved downwardly into register with the wall 294 of the slide 304, but a dime will not be paid out because the motor 230 will continue to remain de-energized. After the second-inserted dollar has been directed to the cash box chute 142, the pins 726 and 742, respectively, on the brackets 720 and 736 will again hold the gate 676 in the position of FIG. 33.

The third-inserted dollar will be directed to the coin return chute 152 by the energization of relay coils 844 and 856. Specifically, the logic "0"s at the inputs of inverters 804 and 822 of FIG. 39 will cause the driver stages 806 and 824 to energize those relay coils; and the movable contacts 850, 862 and 868 will shift out of engagement with stationary contacts 848, 860 and 866 and into engagement with stationary contacts 846, 858 and 864. Thereupon, the solenoid 728 will become energized, but the solenoids 712 and 700 will remain de-energized. Also, motor 230 will remain de-energized. The resulting downward movement of the bracket 736 will cause the pin 740 to engage the lever 748 and rotate the gate 676 from the position of FIG. 33 to the position of FIG. 37. The spacing between the pins 724 and 726 on the bracket 720 is great enough to permit the gate 676 to rotate to the position of FIG. 37 without causing lever 744 to engage the pin 724. As a result, the downward movement of bracket 736 will cause the gate 676 to direct the third-inserted dollar toward the dollar return chute 152 without affecting the position of bracket 720 or the shaft 715. The pin 259 on gear 258 will be moved downwardly into register with the wall 294 of slide 302; but no quarters will be dispensed because the motor 230 will remain de-energized. All of this means that the coin changer of FIGS. 30–31 and 39, like the coin changer of FIGS. 1–30 and 38, can direct a dollar to the dollar return chute 152 without dispensing any lesser-denomination coins.

When the microprocessor 760 again supplies logic "1"s to the inverters 804 and 822 of FIG. 39, the driver stages 806 and 824 will permit the relay coils 844 and 856 to be de-energized; and thereupon the returning spring 734 of the solenoid 728 will move the pin 742 upwardly into engagement with the lever 748 and rotate the gate 676 to the position shown by FIG. 33. In that position, the pin 726 on bracket 720 will abut the lever 744; and hence the gate 676 will be held in the position of FIG. 33 by pins 726 and 742 and levers 744 and 748.

When a quarter is to be dispensed by the coin changer of FIGS. 31–37 and 39, the microporcessor 760 will apply logic "0"s to inverters 804 and 822 and also to the base of transistor 826. The resulting energization of relay coils 844 and 856 will shift the movable contacts 850, 862 and 868 out of engagement with stationary contacts 848, 860 and 866 and into engagement with stationary contacts 846, 858 and 864. Thereupon, current will flow from the positive twelve volts via movable contact 850, stationary contact 846 and solenoid 728 to ground. The resulting downward movement of pin 259 on gear 258 into register with the wall 294 on slide 302 will enable the energization of motor 230 to cause that slide to be moved rearwardly and permit the lowermost quarter in the quarter reservoir to move downwardly onto the projection 180 below that slide. Thereafter that motor will move the slide 302 forwardly to cause that quarter to fall downwardly through the opening 186 in the bottom plate 170.

The gate 676 will again be shifted to the position of FIG. 37; but because that gate and the dollar passageway are devoid of dollars, that movement will not be significant at this time. The movement of relay contact 862 into engagement with stationary contact 858, as relay coil 856 becomes energized, will not energize solenoid 712, because relay contact 850 was moved out of engagement with stationary contact 848 by the energization of relay coil 844. The movement of relay contact 868 out of engagement with stationary contact 866, as relay coil 856 becomes energized, will keep solenoid 700 de-energized. As a result, only a quarter will be dispensed.

To dispense a dime, the microprocessor 760 will apply logic "0" to inverter 822, and also to the base of transistor 826. The resulting energization of relay coil 856 will shift the movable contact 868 away from the stationary contact 866 to keep solenoid 700 de-energized, and will shift the movable contact 862 into engagement with the stationary contact 858. Thereupon, current will flow from the positive twelve volts via movable contact 850, stationary contact 848, stationary contact 858, movable contact 862 and solenoid 712 to ground. The resulting downward movement of pin 251 on gear 250 into register with the wall 294 on slide 304 will enable the energization of motor 230 to cause that slide to be moved rearwardly and permit the lowermost dime in the dime reservoir to move downwardly onto the projection 180 below that slide. Thereafter that motor will move the slide 304 forwardly to cause that dime to fail downwardly through the opening 192 and engage, and be deflected by, the deflector 194.

When a nickel is to be dispensed, the microprocessor 760 will continue to apply logic "1"s to inverters 804 and 822, but will apply a logic "0" to the base of transistor 826. As a result, relay coils 844 and 856 will remain de-energized; and hence movable contact 868 will continue to engage stationary contact 866. The rendering of transistor 830 conductive will simultaneously energize motor 230 and solenoid 700; and hence the pin 255 on gear 254 will move slide 280 rearwardly to permit the lowermost nickel in the nickel reservoir to move downwardly onto the projection 180 below that slide. Thereafter that motor will move the slide 280 forwardly to cause that nickel to fall downwardly through the opening 188 and engage deflector 190 to be directed to the patron. The gate 676 will remain in the position of FIG. 33, and the solenoids 728 and 712 will remain de-energized. Consequently, only a nickel will be dispensed.

It should be apparent from the foregoing description that the substitution of the coin-dispensing sub-assembly 699 of FIGS. 31–37 for the coin-dispensing sub-assembly 168 of FIGS. 1–30 does not require any change in the microprocessor 670, in the inputs to that microprocessor, in the inverters 804 and 822, in the driver stages 806 and 824, or in the transistors 826, 830 and 832. Further, insofar as patrons are concerned, the operation of the coin changer of FIGS. 31–37 and 39 will be identical to the operation of the coin changer on FIGS. 1–30 and 38.

If an electronic slug rejector, rather than a mechanical-type slug rejector, were to be used with the coin changer of FIGS. 1–30 and 38 or the coin changer of FIGS. 31–37 and 39, the conductors 772, 774, 776 and 778 would be connected directly to the electronic slug rejector rather than to the integrated circuits 770, 780, 782 and 784. That slug rejector would apply signals to the conductors 772, 774, 776 and 778 which would represent the insertion and acceptance of nickels, dimes, quarters and dollars and which were bounce-free. As a result, integrated circuits would not be needed for those signals.

However, the electronic slug rejector would have a switch or a coil thereon which would develop a signal whenever the scavenging gate of that electronic slug rejector was not in its normal, closed position. That signal would pass through an integrated circuit similar to the integrated circuit 770 and be applied to a further I/O port of the microprocessor 760. Whenever that switch or coil was applying that signal to that I/O port via that integrated circuit, the coin changer would be unable to accept coins; because the coin return electromagnets would be de-energized, and the fingers thereon would be in position to block the introduction of coins into the slug rejector.

All other components and connections of FIG. 38 would remain unchanged if an electronic slug rejector, rather than a mechanical-type slug rejector, were to be used with the coin changer of FIGS. 1–30 and 38. Also the operation of the coin changer would be essentially identical to the hereinbefore-described operation of the coin changer of FIGS. 1–30 and 38. Similarly, all other components and connections of FIG. 39 would remain unchanged if an electronic slug rejector, rather than a mechanical-type slug rejector, were to be used with the coin changer of FIGS. 31–37 and 39. Also, the operation of the coin changer would be essentially identical to the hereinbefore-described operation of the coin changer of FIGS. 31–37 and 39.

In the preceding description, it was assumed that the patron had inserted three dollars; and hence the gate 676 had to be repeatedly shifted out of the position of FIG. 33 to direct those dollars to the desired chutes. However, in any transaction where the patron does not insert any dollars, the microprocessor 760 will not apply a logic "0" to either or both of the inverters 804 and 822 without also applying a logic "0" to the base of transistor 826. Consequently, where no dollars are inserted, the coin changer of FIGS. 1–30 and 38 or of FIGS. 31–37 and 39 would initiate prompt dispensing of any quarters, dimes and nickels which were to be dispensed.

In the foregoing description, it was assumed that the quarter reservoir, the dime reservoir and the nickel reservoir had sufficient coins therein to keep the sensors 306, 310 and 308 from supplying empty signals to the microprocessor 760 via the integrated circuits 792, 793 and 795. In the event the supply of quarters in the quarter reservoir became depleted, the sensor 306 and integrated circuit 795 would supply a signal to microprocessor 760 which would enable the program for that microprocessor to call for the dispensing of dimes or nickels, rather than quarters, as change. In the event the supply of dimes in the dime reservoir became depleted, the sensor 310 and integrated circuit 793 would supply a signal to microprocessor 760 which would enable the program for that microprocessor to call for the dispensing of nickels, rather than dimes, as change. In the event the supply of nickels in the nickel reservoir became depleted, the sensor 308 and integrated circuit 792 would supply a signal to microprocessor 760 which would enable the program for that microprocessor to prevent the vending of any product where the difference between the inserted money and the price of the desired product required the dispensing of a nickel as change. Similarly, where the depletion of the supply of any other coin made it impossible to pay out the proper amount of change for any proposed transaction, the sensor adjacent the reservoir for that coin would supply a signal to microprocessor 760 which would enable the program for that microprocessor to prevent the vending of the product sought by the patron.

The positioning surfaces on the walls 404, 490, 524 and 558 and the complementary surfaces on median wall 102 and on walls 404, 490 and 524 are displaced from the side walls 101 and 103 of frame 100. As a result, the assembler of the coin changer does not have to tilt any of the walls 404, 490, 524 and 558 relative to any of those side walls to fit a positioning surface on any of those walls into a complementary surface in either of those side walls. Instead, the assembler can dispose the reduced-thickness lower ends of the cylindrical sections of those walls within the annular grooves 204, 208 and 216 at the upper ends of the openings 202, 206 and 214 of housing 200, and then move those walls into parallelism with the next-rearward walls. As a result, installation of the walls 404, 490, 524 and 558 is direct, simple and easy.

Each of the walls 404, 490, 524 and 558 has a positioning surface adjacent the upper edge thereof in the form of a pin, has a positioning surface adjacent the lower edge thereof in the form of a reduced-thickness bottom edge for a semi-cylindrical section, and has an intermediate opening for the elongated screw 600. As a result, each of those walls has three spaced points of support.

Because the slot 588 is in the inclined portion 586, rather than in the vertically-directed planar section 560, of wall 558, the center of mass of a quarter which is about to enter that slot is closer to the axis of the quarter reservoir than it would if that slot had been in the section 560. This is desirable; because the force of gravity will assist the serviceman in causing quarters to pass successively through slot 588, coin return passageway 583, and slot 556 in the inclined portion 546 of wall 524. Also, it is desirable because a serviceman can move a quarter closer to the axis of the quarter reservoir before he has to release it than he could if the slot 588 had been located in the planar section 560.

The coin-dispensing sub-assembly 168 of FIGS. 1–30 and the coin-dispensing sub-assembly 699 of FIGS. 31–37 utilize idler gears 252 and 256 to cause the gears 250, 254 and 258 to rotate in the same direction and at the same speed and to keep all of the pins 251, 255 and 259 in the same relative positions. If desired, however, sprocket chains could be used instead of idler gears. Also, if desired, a rack which engaged all of the gears 250, 254 and 258 could be used instead of idler gears.

The selector motor 366 is desirable and useful. However, if desired, that selector motor could be replaced by two solenoids. One of those solenoids would rotate the cam shaft 346 from the position of FIGS. 23–27 to a position in which the cam 350 was downwardly directed. The other of the solenoids would rotate that cam shaft in the opposite direction to cause the cam 354 to be downwardly directed. As a result, it should be apparent that various forms of electrodynamic elements can be used to operate the cam shaft 346.

If desired, the cam shaft 346 could be replaced by three solenoids which had the plungers thereof disposed in alignment with the caps 274, 276 and 278. In such event, the gears 258, 254 and 250 could be selectively moved downwardly to, and held in, their lower positions by selective actuation of those solenoids.

The cam shaft 346 is shown equipped with three cams; and those cams are used to control the dispensing of coins from each of the three coin reservoirs. In the event just two coin reservoirs were to be provided for the coin changer, only two cams would be required on the cam shaft 346. Those cams could be identical to the cams 350 and 354 shown in the drawing; and, in that event, the cam shaft could effect dispensing coins of one denomination when it was in its clockwise position and could effect the dispensing of coins of the second denomination when it was in its counter clockwise position. In the event the cam shaft 346 were to be used to control the dispensing of just two different denominations, and in the further event that it was to be used to effect the dispensing of one or two coins at a time, the cam 352 could be made so it would hold the gear 254 down in the normal and counter clockwise positions of the cam shaft 346 and the cam 354 could be made so it would hold the gear 250 down in both the clockwise and counter clockwise positions of that cam shaft. In such event, the cam shaft 346 could effect the paying out of a nickel by being left in its middle position, could effect the paying out of a dime by being rotated to its clockwise position, and could effect the paying out of a nickel and a dime by being rotated to its counter clockwise position.

The pin 360 on cam shaft 346 and the connecting rod 402 are very useful where the coin changer is equipped with the gate 376; because that pin, connecting rod and gate enable that coin changer to receive four different denominations of coins. However, in the event that coin changer were to be made to accept only three different denominations of coins, that gate would not be needed; and hence connecting rod 402 would not be used. In that event, the coin changer would selectively dispense only nickels, dimes and quarters.

Similarly, the brackets 720 and 736 of the coin-dispensing sub-assembly 699 of FIGS. 31–37 are useful where the coin changer is required to receive four different denominations of coins. However, in the event the coin changer were to be made to receive just three denominations of coins, the brackets 720 and 736 and the gate 676 would be deleted.

The gears 250, 254 and 258 of FIGS. 1–30 are secured to and rotate with the shafts 249, 253 and 257, respectively. Similarly, the gears 250, 254 and 258 of FIGS. 31–37 are fixedly secured to the shafts 715, 706 and 731, respectively. Such an arrangement is very desirable; but it would be possible to mount those gears on axially-movable pivots. As a result, it should be understood that where the word shafts is used in connection with the gears 250, 254 and 258, either in this description or in the appended claims, it is intended to comprehend pivots as well as shafts.

As indicated particularly by FIGS. 2 and 15, the right-hand portion of the forward surface of wall 404 and the right-hand portion of the rear surface of wall 490 define a space which extends from the upper edge of the runway 424 to the right-hand edge of the forwardly-extending portion 440. As a result, the length of that space is almost twice the length of the chamfer 418. However, the quarter exit of the slug rejector will have a length which approximates that of chamfer 418; and hence quarters which enter the space between walls 404 and 490 will move close to the chamfer 418 and then move into engagement with the runway 424. That runway and the runway 464 are visible in FIG. 2.

Similarly, the space between the right-hand portion of the forward surface of wall 524 and the right-hand portion of the rear surface of wall 558 is open from the upper end of the forwardly-extending portion 538 to the left-hand portion of the semi-cylindrical section 526. As a result, the length of that space is several times longer than the length of the chamfer 536. However, the slug rejector will cause nickels to pass close to the chamfer 536 and engage the concave portion of the forwardly-extending portion 538. That forwardly-extending portion and the forwardly-extending portion 544 of the wall 524 are visible in FIG. 2.

In contrast, the space which is defined by the forward surface of wall 144 and by the corresponding portion of the rear surface of median wall 102 has a length which is just slightly larger than the diameter of a dollar. Similarly, the right-hand portion of the space which is defined by the forward surface of the wall 490 and by the right-hand portion of the rear surface of the wall 524 has a diameter which is only slightly larger than that of a dime.

As indicated by FIGS. 2 and 22, small chamfers are provided at the upper surfaces of wall 144 and of the corresponding portion of median wall 102. Those chamfers facilitate the entry into the dollar passageway of dollars which exit from the slug rejector. The chamfer 418 in FIGS. 2 and 15 facilitates the entry of quarters into the quarter passageway, the chamfer 499 in FIG. 12 facilitates the entry of dimes into the dime passageway, and the chamfers 536 and 568 in FIG. 2 facilitate the entry of nickels into the nickel passageway.

The inclined portion 586 of the planar section 560 on the wall 558 is close to the forward surface of the section 548 of the wall 524. The slot 588 in that inclined portion is narrower than the slot 556 in the section 548, but it is aligned with that slot. The alignment of those slots, the narrow width of slot 588, and the proximity of those slots to each other will impede any effort to cause a quarter to pass through the slot 588 and then turn and pass downwardly through the coin return chute 583 rather than pass through that coin return passageway to enter the slot 556.

Although different forms of coil-type sensors could be used as sensors 149, 306, 308, 310, 312, 486, 520 and 574, E-type ferrite cores with subsequently-introduced windings are preferred. After those windings are introduced into those cores, thin closures of plastic or other non-magnetic material will be used to seal and complete the coil-type sensors.

In the foregoing description, the coin changers were assumed to have been programmed to dispense all quarters before any dimes were dispensed and to dispense all dimes before any nickles were dispensed. However, if desired, those coin changers could be programmed to dispense the nickels, dimes and quarters in any desired sequence after the inserted dollars have been directed to the cash box chute 142 or to the dollar return chute 152.

Attached hereto and made a part hereof is the program which provides the hereinbefore-described operation of the coin changer of FIGS. 1–30 and 38.

Whereas the drawing and accompanying description have shown and described a preferred embodiment and an alternate embodiment of the present invention, it should be apparent to those skilled in the art that various changes may be made in the form of the invention without affecting the scope thereof.

What I claim is:

1. A coin-handling device which can accommodate coins of a plurality of different denominations and which comprises a frame, a first wall which has a positioning surface thereon that interacts with a complementary surface on said frame to just partially restrain and position said first wall, a second wall which has a positioning surface thereon that interacts with a complementary surface on said first wall to just partially restrain and position said second wall, said second wall having a further surface thereof disposed in confronting, but spaced, relation with a further surface on said first wall to define a passageway for coins of one denomination whenever said positioning surface on said second wall and said complementary surface on said first wall interact to just partially restrain and position said second wall, a third wall which has a positioning surface thereon that interacts with a complementary surface on said second wall to just partially restrain and position said third wall, said third wall having a further surface thereof disposed in confronting, but spaced, relation with a still further surface on said second wall to define a passageway for coins of a second denomination whenever said positioning surface on said third wall and said complementary surface on said second wall interact to partially restrain and position said third wall, one of said walls having an additional surface thereon which defines, and constitutes, part of a reservoir for coins that receives coins passing through the passageway which said one wall helps define, another of said walls having an additional surface thereon which defines, and constitutes, another part of said reservoir for coins and said additional surface on said one wall and said additional surface on said other wall being in confronting relation and coacting effectively to define said reservoir for coins, said additional surface on said one wall and said additional surface on said other wall being aligned to define said reservoir for coins whenever said positioning surface on said first wall interacts with said complementary surface on said frame to just partially restrain and position said first wall and said positioning surface on said second wall interacts with said complementary surface on said first wall to just partially restrain and position said second wall and said positioning surface on said third wall interacts with said complementary surface on said second wall to just partially restrain and position said third wall, said additional surface on said one wall being displaced laterally relative to the further surface on said one wall and said additional surface on said other wall being displaced laterally relative to the further surface on said other wall, whereby coins moving through said passageway which said one wall helps to define will move laterally as they pass from said passageway into said reservoir for coins, and a single fastener which extends through all of said walls and engages said frame to coact with said positioning surfaces on said walls and said complementary surface on said frame to fixedly hold said walls in position relative to said frame, said fastener being readily securable to said frame to provide prompt securement of all of said walls to said frame and maintain alignment of said additional surfaces on said one and said other walls, said frame having a side wall, said positioning and complementary surfaces on said walls and frame being displaced from said side wall, and said fastener being displaced from said side wall, said additional surface and the passageway-defining surface on said one wall being molded as a unit so any coin passing said reservoir for coins does not have to pass a joint between discrete parts of said coin-handling device, whereby coins can freely pass through said passageway toward said reservoir for coins with no risk of being intercepted and stopped by such a joint.

2. A coin-handling device which can accommodate coins of a plurality of different denominations and which comprises a frame, a first wall which has a positioning surface thereon that interacts with a complementary surface on said frame to just partially restrain and position said first wall, a second wall which has a positioning surface thereon that interacts with a complementary surface on said first wall to just partially restrain and position said second wall, said second wall having a further surface thereof disposed in confronting, but spaced, relation with a further surface on said first wall to define a passageway for coins of one denomination whenever said positioning surface on said second wall and said complementary surface on said first wall interact to just partially restrain and position said second wall, a third wall which has a positioning surface thereon that interacts with a complementary surface on said second wall to just partially restrain and position said third wall, one of said walls having an additional surface thereon which defines, and constitutes, part of a reservoir for coins that receives coins passing through the passageway which said one wall helps define, another of said walls having an additional surface thereon which defines, and constitutes, another part of said reservoir for coins, said additional surface on said one wall and said additional surface on said other wall being in confronting relation and coacting effectively to define said reservoir for coins, said additional surface on said one wall and said additional surface on said other wall being aligned to define said reservoir for coins whenever said positioning surface on said first wall interacts with said complementary surface on said frame to just partially restrain and position said first wall and said positioning surface on said second wall interacts with said complementary surface on said first wall to just partially restrain and position said second wall and said positioning surface on said third wall interacts with said complementary surface on said second wall to just partially restrain and position said third wall, said additional surface on said one wall being displaced laterally relative to the further surface on said one wall and said additional surface on said other wall being displaced laterally relative to the further surface on said other wall, whereby coins moving through said passageway which said one wall helps to define will move laterally as they pass from the passageway into said reservoir for coins, said third wall having a further surface thereof disposed in confronting, but spaced, relation with a still further surface on said second wall to define a passageway for coins of a second denomination whenever said positioning surface on said third wall and said complementary surface on said second wall interact to partially restrain and position said third wall, and a single fastener which extends through all of said walls and engages said frame to coact with said positioning surfaces on said walls and said complementary surface on said frame to fixedly hold said walls in position relative to said frame, said fastener being readily securable to said frame to provide prompt securement of all of said walls to said frame and maintain alignment of said additional surfaces on said one and said other walls, a sub-assembly which serves as a bottom for said frame, said walls having further positioning surfaces that interact with complementary surfaces on said sub-assembly to just partially restrain and position the lower portions of said walls, said sub-assembly having openings therein which define the lower ends of coin reservoirs and which also constitute portions of said complementary surfaces on said sub-assembly, and said further positioning surfaces on said walls constituting portions of said coin reservoirs, said additional surface and the passageway-defining surface on said one wall being molded as a unit so any coin passing said reservoir for coins does not have to pass a joint between discrete parts of said coin-handling device, whereby coins can freely pass through said passageway toward said reservoir for coins with no risk of being intercepted and stopped by such a joint.

3. A coin handling device which has a coin reservoir into which coins are introduced and from which coins are dispensed and which comprises a wall that defines a cylindrical recess which defines said coin reservoir and which is dimensioned to receive coins and to permit said coins to lie in generally-horizontal positions in face-to-face contact, a dispensing mechanism adjacent the bottom of said wall which is selectively actuatable to dispense coins from said coin reservoir, a coin passageway leading to said coin reservoir, a first entrance into said coin reservoir adjacent the upper end of said wall, a second entrance into said coin reservoir below the level of said first entrance, a first coin-directing means in said coin passageway which directs coins that have a predetermined minimum velocity toward said first entrance, a second coin-directing means in said coin passageway which is disposed below the level of said first coin-directing means and also is disposed below the level of said first entrance and which can receive coins that have a velocity which is substantially different from said predetermined minimum velocity, said second coin-directing means guiding coins which have said substantially-different velocity toward said second entrance.

4. A coin handling device as claimed in claim 3 wherein said first coin-directing means is located above the level of the bottom of said first entrance, and wherein said second coin-directing means is located below the level of the bottom of said first entrance but is located above the level of the bottom of said second entrance.

5. A coin handling device as claimed in claim 3 wherein a further coin-directing means will guide coins which attempt to but cannot enter said first entrance to an outlet which is connectable to a cash box, and wherein said coin-directing means will guide coins which attempt to but cannot enter said second entrance to said outlet.

6. A coin handling device which can receive coins, temporarily hold said coins, and then, selectively, on a coin-by-coin basis return said coins to a patron or on a coin-by-coin basis direct said coins to a cash box and which comprises a coin passageway, a gate which receives coins moving in said coin passageway, said gate acting in one position thereof to hold a coin therein, said gate acting in a second position thereof to direct said coin to an outlet which can guide said coin to said patron, said gate acting in a third position thereof to direct said coin to a second outlet which can guide said coin to said cash box, said coin passageway being adapted to hold a further coin therein if said gate is in said one position and is holding a coin therein, said coin passageway and said gate being adapted to hold said further coin in said coin passageway while said gate is in said second or said third position, said gate automatically permitting said further coin to pass from said coin passageway into said gate whenever said gate moves from said second position to said one position or moves from said third position to said one position, and means to selectively move said gate into said one, said second or said third position.

7. A coin handling device which can receive coins, temporarily hold said coins, and then, selectively, on a coin-by-coin basis return said coins to a patron or on a coin-by-coin basis direct said coins to a cash box and which comprises a coin passageway, a gate which receives coins moving in said coin passageway, said gate acting in one position thereof to hold a coin therein, said gate acting in a second position thereof to direct said coin to an outlet which can guide said coin to said patron, said gate acting in a third position thereof to direct said coin to a second outlet which can guide said coin to said cash box, said coin passageway being adapted to hold a further coin therein if said gate is in said one position and is holding a coin therein, said coin passageway and said gate being adapted to hold said further coin in said coin passageway while said gate is in said second or said third position, said gate automatically permitting said further coin to pass from said coin passageway into said gate whenever said gate moves from said second position to said one position or moves from said third position to said one position, means to selectively move said gate into said one, said second or said third position, and a wall that is disposed below said gate and that has an upper edge which intercepts and supports coins in said gate whenever said gate is in said one position, said gate directing any coin therein to one side of said wall whenever said gate is moved to said second position, and said gate directing any coin therein to the opposite side of said wall whenever said gate is moved to said third position.

8. A coin handling device which can receive coins, temporarily hold said coins, and then, selectively, on a coin-by-coin basis return said coins to a patron or on a coin-by-coin basis direct said coins to a cash box and which comprises a coin passageway, a gate which receives coins moving in said coin passageway, said gate acting in one position thereof to hold a coin therein, said gate acting in a second position thereof to direct said coin to an outlet which can guide said coin to said patron, said gate acting in a third position thereof to direct said coin to a second outlet which can guide said coin to said cash box, said coin passageway being adapted to hold a further coin therein if said gate is in said one position and is holding a coin therein, said coin passageway and said gate being adapted to hold said further coin in said coin passageway while said gate is in said second or said third position, said gate automatically permitting said further coin to pass from said coin passageway into said gate whenever said gate moves from said second position to said one position or moves from said third position to said one position, means to selectively move said gate into said one, said second or said third position, said gate having an entrance which is in register with said coin passageway whenever said gate is in said one position, said gate having a coin-supporting surface adjacent said entrance which is in register with said coin passageway whenever said gate is in said second position, and said gate having a further coin-supporting surface adjacent said entrance which is in register with said coin passageway whenever said gate is in said third position.

9. A coin handling device which can receive coins, temporarily hold said coins, and then, selectively, on a coin-by-coin basis return said coins to a patron or on a coin-by-coin basis direct said coins to a cash box and which comprises a coin passageway, a gate which receives coins moving in said coin passageway, said gate acting in one position thereof to hold a coin therein, said gate acting in a second position thereof to direct said coin to an outlet which can guide said coin to said patron, said gate acting in a third position thereof to direct said coin to a second outlet which can guide said coin to said cash box, said coin passageway being adapted to hold a further coin therein if said gate is in said one position and is holding a coin therein, said coin passageway and said gate being adapted to hold said further coin in said coin passageway while said gate is in said second or said third position, said gate automatically permitting said further coin to pass from said coin passageway into said gate whenever said gate moves from said second position to said one position or moves from said third position to said one position, means to selectively move said gate into said one, said second or said third position, said gate having an entrance, and said gate being dimensioned so the entrance thereof is disposed below the level of the upper edge of said coin whenever said gate is in said one position.

10. A coin handling device which can receive coins, temporarily hold said coins, and then on a coin-by-coin basis direct said coins to a desired outlet and which comprises a coin passageway, a gate which receives coins moving in said coin passageway and which is rotatable relative to said coin passageway to bodily move the bottoms of said coins sideways toward said outlet, said gate acting in one position thereof to hold a coin therein, said gate acting in a second position thereof to direct the bottom of said coin toward said outlet, said coin passageway being adapted to hold a further coin therein if said gate is in said one position and is holding a coin therein, said coin passageway and said gate being adapted to hold said further coin in said coin passageway while said gate is in said second position, said gate automatically permitting said further coin to pass from said coin passageway into said gate whenever said gate moves from said second position to said one position, and means to selectively rotate said gate into said one or said second position.

11. A coin handling device which comprises a plurality of coin reservoirs, a plurality of coin-dispensing slides that are disposed so each of said coin-dispensing slides is adjacent a coin reservoir, a plurality of gear-supporting members that are disposed so each of said coin-dispensing slides has a gear-supporting member adjacent to it, each of said gear-supporting members having a gear mounted thereon so each of said coin-dispensing slides has a gear adjacent to it, a driving element for said gears, means to selectively move one of said gears toward and into driving relation with the coin-dispensing slide therefor to enable said one gear to drive said coin-dispensing slide when said one gear rotates or to move said one gear out of said driving relation with said coin-dispensing slide to permit said coin-dispensing slide to be at rest when said one gear rotates, and further means to selectively move another of said gears toward and into driving relation with the coin-dispensing slide therefor to enable said other gear to drive said coin-dispensing slide when said other gear rotates or to move said other gear out of said driving relation with said coin-dispensing slide to permit said coin-dispensing slide to be at rest when said other gear rotates.

12. A coin handling device as claimed in claim 11 wherein said means moves said one gear axially as said means move said one gear into and out of driving engagement with the coin-dispensing slide therefor, and wherein said further means moves said other gear axially as said further means moves said other gear into and out of driving engagement with the coin-dispensing slide therefor.

13. A coin handling device as claimed in claim 11 wherein said means and said further means move said gear-supporting members, and hence said one gear and said further gear, axially as said means and said further means move said one gear and said further gear into and out of driving engagement with the coin-dispensing slides therefor.

14. A coin handling device as claimed in claim 11 wherein each of said coin-dispensing slides has a first fixed wall and a second fixed wall, wherein each of said gears has an eccentrically-mounted abutment thereon, wherein one edge of said first fixed wall of each coin-dispensing slide is closer to the gear for said coin-dispensing slide than is the corresponding edge of said second fixed wall, wherein the eccentrically-mounted abutment on each gear always is in register with said first fixed wall of the coin-dispensing slide thereof but is not in register with said second fixed wall until said gear has been moved into position to drive said coin-dispensing slide.

15. A coin handling device as claimed in claim 11 wherein each of said coin-dispensing slides has a fixed wall, wherein each of said gears has an eccentrically-mounted abutment thereon, wherein said eccentrically-mounted abutment is in register with said fixed wall whenever said gear has been moved into position to drive said coin-dispensing slide, and wherein said eccentrically-mounted abutment is not in register with said fixed wall whenever said gear has been moved out of position to drive said coin-dispensing slide.

16. A coin handling device as claimed in claim 11 wherein each of said coin-dispensing slides has a fixed wall, wherein each of said gears has an eccentrically-mounted abutment thereon, wherein said eccentrically-mounted abutment is in register with said fixed wall whenever said gear has been moved into position to drive said coin-dispensing slide, wherein said fixed wall has a convex surface adjacent said eccentrically-mounted abutment, and wherein said eccentrically-mounted abutment has a radius of curvature which is less than the radius of eccentricity of said convex surface.

17. A coin handling device as claimed in claim 11 wherein each of said coin-dispensing slides has a fixed wall, wherein each of said gears has an eccentrically-mounted abutment thereon, wherein said eccentrically-mounted abutment is in register with said fixed wall whenever said gear has been moved into position to drive said coin-dispensing slide, and wherein said fixed wall has a surface that extends toward said eccentrically-mounted abutment whenever said gears are at rest.

18. A coin-handling device which comprises a plurality of coin reservoirs, a plurality of coin-dispensing slides that are disposed so each of said coin-dispensing slides is adjacent a coin reservoir, a plurality of gear-supporting members that are disposed so each of said coin-dispensing slides has a gear-supporting member adjacent to it, each of said gear-supporting members having a gear mounted thereon so each of said coin-dispensing slides has a gear adjacent to it, a driving element for said gears, means to selectively interconnect one of said gears and the coin-dispensing slide therefor to enable said one gear to drive said coin-dispensing slide when said one gear rotates, and further means to selectively interconnect another of said gears and the coin-dispensing slide therefor to enable said other gear to drive said coin-dispensing slide when said other gear rotates, said means and said further means including a cam shaft.

19. A coin handling device as claimed in claim 18 wherein said cam shaft normally is in position to interconnect said one gear with the coin-dispensing slide therefor but can be moved to a different position to interconnect said other gear with the coin-dispensing slide therefor.

20. A coin handling device as claimed in claim 18 wherein still further means selectively interconnect a further of said gears and the coin-dispensing slide therefor to enable said further gear to drive said coin-dispensing slide when said further gear rotates, and wherein said still further means includes said cam shaft.

21. A coin handling device as claimed in claim 18 wherein still further means selectively interconnect a further of said gears and the coin-dispensing slide therefor to enable said further gear to drive said coin-dispensing slide when said further gear rotates, wherein said still further means includes said cam shaft, wherein said cam shaft normally is in position to interconnect said one gear with the coin-dispensing slide therefor, wherein said cam shaft is movable in one direction to disconnect said one gear from the coin-dispensing slide therefor and to connect said other gear with the coin-dispensing slide therefor, and wherein said cam shaft is movable in the opposite direction to disconnect said one gear from the coin-dispensing slide therefor and to connect said further gear with the coin-dispensing slide therefor.

22. A coin handling device as claimed in claim 18 wherein still further means selectively interconnect a further of said gears and the coin-dispensing slide therefor to enable said further gear to drive said coin-dispensing slide when said further gear rotates, wherein said still further means includes said cam shaft, wherein said cam shaft normally is in position to interconnect said one gear with the coin-dispensing slide therefor, wherein said cam shaft is movable in one direction to disconnect said one gear from the coin-dispensing slide therefor and to interconnect said other gear with the coin-dispensing slide therefor, wherein said cam shaft is movable in the opposite direction to disconnect said one gear from the coin-dispensing slide therefor and to interconnect said further gear with the coin-dispensing slide therefor, wherein a selector motor selectively leaves said cam shaft in its normal position or moves said cam shaft in said one direction or moves said cam shaft in said opposite direction to selectively effect movement of the coin-dispensing slide adjacent said one gear, said other gear and said further gear.

23. A coin handling device as claimed in claim 18 wherein a selector motor selectively moves said cam shaft in a given direction to interconnect said other gear with the coin-dispensing slide therefor, and wherein said cam shaft is subsequently movable back in the opposite direction to disconnect said other gear from the coin-dispensing slide therefor.

24. A coin handling device as claimed in claim 18 wherein a selector motor selectively moves said cam shaft in a given direction to interconnect said other gear with the coin-dispensing slide therefor, wherein said cam shaft is subsequently movable back in the opposite direction to disconnect said other gear from the coin-dispensing slide therefor, wherein said selector motor is a stall-type motor, and wherein an abutment is movable with said cam shaft to engage a stop to fix the extent of movement of said cam shaft in said given direction.

25. A coin handling device as claimed in claim 18 wherein still further means selectively interconnect a further of said gears and the coin-dispensing slide therefor to enable said further gear to drive said coin-dispensing slide when said further gear rotates, wherein said still further means includes said cam shaft, wherein a selector motor selectively moves said cam shaft in one direction to interconnect said other gear with the coin-dispensing slide therefor, wherein said selector motor selectively moves said cam shaft in the opposite direction to interconnect said further gear with the coin-dispensing slide therefor, wherein said selector motor is a reversible stall-type motor, and wherein an abutment is movable with said cam shaft to engage stops to fix the extent of movement of said cam shaft in said one and said opposite directions.

26. A coin handling device as claimed in claim 18 wherein said gears translate as they are selectively interconnected with the coin-dispensing slides therefor, and wherein said cam shaft translates said gears.

27. A coin handling device as claimed in claim 18 wherein a movable gate is mounted adjacent a coin passageway, and wherein a connecting rod extends between said gate and said cam shaft, whereby said cam shaft not only controls the movement of said coin-dispensing slides but also controls the movement of said gate.

28. A coin-handling device as claimed in claim 18 wherein a movable gate is mounted adjacent a coin passageway, wherein a connecting rod extends between said gate and said cam shaft, whereby said cam shaft not only controls movement of said coin-dispensing slides but also controls the movement of said gate, and wherein said cam shaft is movable when said driving element for said gears is not driving said gears, whereby said cam shaft can be moved to effect movement of said gate without effecting movement of said coin-dispensing slides.

29. A coin handling device as claimed in claim 18 wherein a movable gate is mounted adjacent a coin passageway to dispense coins from said coin passageway in step-by-step fashion, wherein a connecting rod extends between said gate and said cam shaft, whereby said cam shaft not only controls the movement of said coin-dispensing slides but also controls the movement of said gate, wherein said gate can dispense only one coin per movement thereof, and wherein said cam shaft is movable when said driving element for said gears is not driving said gears, whereby said cam shaft can be moved to effect movement of said gate without effecting movement of said coin-dispensing slides.

30. A coin handling device as claimed in claim 18 wherein said cam shaft is rotatable in one direction to one position to selectively interconnect said one gear and the coin-dispensing slide therefor, wherein said cam shaft is rotatable in the opposite direction to a second position to selectively connect said other gear and the coin-dispensing slide therefor, wherein an abutment rotates as said cam shaft rotates, and wherein spaced-apart stops halt movement of said abutment as said cam shaft reaches said one or said other position.

31. A coin-handling device which comprises a plurality of coin reservoirs, a plurality of coin-dispensing slides that are disposed so each of said coin-dispensing slides is adjacent a coin reservoir, a plurality of gear-supporting members that are disposed so each of said coin-dispensing slides has a gear-supporting member adjacent to it, each of said gear-supporting members having a gear mounted thereon so each of said coin-dispensing slides has a gear adjacent to it, a driving element for said gears, means to selectively interconnect one of said gears and the coin-dispensing slide therefor to enable said one gear to drive said coin-dispensing slide when said one gear rotates, and further means to selectively interconnect another of said gears and the coin-dispensing slide therefor to enable said other gear to drive said coin-dispensing slide when said other gear rotates, said means and said further means being solenoids which move said gear-supporting members.

32. A coin-handling device as claimed in claim 31 wherein said gear-supporting members are rotatable and translatable shafts which serve as plungers for said solenoids and which are translated to move said gears.

33. A coin-handling device as claimed in claim 31 wherein a gate is disposed adjacent a passageway, and wherein a connecting means extends between said gate and one of said solenoids to cause said gate to move in a given direction whenever said one solenoid is energized.

34. A coin handling device which can receive coins, temporarily hold said coins, and then on a coin-by-coin basis direct said coins to an outlet and which comprises a coin passageway, an outlet, a gate which receives coins moving in said coin passageway and which can bodily move the bottoms of said coins sideways toward said outlet, said gate acting in one position thereof to hold a coin therein, said gate acting in a second position thereof to direct the bottom of said coin toward said outlet, said coin passageway being adapted to hold a further coin therein, if said gate is in said one position and is holding a coin therein, said coin passageway and said gate being adapted to hold said further coin in said coin passageway while said gate is in said second position, said gate automatically permitting said further coin to pass from said coin passageway into said gate whenever said gate moves from said second position to said one position, and means to selectively move said gate into said one position or said second position.

35. A coin handling device which can receive coins, temporarily hold said coins, and then on a coin-by-coin basis direct said coins to an outlet and which comprises a coin passageway, an outlet, a gate which receives coins moving in said coin passageway and which can bodily move the bottoms of said coins sideways toward said outlet, said gate acting in one position thereof to hold a coin therein, said gate acting in a second position thereof to direct the bottom of said coin toward said outlet, said coin passageway being adapted to hold a further coin therein if said gate is in said one position and is holding a coin therein, said coin passageway and said gate being adapted to hold said further coin in said coin passageway while said gate is in said second position, said gate automatically permitting said further coin to pass from said coin passageway into said gate whenever said gate moves from said second position to said one position, means to selectively move said gate into said one position or said second position, a wall that is disposed below said gate and that has an upper edge that intercepts and supports coins in said gate whenever said gate is in said one position, and said gate directing any coin therein to one side of said wall and hence toward said outlet whenever said gate is moved to said second position.

36. A coin handling device which can receive coins, temporarily hold said coins, and then on a coin-by-coin basis direct said coins to an outlet and which comprises a coin passageway, an outlet, a gate which receives coins moving in said coin passageway and which can bodily move the bottoms of said coins sideways toward said outlet, said gate acting in one position thereof to hold a coin therein, said gate acting in a second position thereof to direct the bottom of said coin toward said outlet, said coin passageway being adapted to hold a further coin therein if said gate is in said one position and is holding a coin therein, said coin passageway and said gate being adapted to hold said further coin in said coin passageway while said gate is in said second position, said gate automatically permitting said further coin to pass from said coin passageway into said gate whenever said gate moves from said second position to said one position, means to selectively move said gate into said one position or said second position, said gate having an entrance which is in register with said coin passageway whenever said gate is in said one position, and said gate having a coin-supporting surface which is adjacent said entrance and which is in register with said coin passageway whenever said gate is in said second position.

37. A coin handling device which can receive coins, temporarily hold said coins, and then on a coin-by-coin basis direct said coins to a desired outlet and which comprises a coin passageway, a gate which receives coins moving in said coin passageway and which is rotatable relative to said coin passageway to bodily move the bottoms of said coins sideways toward said outlet, said gate acting in one position thereof to hold a coin therein, said gate acting in a second position thereof to direct the bottom of said coin toward said outlet, said coin passageway being adapted to hold a further coin therein if said gate is in said one position and is holding a coin therein, said coin passageway and said gate being adapted to hold said further coin in said coin passageway while said gate is in said second position, said gate automatically permitting said further coin to pass from said coin passageway into said gate whenever said gate moves from said second position to said one position, means to selectively rotate said gate into said one or said second position, said coin passageway being part of a stationary structure of said coin handling device, said means being secured to a second stationary structure of said coin handling device that is separate from and displaced from the first said stationary structure of said coin handling device, a crank arm that is used to move said gate from a given one of said positions to another of said positions, and said position of said gate being adjustable relative to said first said stationary structure of said coin handling device to enable said crank arm to dispose said gate in register with said coin passageway.

38. A coin handling device which can accommodate coins of a plurality of different denominations and which comprises a coin-dispensing member that is disposable in a given position to receive and hold coins of one denomination and that is movable to a second position to release any coins of said one denomination which are held by it, a second coin-dispensing member which is movable to dispense coins of a second denomination, a driving member which is movable into and out of a predetermined position wherein it can be operated to move said second coin-dispensing member and thereby cause said second coin-dispensing member to dispense a coin of said second denomination, a shifting means which can selectively permit the first said coin-dispensing member to be in said given position and to permit said driving member to be out of said predetermined position or can cause said first said coin-dispensing member to be in said second position and can cause said driving member to be in said predetermined position, and a source of power which can operate said driving member, said source of power being selectively actuatable to operate said driving member when said driving member is in said predetermined position, said second coin-dispensing member acting to dispense coins of said second denomination only when said source of power is actuated and said shifting means causes said driving member to be in said predetermined position, whereby said shifting means can effect the dispensing of coins of said one denomination by causing said first said coin-dispensing member to be in said second position and by causing said driving member to be in said predetermined position while said source of power is inactive, and whereby said shifting means can effect the dispensing of coins of said second denomination by causing said first said coin-dispensing member to be in said second position and by causing said driving member to be in said predetermined position while said source of power is actuated.

39. A coin handling device as claimed in claim 38 wherein said shifting means simultaneously moves said first said coin-dispensing member into said second position and said driving member into said predetermined position, and wherein said shifting means simultaneously moves said first said coin-dispensing member to said given position and said driving member out of said predetermined position.

40. A coin handling device as claimed in claim 38 wherein said first said coin-dispensing member is rotatable, wherein said driving member is translatable, and wherein said shifting means includes an electrodynamic element and linkages that enable said electrodynamic element to simultaneously rotate said first said coin-dispensing member and translate said driving member.

41. A coin handling device as claimed in claim 38 wherein said driving member is a gear, wherein said source of power is an electric motor, wherein said shifting means includes an electro-dynamic element, wherein said first said coin-dispensing member is rotatable into and out of said given and said second positions, wherein said gear is shifted axially as it is moved into and out of said predetermined position, and wherein said electro-dynamic element simultaneously rotates said first said coin-dispensing element and effects axial shifting of said gear.

42. A coin handling device which comprises a coin-dispensing member that is movable to dispense coins of a given denomination, a driving member which is movable into and out of a predetermined position wherein it can be operated to move said coin-dispensing member to dispense a coin of said given denomination, and a source of power which can operate said driving member, said source of power being selectively actuatable to operate said driving member when said driving member is in said predetermined position, said coin-dispensing member acting to dispense coins of said given denomination only when said driving member is in said predetermined position and said source of power is actuated, whereby said driving member can be in said predetermined position without causing said coin-dispensing member to dispense a coin of said given denomination, said coin-dispensing member being a slide, said driving member being a gear, said source of power being an electric motor, and said gear being shifted axially as it is moved into and out of said predetermined position.

43. A coin-handling device which comprises walls that define a passageway which has a plurality of branches, a coin-directing element that is selectively disposable in a plurality of mechanically and positively fixed positions within said passageway, positioning means on said coin-directing element which has two spaced-apart positioning surfaces, two sets of positioning means adjacent said passageway, each of said two sets of positioning means having two spaced-apart positioning surfaces which are complementary to said two spaced-apart positioning surfaces of said coin-directing element, said two spaced-apart positioning surfaces of said coin-directing element coacting with the two spaced-apart positioning surfaces of one of said two sets of positioning means to mechanically and positively lock said coin-directing element in one of said plurality of mechanically and positively fixed positions within said passageway, said two spaced-apart positioning surfaces of said coin-directing element coacting with the two spaced-apart positioning surfaces of the other of said two sets of positioning means to mechanically and positively lock said coin-directing element in another of said plurality of mechanically and positively fixed positions within said passageway, said coin-directing element causing coins to pass through a selected branch of said passageway whenever said coin-directing element is in said one of said plurality of mechanically and positively fixed positions, said coin-directing element causing coins to pass through another selected branch of said passageway whenever said coin-directing element is in said other of said plurality of mechanically and positively fixed positions, and a coin-sensing element which is disposed out of, but closely adjacent to, said passageway at a point which is ahead of said coin-directing element irrespective of the mechanically and positively fixed position in which said coin-directing element is disposed, whereby each coin which passes to said coin-directing element will have to pass close to said coin-sensing element regardless of which of said plurality of mechanically and positively fixed positions is occupied by said coin-directing element.

44. A coin handling device as claimed in claim 43 wherein one of said selected branches of said passageway leads to a coin reservoir, wherein another of said selected branches of said passageway leads to an outlet, and wherein a coin which attempts to but cannot enter said coin reservoir will be directed to said outlet.

45. A coin-handling device which is disposable within a machine that will dispense coins, which can store inserted coins, which can dispense stored coins, which can be fixed in position within said coin-dispensing machine, and which comprises a first wall that has a generally-planar surface plus an elongated surface which is concave in cross section, a second wall that has an elongated surface which is concave in cross section and which is disposable in registry with said elongated surface of said first wall to cause said elongated surfaces on said first and second walls to coact to define a reservoir for coins, said second wall having a further surface which is in registry with at least a part of said concave elongated surface on said second wall but which faces away from said coin reservoir, said second wall having a still further surface which is disposable in confronting, but spaced, relation with said generally-planar surface on said first wall to define an area through which coins can pass to said coin reservoir, said further surface constituting a part of a passageway for rejected coins and slugs, said further surface having an upper portion which extends toward said first wall to substantially overlie the top of said coin reservoir to guide rejected coins and slugs past said top of said coin reservoir and thereby keep rejected coins and slugs from entering said top of said coin reservoir, said further surface having a lower portion which helps guide rejected coins and slugs toward a rejected coin outlet, whereby said further surface can guide rejected coins and slugs away from said top of said coin reservoir and thereafter guide said rejected coins and slugs toward said rejected coin outlet, a base which has a socket therein, said elongated surface on said first wall having the lower end thereof disposable within one part of said socket, said elongated surface on said second wall having the lower end thereof disposable within one part of said socket, said lower ends of said elongated surfaces on said first and second walls coacting with said socket to substantially prevent lateral movement of said lower ends of said elongated surfaces on said first and second walls relative to each other or relative to said base after said lower ends of said elongated surfaces on said first and second walls have been disposed within said one part of said socket, a fastener which engages said first and second walls at locations which are displaced vertically from said base, said fastener substantially preventing lateral relative movement of those portions of said first and second walls which it engages and thereby helping prevent lateral relative movement of upper portions of said first and second walls and of upper portions of said elongated surfaces on said first and second walls, whereby said socket and said fastener coact to help prevent lateral relative movement of said upper portions and of lower portions of said first and second walls and thereby help prevent lateral relative movement of said upper portions and of said lower portions of said elongated surfaces on said first and second walls, said elongated surfaces on said first and second walls being separable in the vicinity of a plane which intersects the interior of said coin reservoir and which also intersects the interior of said socket in said base, said elongated surface on said second wall being in registry with said elongated surface on said first wall whenever said lower ends of said elongated surfaces on said first and second walls are disposed within said one part of said socket and said fastener is assembled with said first and second walls, said fastener being a rotatable element which is rotatable relative to said first wall and also is rotatable relative to said second wall to help prevent lateral relative movement of said upper portions of said first and second walls and thereby help prevent lateral relative movement of said upper portions of said elongated surfaces on said first and second walls, a coin-dispensing slide that is mounted for movement relative to said base and to said socket in said base to dispense coins which have been stored in said coin reservoir, said elongated surface on said first wall having edges that are disposable immediately adjacent edges on said elongated surface on said second wall to keep coins that enter said coin reservoir from escaping from said coin reservoir by passing between said confronting edges of said elongated surfaces on said first and second walls, the coin reservoir automatically receiving and storing coins which move through said area toward said coin reservoir, said coin reservoir automatically permitting stored coins to move downwardly toward said socket in said base so the lowermost of said stored coins can be dispensed by movement of said coin-dispensing slide relative to said base and relative to said socket in said base, said generally-planar surface and said elongated surface on said first wall being molded as a unit so any coin passing through said area toward said coin reservoir does not have to pass a joint between discrete parts of said coin-handling device, whereby coins can freely pass through said area toward said coin reservoir with no risk of being intercepted and stopped by such a joint.

46. A coin-handling device as claimed in claim 45 wherein said passageway for rejected coins and slugs has a closure which is in registry with, but which is spaced a short distance from, said further surface on said second wall, said closure being separate and distinct from said second wall but being held in spaced position relative to said further surface on said second wall to permit ready passage of rejected coins and slugs through said passageway for rejected coins and slugs.

47. A coin-handling device as claimed in claim 45 wherein said generally-planar surface on said first wall is displaced from the geometric center of said coin reservoir, whereby coins which are close to said generally-planar surface as they enter said coin reservoir must move away from said generally-planar surface and toward said geometric center of said coin reservoir as they become part of the coins stored within said coin reservoir.

* * * * *